US007926893B2

(12) United States Patent
Hayashi et al.

(10) Patent No.: US 7,926,893 B2
(45) Date of Patent: Apr. 19, 2011

(54) RECORDING APPARATUS

(75) Inventors: Masashi Hayashi, Sagamihara (JP); Norihiro Kawatoko, Yokohama (JP); Hidehiko Kanda, Yokohama (JP); Toshiyuki Chikuma, Tokyo (JP); Minoru Teshigawara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 491 days.

(21) Appl. No.: 12/135,795

(22) Filed: Jun. 9, 2008

(65) Prior Publication Data

US 2009/0002439 A1 Jan. 1, 2009

(30) Foreign Application Priority Data

Jun. 29, 2007 (JP) ..... 2007-172740

(51) Int. Cl.
*B41J 29/38* (2006.01)

(52) U.S. Cl. ..... 347/10; 347/12

(58) Field of Classification Search ..... 347/12, 347/14, 19, 40, 43, 9–11, 41; 358/1.2, 1.9
See application file for complete search history.

(56) References Cited

U.S. PATENT DOCUMENTS

| | | | | |
|---|---|---|---|---|
| 6,412,903 | B1 * | 7/2002 | Lee et al. | 347/19 |
| 6,554,387 | B1 * | 4/2003 | Otsuki | 347/19 |
| 6,644,783 | B1 * | 11/2003 | Tsuruoka | 347/41 |
| 7,325,900 | B2 * | 2/2008 | Hayashi et al. | 347/41 |

FOREIGN PATENT DOCUMENTS

| | | | |
|---|---|---|---|
| JP | 2004-009489 | A | 1/2004 |
| WO | 00/06386 | A2 | 2/2000 |

* cited by examiner

*Primary Examiner* — Lamson D Nguyen
(74) *Attorney, Agent, or Firm* — Canon USA, Inc. IP Division

(57) ABSTRACT

A recording apparatus scans a recording head in a main scanning direction to perform time-division driving for a plurality of blocks of recording elements to perform recording. The recording apparatus includes an obtaining unit configured to obtain information regarding inclination of the recording element array with respect to a main scanning direction, a first changing unit configured to change, in units of recording elements, based on the obtained information, storage positions of recording data items that are stored in a storage unit and that are assigned to recording elements in each of groups, each of the groups including recording elements belonging to the blocks in the recording element array which are consecutive, and a second changing unit configured to change, in units of groups, based on the obtained information, the storage positions of the recording data items in the main scanning direction.

9 Claims, 40 Drawing Sheets

FIG. 10

BLOCK-DRIVING-ORDER DATA

| | | | | |
|---|---|---|---|---|
| ADDRESS 0 | 0 | 0 | 0 | 0 |
| | 0 | 0 | 0 | 1 |
| | 0 | 0 | 1 | 0 |
| | 0 | 0 | 1 | 1 |
| | 0 | 1 | 0 | 0 |
| | 0 | 1 | 0 | 1 |
| | 0 | 1 | 1 | 0 |
| | 0 | 1 | 1 | 1 |
| | 1 | 0 | 0 | 0 |
| | 1 | 0 | 0 | 1 |
| | 1 | 0 | 1 | 0 |
| | 1 | 0 | 1 | 1 |
| | 1 | 1 | 0 | 0 |
| | 1 | 1 | 0 | 1 |
| | 1 | 1 | 1 | 0 |
| ADDRESS 15 | 1 | 1 | 1 | 1 |

FIG. 17A
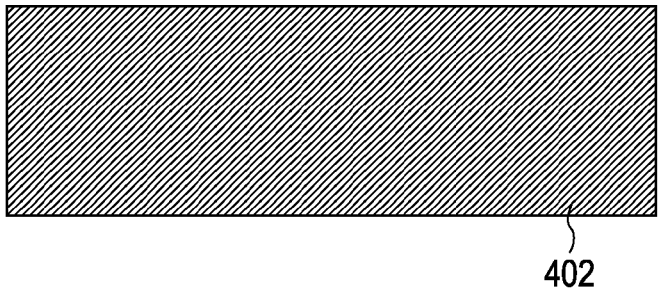
FIG. 17B
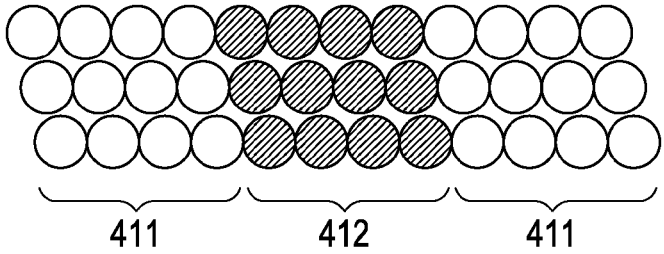
FIG. 18
| | NOZZLE NO. | CORRECTION VALUE |
|---|---|---|
| GROUP 0 | 0 TO 15 | 0 |
| GROUP 1 | 16 TO 31 | 2 |
| GROUP 2 | 32 TO 47 | 4 |
| GROUP 3 | 48 TO 63 | 6 |
| GROUP 4 | 64 TO 79 | 8 |
| GROUP 5 | 80 TO 95 | 10 |
| GROUP 6 | 96 TO 111 | 12 |
| GROUP 7 | 112 TO 127 | 14 |

FIG. 23

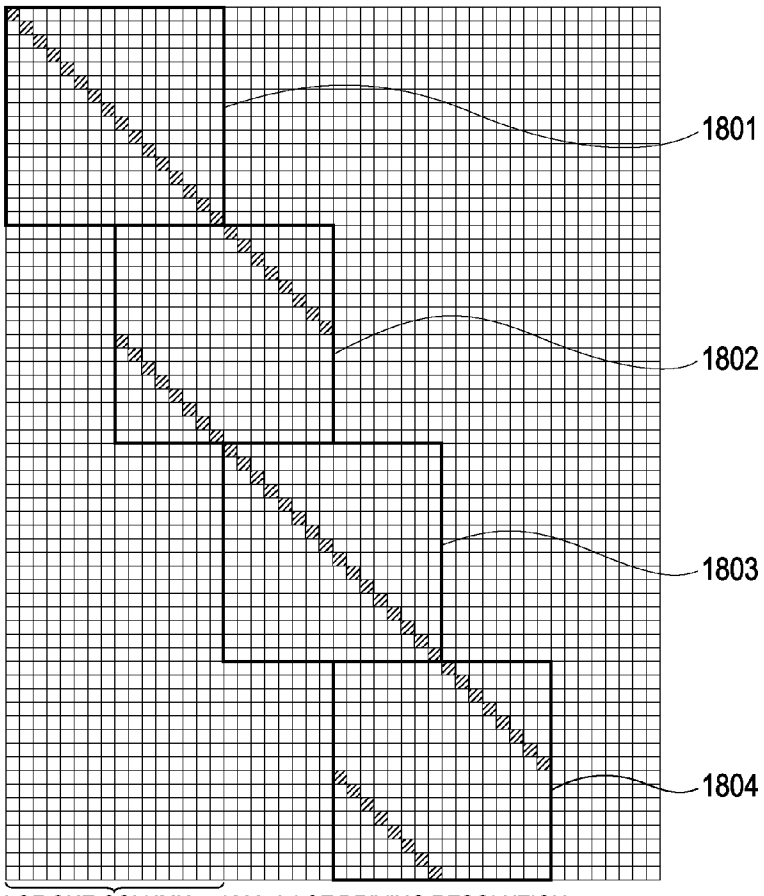

| | NOZZLE NO. | SELECTION BLOCK | RECORDING DATA COLUMN 0 | RECORDING DATA COLUMN 1 | RECORDING DATA COLUMN 2 | CORRECTION VALUE ROUGH METERING VALUE | CORRECTION VALUE FINE METERING VALUE |
|---|---|---|---|---|---|---|---|
| GROUP 0 | 0 | 0 | ○ | × | × | 0 | 0 |
| | 1 | 1 | ○ | × | × | | |
| | 2 | 2 | ○ | × | × | | |
| | 3 | 3 | ○ | × | × | | |
| | 4 | 4 | ○ | × | × | | |
| | 5 | 5 | ○ | × | × | | |
| | 6 | 6 | ○ | × | × | | |
| | 7 | 7 | ○ | × | × | | |
| | 8 | 8 | ○ | × | × | | |
| | 9 | 9 | ○ | × | × | | |
| | 10 | 10 | ○ | × | × | | |
| | 11 | 11 | ○ | × | × | | |
| | 12 | 12 | ○ | × | × | | |
| | 13 | 13 | ○ | × | × | | |
| | 14 | 14 | ○ | × | × | | |
| | 15 | 15 | ○ | × | × | | |
| GROUP 1 | 16 | 0 | × | ○ | × | 0 | 8 |
| | 17 | 1 | × | ○ | × | | |
| | 18 | 2 | × | ○ | × | | |
| | 19 | 3 | × | ○ | × | | |
| | 20 | 4 | × | ○ | × | | |
| | 21 | 5 | × | ○ | × | | |
| | 22 | 6 | × | ○ | × | | |
| | 23 | 7 | × | ○ | × | | |
| | 24 | 8 | ○ | × | × | | |
| | 25 | 9 | ○ | × | × | | |
| | 26 | 10 | ○ | × | × | | |
| | 27 | 11 | ○ | × | × | | |
| | 28 | 12 | ○ | × | × | | |
| | 29 | 13 | ○ | × | × | | |
| | 30 | 14 | ○ | × | × | | |
| | 31 | 15 | ○ | × | × | | |
| GROUP 2 | 32 | 0 | × | ○ | × | 1 | 0 |
| | 33 | 1 | × | ○ | × | | |
| | 34 | 2 | × | ○ | × | | |
| | 35 | 3 | × | ○ | × | | |
| | 36 | 4 | × | ○ | × | | |
| | 37 | 5 | × | ○ | × | | |
| | 38 | 6 | × | ○ | × | | |
| | 39 | 7 | × | ○ | × | | |
| | 40 | 8 | × | ○ | × | | |
| | 41 | 9 | × | ○ | × | | |
| | 42 | 10 | × | ○ | × | | |
| | 43 | 11 | × | ○ | × | | |
| | 44 | 12 | × | ○ | × | | |
| | 45 | 13 | × | ○ | × | | |
| | 46 | 14 | × | ○ | × | | |
| | 47 | 15 | × | ○ | × | | |
| GROUP 3 | 48 | 0 | × | × | ○ | 1 | 8 |
| | 49 | 1 | × | × | ○ | | |
| | 50 | 2 | × | × | ○ | | |
| | 51 | 3 | × | × | ○ | | |
| | 52 | 4 | × | × | ○ | | |
| | 53 | 5 | × | × | ○ | | |
| | 54 | 6 | × | × | ○ | | |
| | 55 | 7 | × | × | ○ | | |
| | 56 | 8 | ○ | ○ | × | | |
| | 57 | 9 | ○ | ○ | × | | |
| | 58 | 10 | ○ | ○ | × | | |
| | 59 | 11 | ○ | ○ | × | | |
| | 60 | 12 | ○ | ○ | × | | |
| | 61 | 13 | ○ | ○ | × | | |
| | 62 | 14 | ○ | ○ | × | | |
| | 63 | 15 | ○ | ○ | × | | |

| | NOZZLE NO. | SELECTION BLOCK | RECORDING DATA COLUMN 0 | RECORDING DATA COLUMN 1 | CORRECTION VALUE ROUGH METERING VALUE | CORRECTION VALUE FINE METERING VALUE |
|---|---|---|---|---|---|---|
| GROUP 0 | 0 | 0 | ○ | × | 0 | 0 |
| | 1 | 1 | ○ | × | | |
| | 2 | 2 | ○ | × | | |
| | 3 | 3 | ○ | × | | |
| | 4 | 4 | ○ | × | | |
| | 5 | 5 | ○ | × | | |
| | 6 | 6 | ○ | × | | |
| | 7 | 7 | ○ | × | | |
| | 8 | 8 | ○ | × | | |
| | 9 | 9 | ○ | × | | |
| | 10 | 10 | ○ | × | | |
| | 11 | 11 | ○ | × | | |
| | 12 | 12 | ○ | × | | |
| | 13 | 13 | ○ | × | | |
| | 14 | 14 | ○ | × | | |
| | 15 | 15 | ○ | × | | |
| GROUP 1 | 16 | 0 | × | ○ | 0 | 4 |
| | 17 | 1 | × | ○ | | |
| | 18 | 2 | × | ○ | | |
| | 19 | 3 | × | ○ | | |
| | 20 | 4 | ○ | × | | |
| | 21 | 5 | ○ | × | | |
| | 22 | 6 | ○ | × | | |
| | 23 | 7 | ○ | × | | |
| | 24 | 8 | ○ | × | | |
| | 25 | 9 | ○ | × | | |
| | 26 | 10 | ○ | × | | |
| | 27 | 11 | ○ | × | | |
| | 28 | 12 | ○ | × | | |
| | 29 | 13 | ○ | × | | |
| | 30 | 14 | ○ | × | | |
| | 31 | 15 | ○ | × | | |
| GROUP 2 | 32 | 0 | × | ○ | 0 | 8 |
| | 33 | 1 | × | ○ | | |
| | 34 | 2 | × | ○ | | |
| | 35 | 3 | × | ○ | | |
| | 36 | 4 | × | ○ | | |
| | 37 | 5 | × | ○ | | |
| | 38 | 6 | × | ○ | | |
| | 39 | 7 | × | ○ | | |
| | 40 | 8 | ○ | × | | |
| | 41 | 9 | ○ | × | | |
| | 42 | 10 | ○ | × | | |
| | 43 | 11 | ○ | × | | |
| | 44 | 12 | ○ | × | | |
| | 45 | 13 | ○ | × | | |
| | 46 | 14 | ○ | × | | |
| | 47 | 15 | ○ | × | | |
| GROUP 3 | 48 | 0 | × | ○ | 0 | 12 |
| | 49 | 1 | × | ○ | | |
| | 50 | 2 | × | ○ | | |
| | 51 | 3 | × | ○ | | |
| | 52 | 4 | × | ○ | | |
| | 53 | 5 | × | ○ | | |
| | 54 | 6 | × | ○ | | |
| | 55 | 7 | × | ○ | | |
| | 56 | 8 | × | ○ | | |
| | 57 | 9 | × | ○ | | |
| | 58 | 10 | × | ○ | | |
| | 59 | 11 | × | ○ | | |
| | 60 | 12 | × | × | | |
| | 61 | 13 | × | × | | |
| | 62 | 14 | × | × | | |
| | 63 | 15 | × | × | | |

| | NOZZLE NO. | SELECTION BLOCK | RECORDING DATA COLUMN 0 | RECORDING DATA COLUMN 1 | CORRECTION VALUE ROUGH METERING VALUE | CORRECTION VALUE FINE METERING VALUE |
|---|---|---|---|---|---|---|
| GROUP 0 | 0 | 0 | × | ○ | 0 | 12 |
| | 1 | 1 | × | ○ | | |
| | 2 | 2 | × | ○ | | |
| | 3 | 3 | × | ○ | | |
| | 4 | 4 | ○ | × | | |
| | 5 | 5 | ○ | × | | |
| | 6 | 6 | ○ | × | | |
| | 7 | 7 | ○ | × | | |
| | 8 | 8 | ○ | × | | |
| | 9 | 9 | ○ | × | | |
| | 10 | 10 | ○ | × | | |
| | 11 | 11 | ○ | × | | |
| | 12 | 12 | ○ | × | | |
| | 13 | 13 | ○ | × | | |
| | 14 | 14 | ○ | × | | |
| | 15 | 15 | ○ | × | | |
| GROUP 1 | 16 | 0 | × | ○ | 0 | 8 |
| | 17 | 1 | × | ○ | | |
| | 18 | 2 | × | ○ | | |
| | 19 | 3 | × | ○ | | |
| | 20 | 4 | × | ○ | | |
| | 21 | 5 | × | ○ | | |
| | 22 | 6 | × | ○ | | |
| | 23 | 7 | × | ○ | | |
| | 24 | 8 | ○ | × | | |
| | 25 | 9 | ○ | × | | |
| | 26 | 10 | ○ | × | | |
| | 27 | 11 | ○ | × | | |
| | 28 | 12 | ○ | × | | |
| | 29 | 13 | ○ | × | | |
| | 30 | 14 | ○ | × | | |
| | 31 | 15 | ○ | × | | |
| GROUP 2 | 32 | 0 | × | ○ | 0 | 4 |
| | 33 | 1 | × | ○ | | |
| | 34 | 2 | × | ○ | | |
| | 35 | 3 | × | ○ | | |
| | 36 | 4 | × | ○ | | |
| | 37 | 5 | × | ○ | | |
| | 38 | 6 | × | ○ | | |
| | 39 | 7 | × | ○ | | |
| | 40 | 8 | × | ○ | | |
| | 41 | 9 | × | ○ | | |
| | 42 | 10 | × | ○ | | |
| | 43 | 11 | × | ○ | | |
| | 44 | 12 | ○ | × | | |
| | 45 | 13 | ○ | × | | |
| | 46 | 14 | ○ | × | | |
| | 47 | 15 | ○ | × | | |
| GROUP 3 | 48 | 0 | × | ○ | 0 | 0 |
| | 49 | 1 | × | ○ | | |
| | 50 | 2 | × | ○ | | |
| | 51 | 3 | × | ○ | | |
| | 52 | 4 | × | ○ | | |
| | 53 | 5 | × | ○ | | |
| | 54 | 6 | × | ○ | | |
| | 55 | 7 | × | ○ | | |
| | 56 | 8 | × | ○ | | |
| | 57 | 9 | × | ○ | | |
| | 58 | 10 | × | ○ | | |
| | 59 | 11 | × | ○ | | |
| | 60 | 12 | × | ○ | | |
| | 61 | 13 | × | ○ | | |
| | 62 | 14 | × | ○ | | |
| | 63 | 15 | × | ○ | | |

FIG. 27

| | NOZZLE NO. | SELECTION BLOCK | RECORDING DATA | | | | CORRECTION VALUE | |
|---|---|---|---|---|---|---|---|---|
| | | | COLUMN 0 | COLUMN 1 | COLUMN 2 | COLUMN 3 | ROUGH METERING VALUE | FINE METERING VALUE |
| GROUP 0 | 0 | 0 | ○ | ○ | × | × | 0 | 0 |
| | 1 | 1 | ○ | ○ | × | × | | |
| | 2 | 2 | ○ | ○ | × | × | | |
| | 3 | 3 | ○ | ○ | × | × | | |
| | 4 | 4 | ○ | ○ | × | × | | |
| | 5 | 5 | ○ | ○ | × | × | | |
| | 6 | 6 | ○ | ○ | × | × | | |
| | 7 | 7 | ○ | ○ | × | × | | |
| | 8 | 8 | ○ | ○ | × | × | | |
| | 9 | 9 | ○ | ○ | × | × | | |
| | 10 | 10 | ○ | ○ | × | × | | |
| | 11 | 11 | ○ | ○ | × | × | | |
| | 12 | 12 | ○ | ○ | × | × | | |
| | 13 | 13 | ○ | ○ | × | × | | |
| | 14 | 14 | ○ | ○ | × | × | | |
| | 15 | 15 | ○ | ○ | × | × | | |
| GROUP 1 | 16 | 0 | × | ○ | ○ | × | 0 | 8 |
| | 17 | 1 | × | ○ | ○ | × | | |
| | 18 | 2 | × | ○ | ○ | × | | |
| | 19 | 3 | × | ○ | ○ | × | | |
| | 20 | 4 | × | ○ | ○ | × | | |
| | 21 | 5 | × | ○ | ○ | × | | |
| | 22 | 6 | × | ○ | ○ | × | | |
| | 23 | 7 | × | ○ | ○ | × | | |
| | 24 | 8 | ○ | ○ | × | × | | |
| | 25 | 9 | ○ | ○ | × | × | | |
| | 26 | 10 | ○ | ○ | × | × | | |
| | 27 | 11 | ○ | ○ | × | × | | |
| | 28 | 12 | ○ | ○ | × | × | | |
| | 29 | 13 | ○ | ○ | × | × | | |
| | 30 | 14 | ○ | ○ | × | × | | |
| | 31 | 15 | ○ | ○ | × | × | | |
| GROUP 2 | 32 | 0 | × | ○ | ○ | × | 1 | 0 |
| | 33 | 1 | × | ○ | ○ | × | | |
| | 34 | 2 | × | ○ | ○ | × | | |
| | 35 | 3 | × | ○ | ○ | × | | |
| | 36 | 4 | × | ○ | ○ | × | | |
| | 37 | 5 | × | ○ | ○ | × | | |
| | 38 | 6 | × | ○ | ○ | × | | |
| | 39 | 7 | × | ○ | ○ | × | | |
| | 40 | 8 | × | ○ | ○ | × | | |
| | 41 | 9 | × | ○ | ○ | × | | |
| | 42 | 10 | × | ○ | ○ | × | | |
| | 43 | 11 | × | ○ | ○ | × | | |
| | 44 | 12 | × | ○ | ○ | × | | |
| | 45 | 13 | × | ○ | ○ | × | | |
| | 46 | 14 | × | ○ | ○ | × | | |
| | 47 | 15 | × | ○ | ○ | × | | |
| GROUP 3 | 48 | 0 | × | × | ○ | ○ | 1 | 8 |
| | 49 | 1 | × | × | ○ | ○ | | |
| | 50 | 2 | × | × | ○ | ○ | | |
| | 51 | 3 | × | × | ○ | ○ | | |
| | 52 | 4 | × | × | ○ | ○ | | |
| | 53 | 5 | × | × | ○ | ○ | | |
| | 54 | 6 | × | × | ○ | ○ | | |
| | 55 | 7 | × | × | ○ | ○ | | |
| | 56 | 8 | × | ○ | ○ | × | | |
| | 57 | 9 | × | ○ | ○ | × | | |
| | 58 | 10 | × | ○ | ○ | × | | |
| | 59 | 11 | × | ○ | ○ | × | | |
| | 60 | 12 | × | ○ | ○ | × | | |
| | 61 | 13 | × | ○ | ○ | × | | |
| | 62 | 14 | × | ○ | ○ | × | | |
| | 63 | 15 | × | ○ | ○ | × | | |

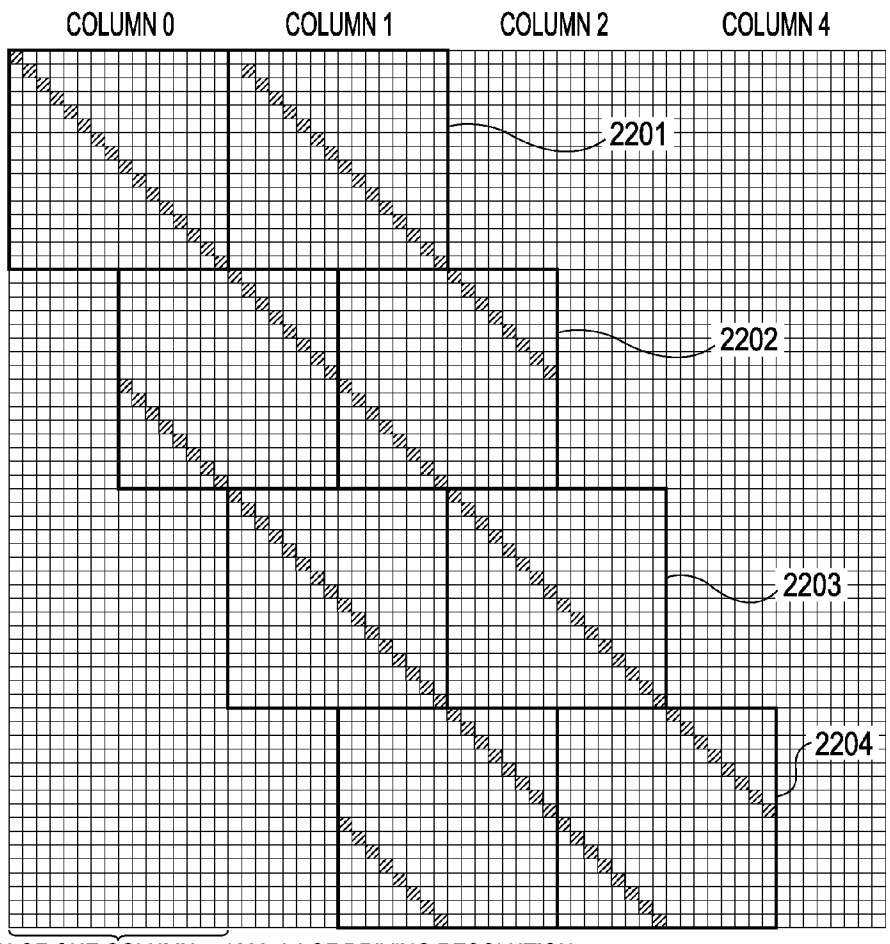

FIG. 29

| | NOZZLE NO. | CORRECTION VALUE | |
|---|---|---|---|
| | | ROUGH METERING VALUE | FINE METERING VALUE |
| GROUP 0 | 0 TO 15 | 0 | 0 |
| GROUP 1 | 16 TO 31 | 0 | 4 |
| GROUP 2 | 32 TO 47 | 0 | 8 |
| GROUP 3 | 48 TO 63 | 0 | 12 |

FIG. 38

| | | Bank_0 | Bank_1 | Bank_2 |
|---|---|---|---|---|
| BLOCK 0 | b0<br>b7 | Ad0h | Ad10h | Ad20h |
| BLOCK 1 | b0<br>b7 | Ad1h | Ad11h | Ad21h |
| BLOCK 2 | b0<br>b7 | Ad2h | Ad12h | Ad22h |
| BLOCK 3 | b0<br>b7 | Ad3h | Ad13h | Ad23h |
| BLOCK 4 | b0<br>b7 | Ad4h | Ad14h | Ad24h |
| BLOCK 5 | b0<br>b7 | Ad5h | Ad15h | Ad25h |
| BLOCK 6 | b0<br>b7 | Ad6h | Ad16h | Ad26h |
| BLOCK 7 | b0<br>b7 | Ad7h | Ad17h | Ad27h |
| BLOCK 8 | b0<br>b7 | Ad8h | Ad18h | Ad28h |
| BLOCK 9 | b0<br>b7 | Ad9h | Ad19h | Ad29h |
| BLOCK 10 | b0<br>b7 | Adah | Ad1ah | Ad2ah |
| BLOCK 11 | b0<br>b7 | Adbh | Ad1bh | Ad2bh |
| BLOCK 12 | b0<br>b7 | Adch | Ad1ch | Ad2ch |
| BLOCK 13 | b0<br>b7 | Addh | Ad1dh | Ad2dh |
| BLOCK 14 | b0<br>b7 | Adeh | Ad1eh | Ad2eh |
| BLOCK 15 | b0<br>b7 | Adfh | Ad1fh | Ad2fh |

RECORDING APPARATUS

BACKGROUND OF THE INVENTION

1. Field of the Invention

The present invention relates to a recording apparatus configured to eject ink drops from ink ejection ports provided in recording heads on the basis of recording data to record an image on a recording medium.

2. Description of the Related Art

An ink jet recording apparatus generally includes a recording head in which ink ejection ports and recording elements serving as energy generators including heaters and piezoelectric elements and adapted to eject ink drops are arranged in correspondence with each other. The recording head is moved in a main scanning direction and ink drops are ejected in a recording area to perform recording scanning. A recording medium is fed in a sub-scanning direction perpendicular to the main scanning direction. The recording scanning and the feeding of the recording medium are repeatedly performed to record an image on the recording medium.

Due to a reason such as the high cost of power supply, it may be difficult to provide a large power supply capacity sufficient for an ink jet recording apparatus to simultaneously eject ink drops from all ink ejection ports in each array of ink ejection ports (array of recording elements) of the recording head. In order to overcome this problem, the recording elements are driven in a time-division manner. The time-division driving will now be described. For each array of ink ejection ports, the recording elements are divided into a plurality of groups, and the recording elements in each of the groups are assigned different blocks. The recording elements belonging to the same block are driven simultaneously or substantially simultaneously, and the recording elements in the respective blocks are sequentially driven at certain intervals of time. The driving of the recording elements is performed through one cycle, thereby driving all the recording elements. This driving operation is repeated in the main scanning direction to perform recording in a recording area corresponding to one line of main scanning.

In an ink jet recording apparatus, an error in attachment of a recording head or error in assembling of the recording head may cause the recording head to be inclined when it is attached to the ink jet recording apparatus. Thus, deviation in position of dots formed in accordance with this inclination, called inclination deviation, may occur.

The inclination deviation will be described in detail with reference to FIGS. 30 and 31.

FIG. 30 shows an arrangement of dots formed on a recording medium in a case where a recording head is ideally attached to an ink jet recording apparatus, that is, in a case where no inclination deviation has occurred. In FIG. 30, a recording head 11 is attached parallel to a sub-scanning direction indicated by an arrow B, and is moved from left to right in a main scanning direction indicated by an arrow A across the recording medium 12. The recording medium 12 is fed upward from below, as viewed in FIG. 30, in the direction indicated by the arrow B. The top side of FIG. 30 is a downstream side in the sub-scanning direction, and the bottom side of FIG. 30 is an upstream side in the sub-scanning direction.

Recording elements (not shown) disposed in correspondence with 128 ink ejection ports 13 of the recording head 11 are divided into eight groups (group 0 to group 7) each having 16 recording elements. The recording elements in each of the groups are assigned different blocks, and are sequentially driven at certain intervals of time in units of recording elements in the same block. In this example, the recording elements are divided, in turn, into groups 0 to 7 each having 16 recording elements from the downstream side in the sub-scanning direction. The recording elements in each of the groups are assigned blocks 0 to 15, in order, from the downstream side in the sub-scanning direction. The recording elements in each of the groups are driven in the order of block 0, block 1, block 2, . . . , and block 15, and one cycle of driving is thus completed.

Without inclination deviation, dots formed by one cycle of driving of the recording elements of blocks 0 to 15 are formed within the same column (region with a width of one pixel). FIG. 30 shows an arrangement of dots formed on the recording medium 12 by driving the recording elements in the order of blocks 0 to 15 and assigning recording data for three columns, namely, the first to third columns, to the recording elements. In this way, dots formed by one cycle of driving of recording elements in each group are arranged in the same column, thereby obtaining an image having a high recording quality.

FIG. 31 shows an arrangement of dots as a result of the occurrence of inclination deviation when an image is recorded with a structure similar to that shown in FIG. 30. As shown in FIG. 31, dots formed by the recording elements that are assigned to the same block are shifted in the main scanning direction between the upstream side and the downstream side. Further, some dots may be formed at positions that lie outside the target column where the dots are to be arranged. For example, for group 2, four dots of blocks 0 to 3 are formed outside the target column. Due to the occurrence of such inclination deviation, dots may be formed at positions outside the target column, leading to deterioration in image quality.

A technique has been proposed for correcting inclination deviation by providing a detector configured to detect information regarding inclination deviation and changing ejection timings of a recording head on the basis of the detected information regarding inclination deviation.

Japanese Patent Laid-Open No. 2004-09489 describes an ink jet recording apparatus arranged to record an image by time-division driving, in which the position at which recording data is read from a recording buffer is changed in accordance with inclination deviation to change ejection timings of a recording head.

An inclination deviation correction method described in Japanese Patent Laid-Open No. 2004-09489 will be described with reference to FIGS. 32 and 33.

The ink jet recording apparatus described in Japanese Patent Laid-Open No. 2004-09489 has a structure similar to that shown in FIG. 30. That is, recording elements provided in a recording head 11 are divided into eight groups 0 to 7, each having 16 recording elements, and the recording elements in each of the groups are assigned block numbers 0 to 15. The recording elements in each of the groups are driven in the order of block 0, block 1, block 2, . . . , and block 15. The following description will be given in the context of an example in which all ink ejection ports 13 of the recording head 11 are used to form dots in an area of three columns from the first to third columns to record an image.

In this example, the recording head 11 is inclined clockwise when it is attached to a recording medium 12, thus causing inclination deviation in which positions of dots formed by the ink ejection ports 13 located at both ends of the recording head 11 are about one column shifted in the main scanning direction.

FIG. 32 is a diagram showing nozzle numbers assigned to the recording elements of groups 0 to 7, a driving order, recording data, and a dot arrangement. The dot arrangement shown in FIG. 32 represents a schematic arrangement of dots formed on the recording medium 12 under the absence of inclination deviation. The nozzle numbers are numbers that are provisionally assigned to the individual recording elements, and the recording elements are assigned nozzle numbers 0 to 127 in order from the recording element located downstream in the sub-scanning direction.

In Japanese Patent Laid-Open No. 2004-09489, the position at which recording data is read from a recording buffer is changed for every group in accordance with inclination deviation. In case of one-column inclination deviation, as shown in FIG. 32, recording data assigned to the recording elements of groups 4 to 7 is read from a position one column shifted in the main scanning direction with respect to the true column.

Specifically, recording data is assigned to the recording elements of groups 0 to 3 so that dots are formed in an area of the first to third columns. The recording elements of groups 4 to 7 are, on the other hand, assigned recording data by changing the read position of the recording data so that dots are formed in an area of the second to fourth columns.

FIG. 33 shows an actual arrangement of dots formed on a recording medium as a result of changing the read position of recording data in the manner described with reference to FIG. 32. In FIG. 33, hollow circles shown on the recording medium 12 in correspondence with groups 4 to 7 represent dots that will be formed when recording data of the first column is assigned to the recording elements of groups 4 to 7 without performing the above-described correction. As a result of the correction of inclination deviation described in Japanese Patent Laid-Open No. 2004-09489, the dots for groups 4 to 7 are formed at positions one column offset to the right in the main scanning direction with respect to the positions indicated by the hollow circles. Thus, as is apparent from FIG. 33, the amount of deviation in the main scanning direction for dots in the same block can be reduced between the upstream and downstream sides in the sub-scanning direction.

In the correction method described in Japanese Patent Laid-Open No. 2004-09489, however, other problems may occur. In this method, the read position of recording data is changed for all recording elements within a group. Thus, for a group for which the read position of recording data has been changed, a dot that lies outside the true column may exist. For example, focusing on the first column of group 6, without correction of inclination deviation, four dots for blocks 12 to 15 are arranged in the first column and the rest 12 dots for blocks 0 to 11 are arranged to the left with respect to the first column. If, as a result of the correction of inclination deviation, recording data for the first column is assigned at a timing at which all the recording elements within the group are recorded in the second column, the four dots for blocks 12 to 15 are arranged in the second column instead of the true, first column.

Moreover, depending on the amount of inclination of the recording head, like groups 1 to 3, a group may exist for which even a dot arranged at a position outside the true column might not be corrected.

The correction method described in Japanese Patent Laid-Open No. 2004-09489 can reduce deterioration in image quality caused by inclination deviation. However, a dot may be arranged at a position outside the correct area.

Furthermore, if the amount of inclination of the recording head is small, a group for which correction is not performed may exist and a dot outside the true column may not be corrected. In such an existing method of correcting inclination deviation, therefore, there is a limit to the degree of preventing deterioration in image quality.

SUMMARY OF THE INVENTION

An embodiment of the present invention provides a recording apparatus capable of reducing deterioration in image quality caused by inclination deviation.

According to an aspect of the present invention, a recording apparatus scans a recording head in a main scanning direction to perform time-division driving for a plurality of blocks of recording elements, the recording head including a recording element array having a plurality of recording elements, each of blocks including recording elements located at discrete positions in the recording element array. The recording apparatus includes a storage unit configured to store recording data items; an obtaining unit configured to obtain information regarding inclination of the recording element array with respect to the main scanning direction; a first changing unit configured to change, in units of the recording elements, based on the obtained information, storage positions of recording data items in the main scanning direction that are stored in the storage unit and that are assigned to recording elements in each of groups, each of the groups including recording elements belonging to the blocks in the recording element array which are consecutive; and a second changing unit configured to change, in units of the groups, based on the obtained information, the storage positions of the recording data items in the main scanning direction.

According to another aspect of the present invention, a recording apparatus scans a recording head in a main scanning direction to perform time-division driving for a plurality of blocks of recording elements, the recording head including a recording element array having a plurality of recording elements, each of blocks including recording elements that are located at discrete positions in the recording element array. The recording apparatus includes a storage unit configured to store recording data items; an obtaining unit configured to obtain information regarding inclination of the recording element array with respect to the main scanning direction; a first reading unit configured to read, in units of the recording elements, based on the obtained information, recording data items stored at different positions in the main scanning direction in the storage unit so that recording elements belonging to an identical block are substantially simultaneously driven; and a second reading unit configured to read, in units of groups, based on the obtained information, recording data items stored at different positions in the storage unit in the main scanning direction so that recording elements belonging to an identical block are substantially simultaneously driven, each of the groups including recording elements belonging to the blocks in the recording element array which are consecutive.

According to yet another aspect of the present invention, a recording apparatus scans a recording head in a main scanning direction to perform time-division driving for a plurality of blocks of recording elements, the recording head including a recording element array having a plurality of recording elements, each of blocks including recording elements located at discrete positions in the recording element array. The recording apparatus includes a storage unit configured to store recording data items; an obtaining unit configured to obtain information regarding inclination of the recording element array with respect to the main scanning direction; a changing unit configured to change, in units of groups, based on the obtained information, storage positions of the recording data items that are stored in the storage unit in the main scanning direction and that are assigned to recording elements in each of groups, each of the groups including recording elements belonging to the blocks in the recording element array which are consecutive; and a reading unit configured to read, in units of the recording elements, based on the obtained information, the recording data items for which the storage positions have been changed by the changing unit so that recording elements belonging to an identical block are substantially simultaneously driven.

A recording apparatus according to an embodiment of the present invention is configured such that the read position or storage position of recording data can be separately changed for recording elements, and can reduce deterioration in image quality caused by inclination deviation.

Further features of the present invention will become apparent from the following description of exemplary embodiments with reference to the attached drawings.

BRIEF DESCRIPTION OF THE DRAWINGS

FIG. 10 is a diagram showing an example of block-driving-order data written in a block-driving-order data memory.

FIGS. 17A and 17B are diagrams showing a test patch having a uniform recording density and including no black fringe or white fringe.

FIG. 18 is a diagram showing correction information defined in the form of a table in a correction value storage unit.

FIG. 23 is a diagram showing a method of correcting inclination deviation using a rough metering value and a fine metering value.

FIG. 27 is a diagram showing a method of correcting a recording element array for inclination deviation using a rough metering value and a fine metering value.

FIG. 29 is a diagram showing correction information including a rough metering value and fine metering value that are set in the correction value storage unit.

FIG. 38 is a diagram showing a structure of a third recording memory.

DESCRIPTION OF THE EMBODIMENTS

In the specification, the term "recording" refers not only to formation of significant information such as text and graphics but widely refers to formation of an image, a figure, a pattern, or any other object on a recording medium regardless of whether it is significant or insignificant, and modification of the medium. Such formation and modification may or may not be perceived by the human eye.

The term "recording medium" refers not only to a sheet of paper which is generally used in a recording apparatus but widely refers to an ink-acceptable medium such as a piece of cloth, a plastic film, a metal plate, a glass plate, a ceramic plate, a piece of wood, or a sheet of leather.

The term "ink" is to be broadly construed, like the term "recording" described above, and refers to a liquid which can be applied onto a recording medium to form an image, a figure, a pattern, or any other object, to modify the recording medium, or to perform ink processing. Examples of the ink processing include solidification or insolubilization of coloring materials in ink applied onto the recording medium.

The term "recording element" (also referred to as "nozzle") collectively refers to elements configured to generate energy which is used for an ink ejection port or a liquid path communicating therewith and for ink ejection unless specifically stated otherwise.

First Embodiment

Figure 3:
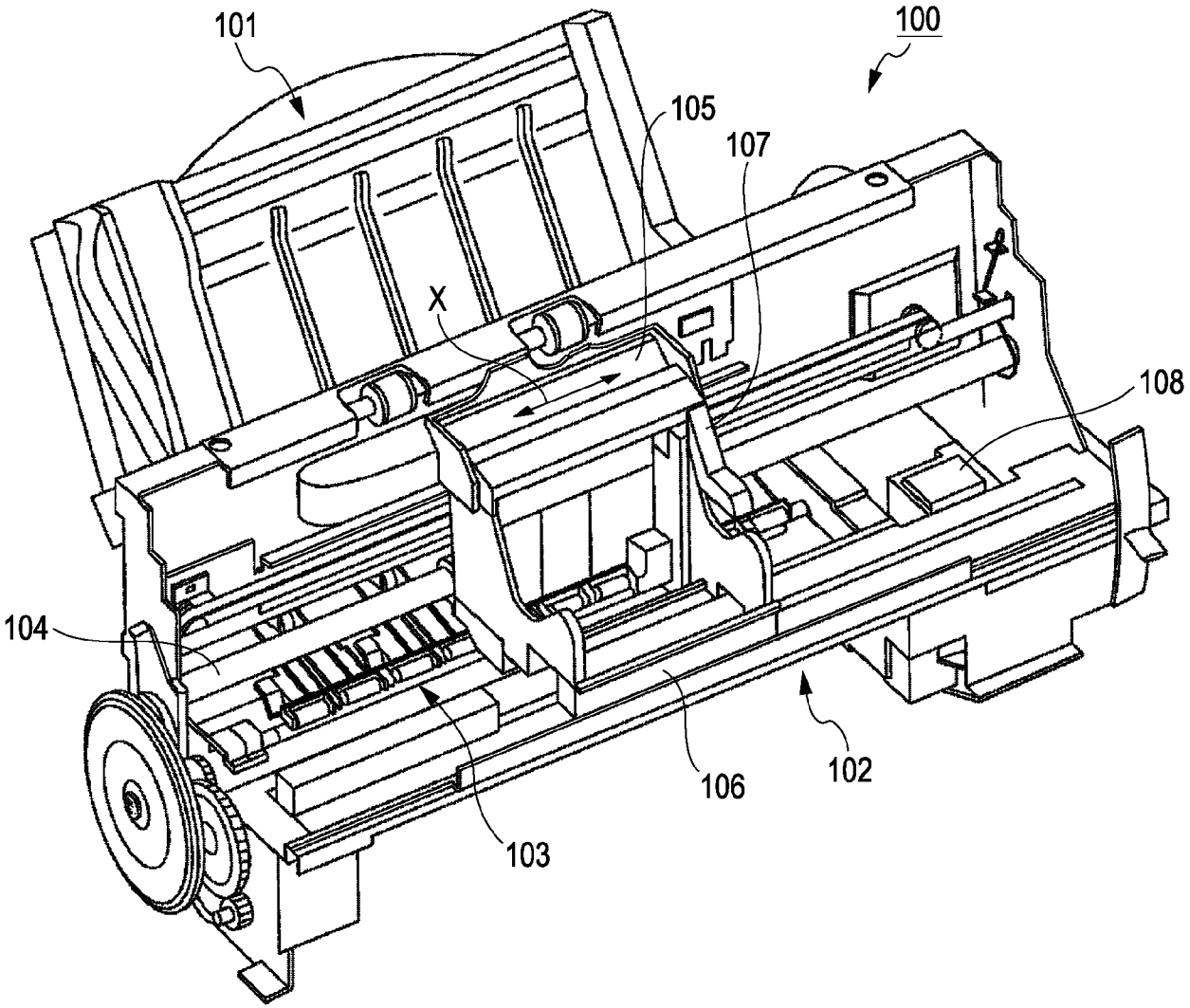
FIG. 3 is an external perspective view of an ink jet recording apparatus according to the present invention.

An ink jet recording apparatus according to a first embodiment will be described with reference to FIG. 3. An ink jet recording apparatus 100 includes an automatic feeder 101 arranged to automatically feed recording media such as sheets of paper to the inside of a main body of the ink jet recording apparatus 100 one by one, and a conveyor 103 arranged to convey the recording media fed one by one from the automatic feeder 101 to predetermined recording positions and arranged to convey the recording media from the recording positions to a discharge unit 102. The ink jet recording apparatus 100 further includes a recording unit arranged to record a desired object on a recording medium conveyed to a recording position, and a recovering unit 108 arranged to perform recovery processing on the recording unit.

The recording unit includes a carriage 105 supported by a carriage shaft 104 so as to be movable in a main scanning direction indicated by an arrow X, and a recording head 11 (not shown in FIG. 3) removably mounted on the carriage 105.

The carriage 105 is provided with a carriage cover 106 that is engaged with the carriage 105 to guide the recording head 11 to a predetermined attachment position on the carriage 105. The carriage 105 is also provided with a headset lever 107 that is engaged with a tank holder 113 of the recording head 11 to press the recording head 11 so that the recording head 11 can be set at the predetermined attachment position.

A headset plate (not shown) is provided at an upper portion of the carriage 105 so as to be rotatable with respect to a shaft of a headset lever 107, and is provided so as to be spring-biased to an engaging portion with the recording head 11. The spring force of the headset plate urges the headset lever 107 to attach the recording head 11 to the carriage 105 while pressing the recording head 11.

A structure of the recording head 11 will be described.

Figure 4:
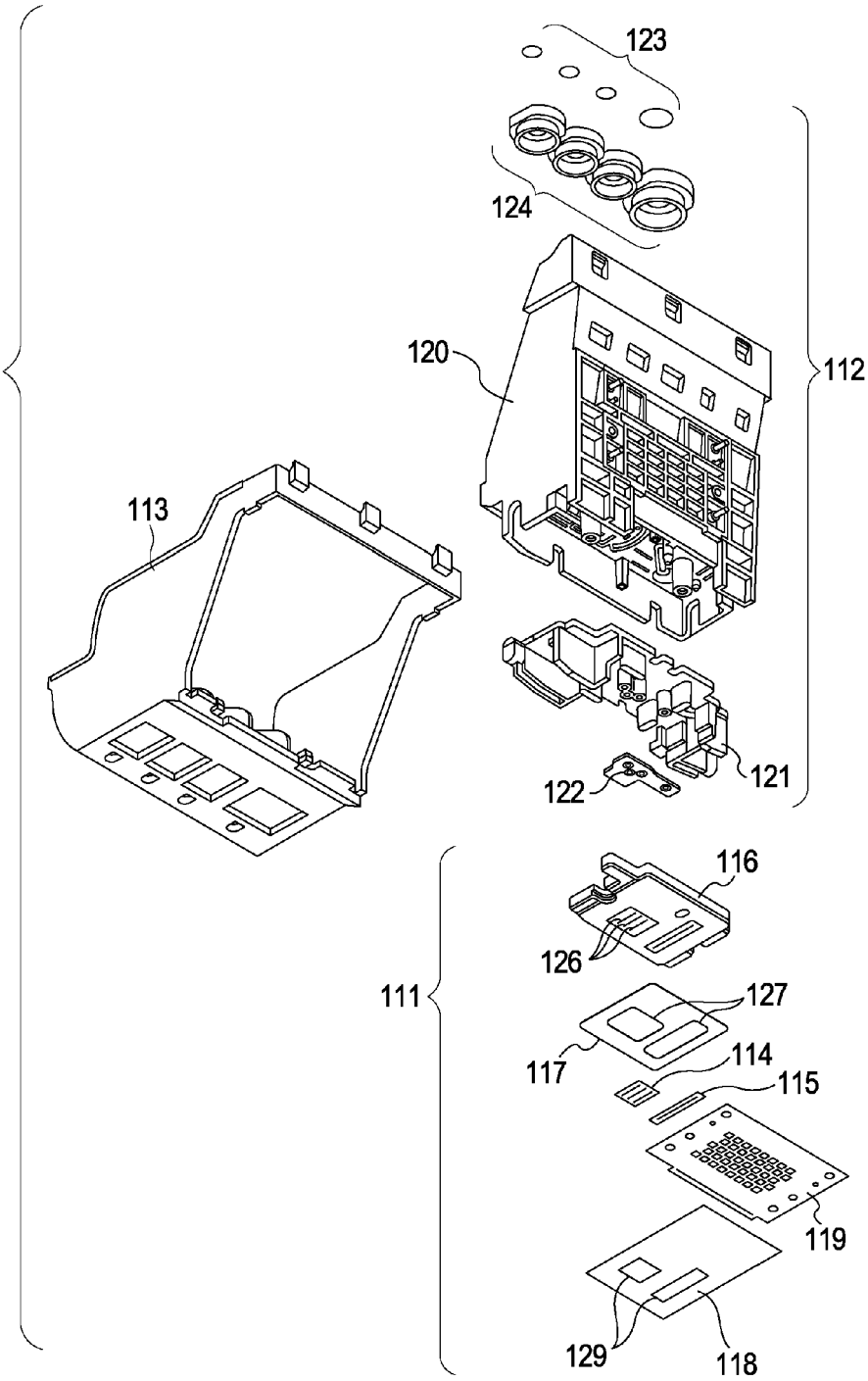
FIG. 4 is a diagram showing a recording head according to the present invention.
Figure 5:
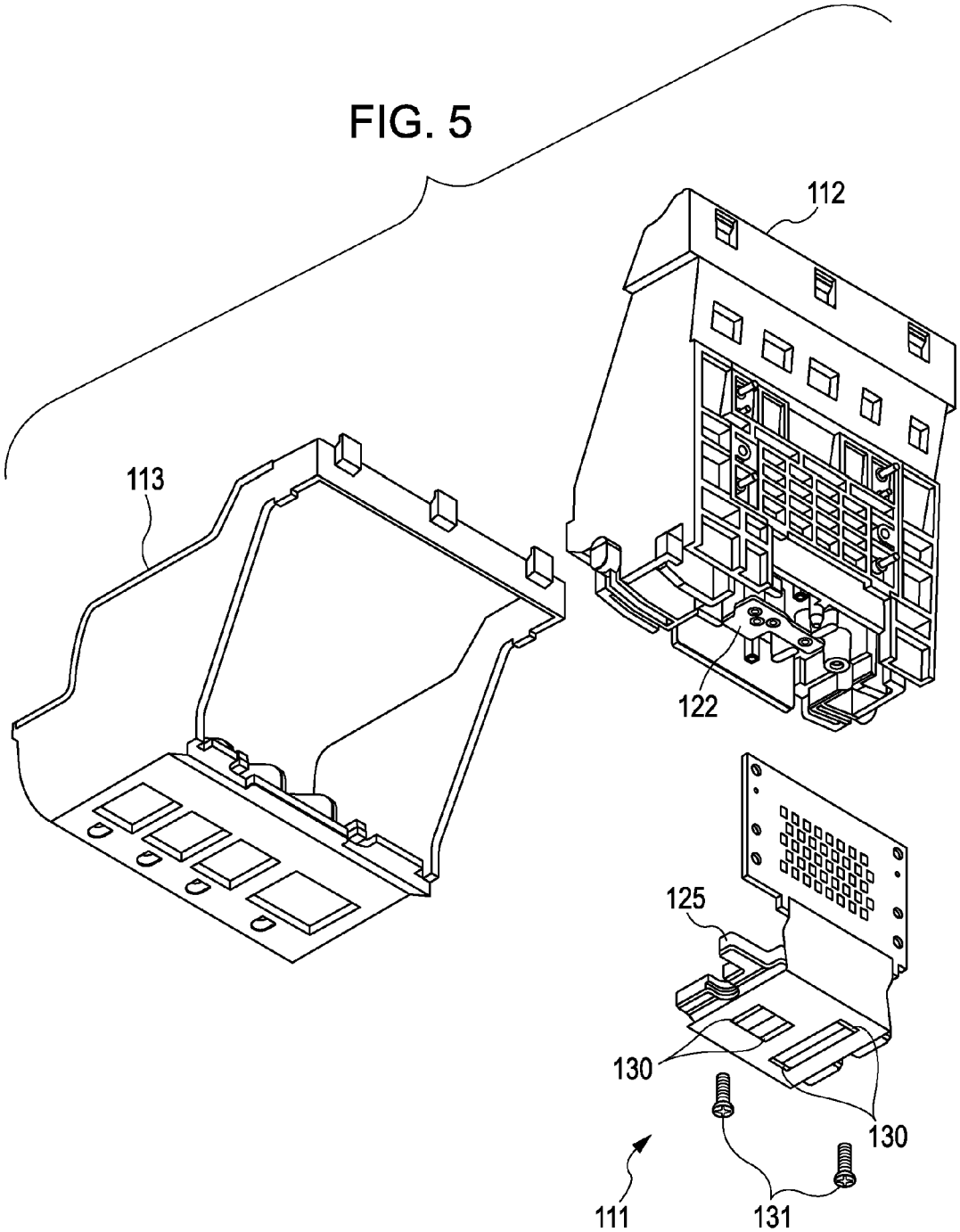
FIG. 5 is a diagram showing the recording head according to the present invention.

FIGS. 4 and 5 show the recording head 11 according to the first embodiment. The recording head 11 is a side-shooter bubble jet (registered trademark) recording head arranged to eject liquid drops in a direction substantially perpendicular to a heater substrate. The recording head 11 includes a recording element unit 111, an ink supply unit 112, and the tank holder 113. The recording element unit 111 includes a first recording element 114, a second recording element 115, a first plate 116, an electrical wiring tape 118, an electric contact substrate 119, and a second plate 117. The ink supply unit 112 includes an ink supply member 120, a flow-path forming member 121, a joint rubber 122, a filter 123, and a seal rubber 124.

The recording element unit 111 will now be described. The recording element unit 111 is implemented by joining the first plate 116 and the second plate 117 to form a plate joining member 125 and then mounting the first recording element 114 and the second recording element 115 on the plate joining member 125. After the electrical wiring tape 118 is laminated, the first recording element 114 and the second recording element 115 are electrically connected, and the electrically connected portions etc., are sealed, thereby implementing the recording element unit 111.

Due to the demand of high plane precision because of the influence on the direction of ejection of liquid drops, the first plate 116 is composed of an alumina ($Al_2O_3$) material having a thickness of 0.5 mm to 10 mm. The first plate 116 has ink supply ports 126 formed therein to supply ink to the first recording element 114 and the second recording element 115.

The second plate 117 is a single plate-shaped member having a thickness of 0.5 mm to 1 mm, and has window-shaped openings 127 formed therein. The openings 127 are greater in outer diameter than the first and second recording elements 114 and 115 that are fixedly adhered to the first plate 116. The second plate 117 is fixedly stacked on the first plate 116 through an adhesive, and therefore the plate joining member 125 is formed.

The first recording element 114 and the second recording element 115 are fixedly adhered to the surfaces of portions of the first plate 116 that are defined in the openings 127. Depending on the accuracy of mounting of the first and second recording elements 114 and 115, the movement of the adhesive, or the like, the accurate implementation of the recording element unit 111 is difficult. This will cause an error of assembling of the recording head 111, which is overcome by the present invention.

The first recording element 114 and the second recording element 115, each of which has an ink ejection port array 14 including a plurality of ink ejection ports, have an existing side-shooter bubble jet substrate structure. Each of the first recording element 114 and the second recording element 115 includes a Si substrate having a thickness of 0.5 mm to 1 mm, an ink supply port formed of a long grooved through-hole serving as an ink flow path, and heater arrays serving as energy generators, the ink supply port and the heater arrays are formed on the Si substrate so that one heater array is provided at each of both sides with the ink supply port therebetween and the heater arrays are arranged in a staggered manner. Each of the first recording element 114 and the second recording element 115 further includes an electrode portion so as to extend along a side of the first recording element 114 and the second recording element 115 that is perpendicular to the heater arrays. The electrode portions are connected to heaters of the heater arrays, and have connection pads on both outer edges of the substrate.

The electrical wiring tape 118 may be a tape automated bonding (TAB) tape. A TAB tape is a laminate of a tape base member (base film), a copper foil wiring layer, and a cover layer.

On two connection sides of device holes corresponding to the electrode portions of the first recording element 114 and the second recording element 115, inner leads 129 serving as connection terminals extend. The electrical wiring tape 118 is fixedly adhered to a surface of the second plate 117 through a thermosetting epoxy resin adhesive layer so that the cover layer of the electrical wiring tape 118 is in contact with the surface of the second plate 117. The base film of the electrical wiring tape 118 becomes a smooth capping surface against which a capping member of the recording element unit 111 abuts.

The electrical wiring tape 118 and the two recording elements 114 and 115 are electrically connected through an ultrasonic thermocompression method or an anisotropic conductive tape. Inner lead bonding (ILB) using ultrasonic thermocompression bonding is preferable for a TAB tape. In the recording element unit 111, the leads 129 of the electrical wiring tape 118 and stud bumps on the first recording element 114 and second recording element 115 are bonded by ILB.

After an electrical connection is established between the electrical wiring tape 118 and the two recording elements 114 and 115, the electrically connected portions are sealed by a first sealant 130 and a second sealant 131 to protect the electrically connected portions against corrosion caused by ink or external shock. The first sealant 130 mainly serves to seal outer peripheral portions of the mounted recording elements 114 and 115, and the second sealant 131 serves to seal the front side of the electrically connected portions of the electrical wiring tape 118 and recording elements 114 and 115.

Figure 6A:
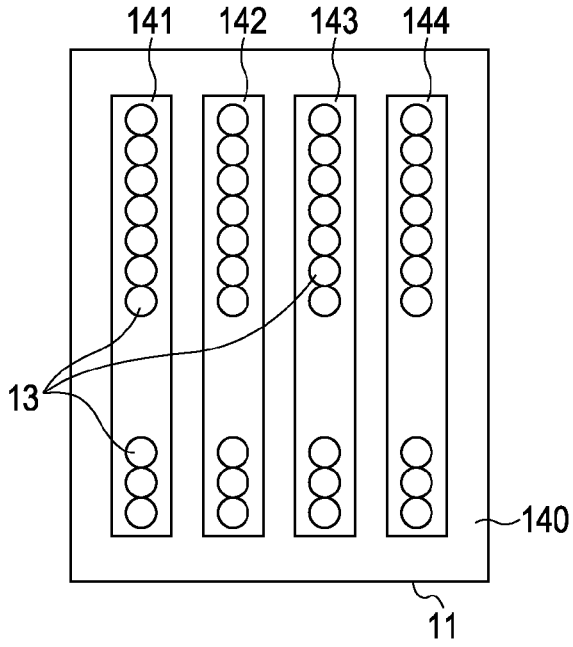
FIGS. 6A and 6B are diagrams showing an ink ejection port surface of the recording head according to the present invention.

FIG. 6A shows an array of ink ejection ports 13 in an ink ejection port surface 140 of the recording head 11. Ink ejection port arrays 141, 142, 143, and 144 each including a plurality of ink ejection ports 13, e.g., 128 ink ejection ports 13 in the first embodiment, eject ink drops of black, cyan, magenta, and yellow colors, respectively.

The recording head 11 may be configured such that, for example, each of the ink ejection port arrays 141, 142, 143, and 144 of the respective colors includes two columns of ink ejection ports 13 that are alternately arranged in the sub-scanning direction. Alternatively, the ink ejection port array 141 of black color may include a larger number of ink ejection ports 13 than the ink ejection port arrays 142, 143, and 144 of the other colors.

In the first embodiment, one of the ink ejection port arrays 141 to 144 (for example, the ink ejection port array 141 of black color) will be described. For the other ink ejection port arrays, inclination deviation may be corrected in a similar manner.

Figure 6B:
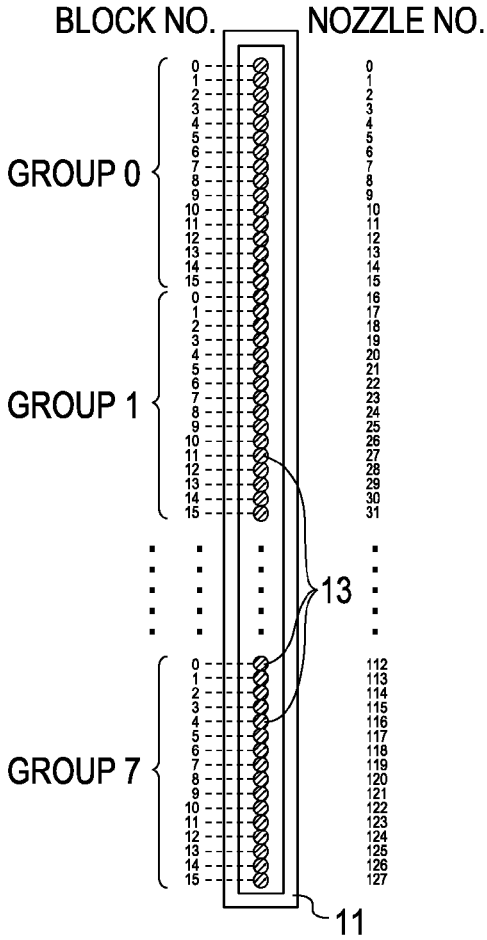

FIG. 6B shows the recording head 11 having the ink ejection port array 141 including the 128 ink ejection ports 13. An ink ejection port 13 on the upper side of the ink ejection port array 141 is an ink ejection port located downstream in the sub-scanning direction, and the ink ejection ports 13 are provisionally assigned nozzle numbers 0 to 127 in order from the downstream side to the upstream side. The ink ejection ports 13 are further divided into groups 0 to 7, each having 16 ink ejection ports, starting from the ink ejection port 13 assigned the smallest nozzle number, and recording elements corresponding to the ink ejection ports 13 in each of the groups are assigned block 0 to block 15 in order from the recording element corresponding to the ink ejection port 13 assigned the smallest nozzle number. The recording elements assigned the block numbers in this way are driven in a time-division manner to record an image.

Figure 7:
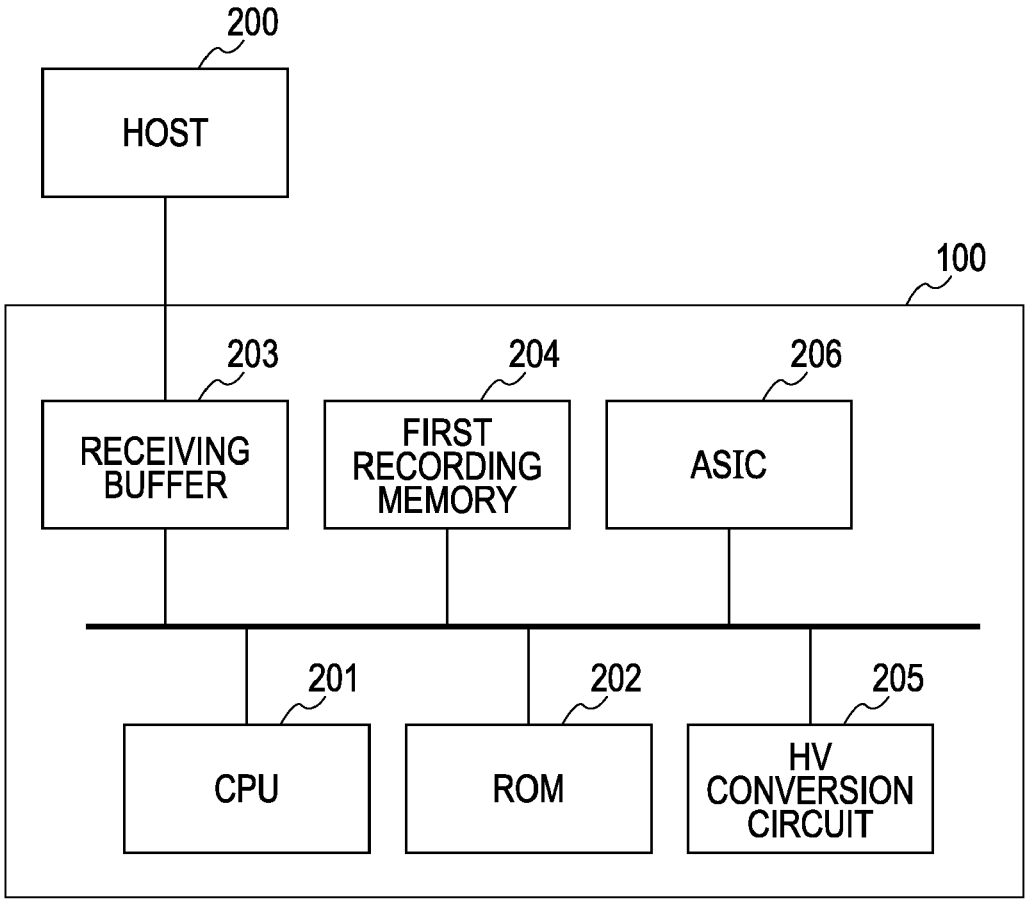
FIG. 7 is a block diagram showing a structure of a control circuit according to the present invention.

FIG. 7 is a block diagram showing a structure of a control circuit in the ink jet recording apparatus 100. The ink jet recording apparatus 100 includes a central processing unit (CPU) 201 and a read-only memory (ROM) 202 configured to store a control program that is executed by the CPU 201. Recording data received in units of raster from a host 200 is first stored in a receiving buffer 203. The recording data stored in the receiving buffer 203 is data that has been compressed to reduce the amount of transmission data from the host 200. The recording data is expanded and is then stored in a first recording memory 204. The recording data stored in the first recording memory 204 is subjected to horizontal-vertical (HV) conversion processing by an HV conversion circuit 205, and the resulting data is stored in a second recording memory 211 (see FIG. 8).

Figure 9:
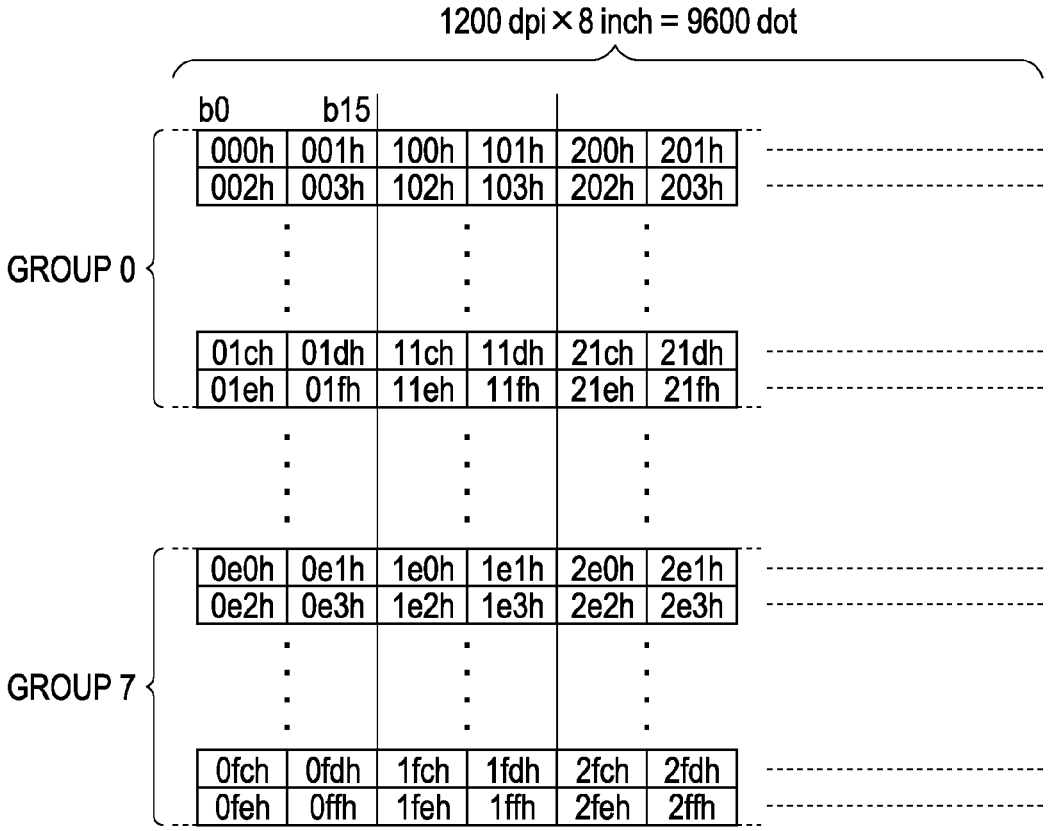
FIG. 9 is a schematic diagram showing an arrangement of recording data in a first recording memory.

FIG. 9 schematically shows an arrangement of recording data items in the first recording memory 204. The recording data items stored in the first recording memory 204 are associated with addresses 000 to 0FE corresponding to 128 recording elements in a longitudinal direction. The first recording memory 204 has a lateral size of a printing resolution by the size of a recording medium. For example, if the printing resolution is 1200 dots per inch (dpi) and the size of a recording medium is 8 inches, the first recording memory 204 has a memory area having a size sufficient to record data of 9600 dots in the lateral direction.

In FIG. 9, a recording data item for the recording element of nozzle number 0 is stored in an area b0 of address 000. A data item to be recorded in the subsequent column of nozzle number 0 is stored in an area b1 of address 000. Similarly, data items to be recorded in subsequent columns are sequentially stored in lateral areas of address 000. Recording data items of nozzle number 127 are stored at address 0FE in a similar manner.

Accordingly, data items for the same nozzle number are stored at the same address of the first recording memory 204. In actuality, however, data items in the area b0 of addresses 000 to 0FE are recorded as the first column, and data items in the subsequent area b1 of addresses 000 to 0FE are recorded as the second column. The HV conversion circuit 205 performs horizontal-vertical (HV) conversion on the recording data items stored in the raster direction of the first recording memory 204, and stores the resulting recording data items in the column direction of the second recording memory 211.

Figure 35:
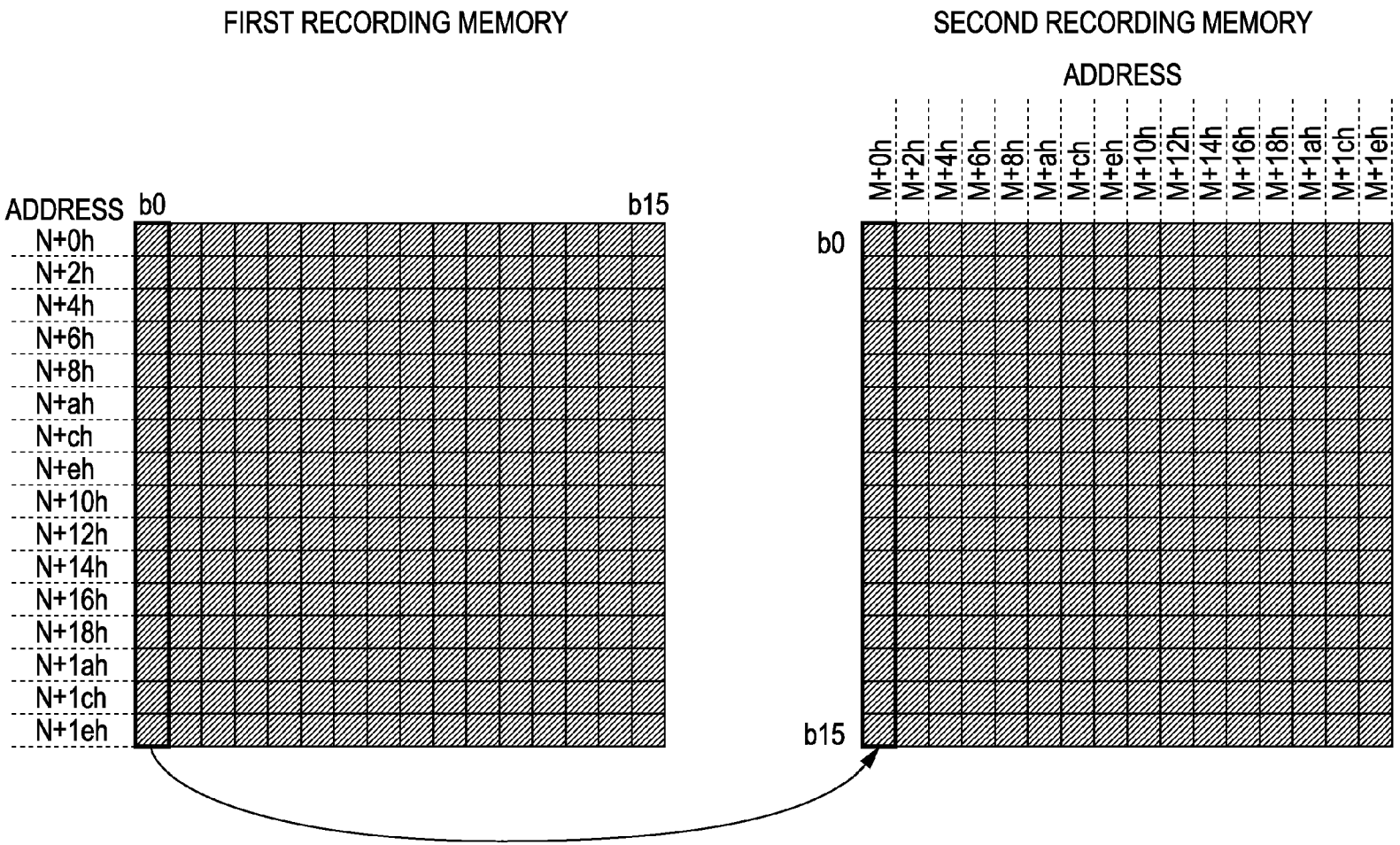
FIG. 35 is a diagram showing a horizontal-vertical (HV) conversion operation.

The HV conversion operation will now be described with reference to FIG. 35. In the first embodiment, an HV conversion is performed in units of 16 by 16 data items. First, data items stored in an area b0 of addresses N+0 to N+1E of the first recording memory 204 are read and are written to address M+0 of the second recording memory 211. Then, data items stored in an area b1 of addresses N+0 to N+1E are read and are written to address M+2 of the second recording memory 211. Similarly, this operation is repeated 16 times for addresses M+0 to M+1e to thereby perform an HV conversion in units of 16 by 16 data items. In the first embodiment, therefore, an HV conversion is performed in units of groups to be driven in a time-division manner, and is performed in order from groups 0 to 7.

Figure 36:
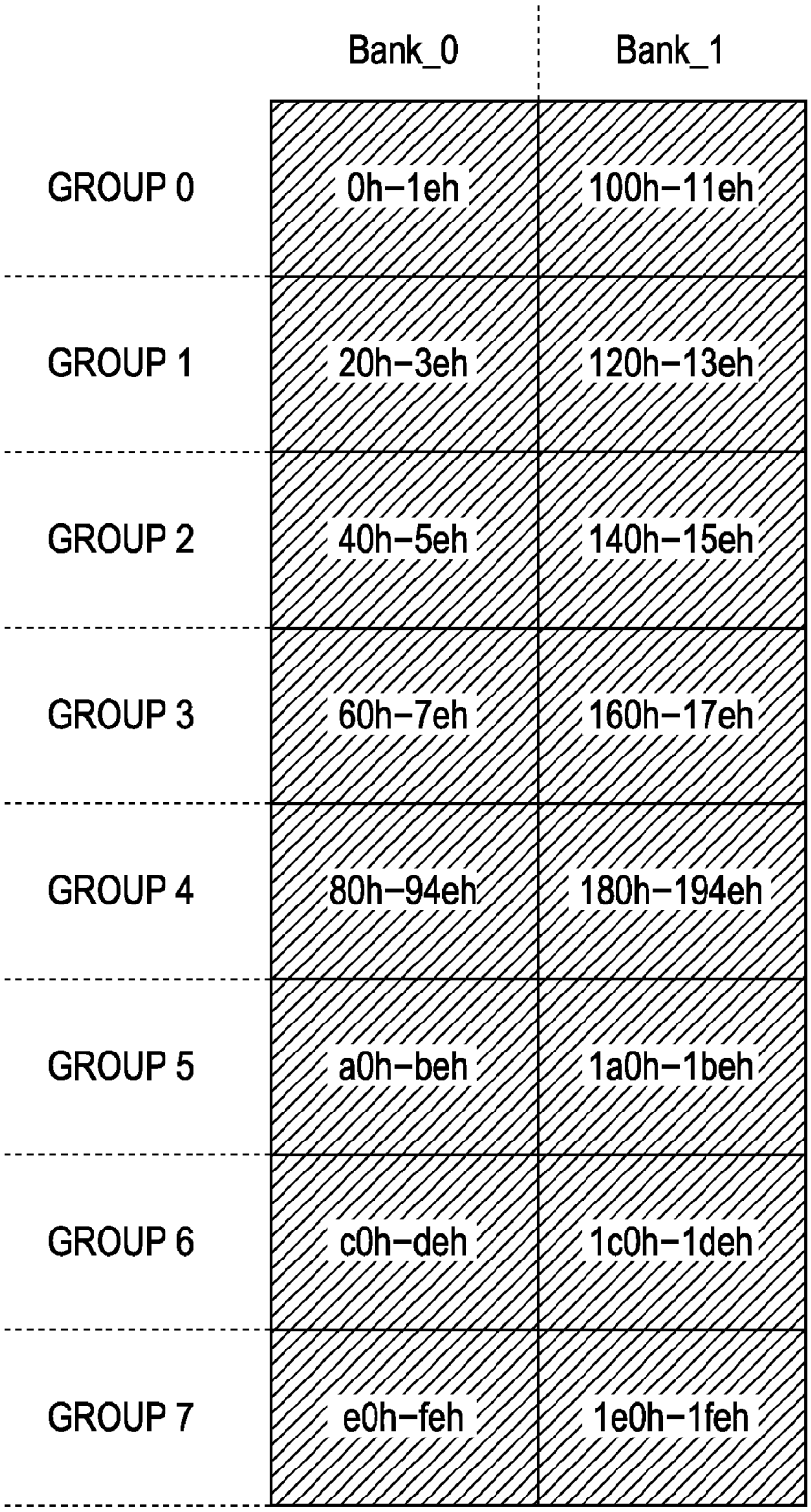
FIG. 36 is a schematic diagram showing a structure of a second recording memory.
Figure 37:
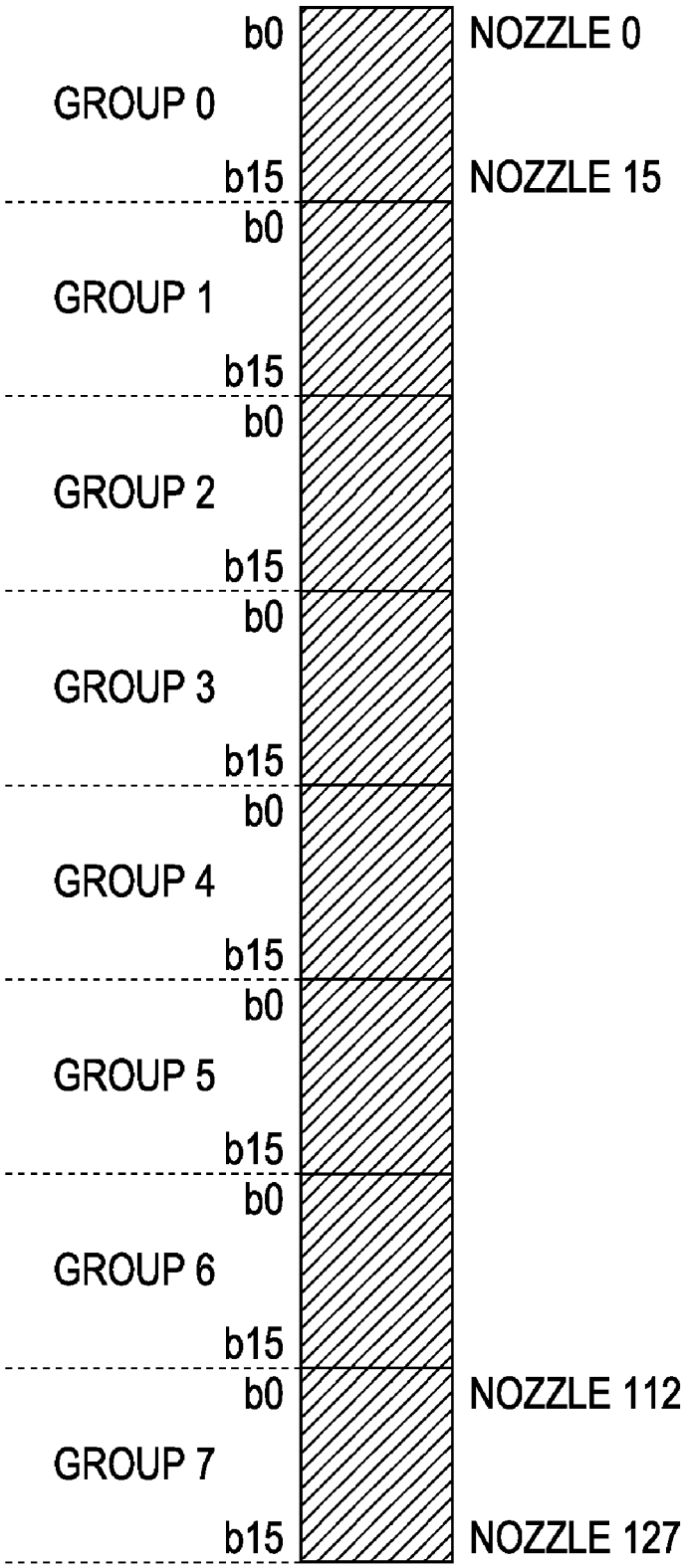
FIG. 37 is a schematic diagram showing an arrangement of recording data stored in the second recording memory.

FIG. 36 schematically shows a structure of the second recording memory 211. Since an HV conversion is performed during the recording operation, the second recording memory 211 has a two-bank structure in which each bank has 16 columns so that writing to the second recording memory 211 and reading from the second recording memory 211 can be exclusively performed. That is, if Bank 0 is used for writing, a read is performed from Bank 1, and if Bank 1 is used for writing, a read is performed from Bank 0. FIG. 37 shows recording data items stored in the second recording memory 211. Recording data items are stored in the second recording memory 211 so as to be associated with 128 recording elements.

Figure 8:
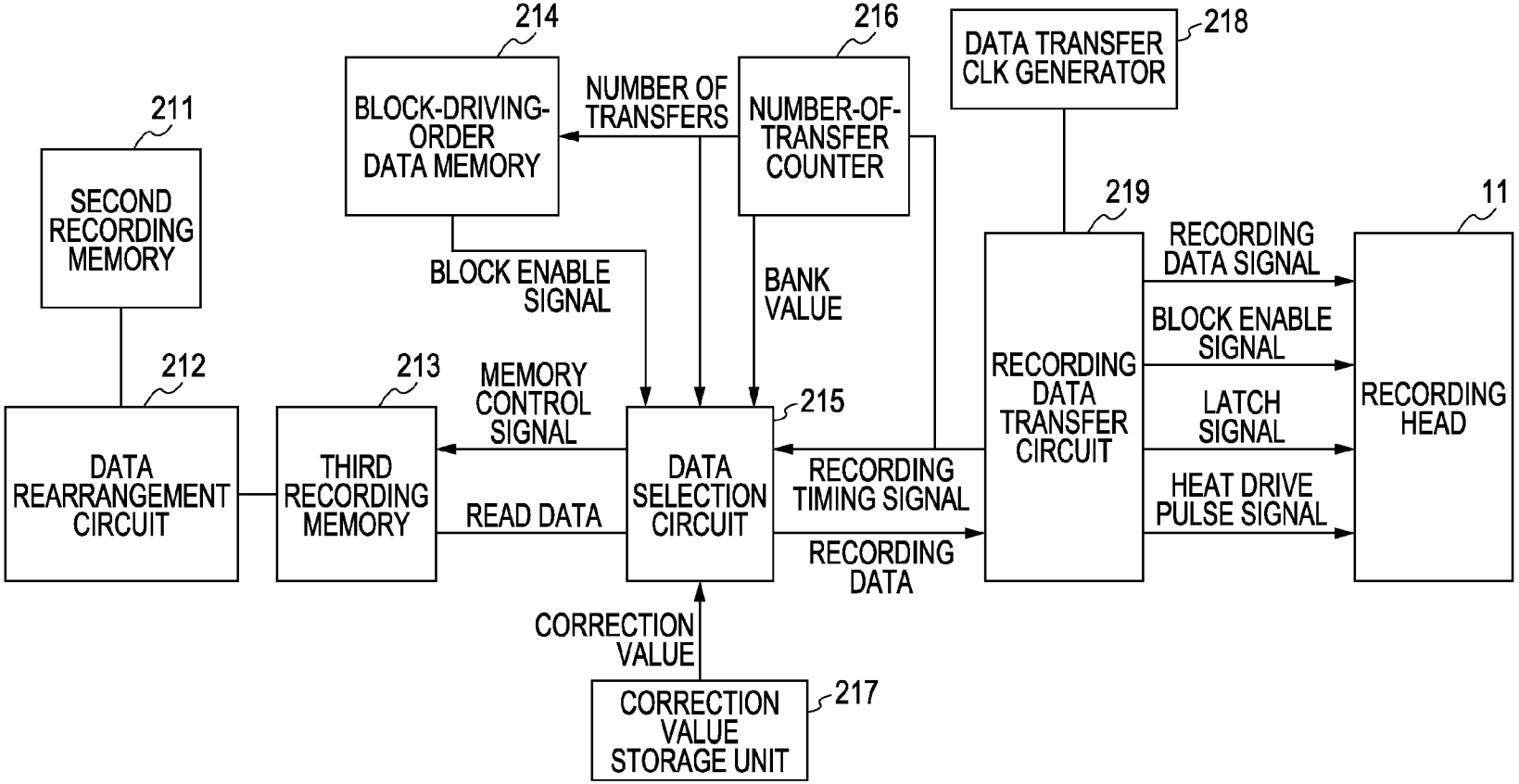
FIG. 8 is an internal block diagram of an application specific integrated circuit (ASIC).

FIG. 8 is an internal block diagram of an application specific integrated circuit (ASIC) 206. A structure for sequentially driving recording elements in a time-division manner will be described with reference to FIG. 8. A data rearrangement circuit 212 is a circuit configured to rearrange recording data items. The data rearrangement circuit 212 serves to integrate recording data items stored in the second recording memory 211 in association with 128 recording elements into 7-bit recording data items of every block to be recorded at the same time, and to write the recording data items to a third recording memory 213.

FIG. 38 is a diagram showing a structure of the third recording memory 213. In FIG. 38, recording data items for blocks 0 to 15 are stored in order at addresses 0 to F. The data items in the area b0 of groups 0 to 7 are stored in block 0, and the data items in the area b1 of groups 0 to 7 are stored in block 1. The third recording memory 213 has a three-bank structure in which each bank has data items of 16 blocks so that the writing and reading operations can be exclusively performed.

If Bank 0 is used for writing, a read from Banks 1 and 2 is performed. If Bank 1 is used for writing, a read from Banks 2 and 0 is performed, and if Bank 2 is used for writing, a read from Banks 0 and 1 is performed. In the first embodiment, a reason for using two banks for reading will be described later.

Referring back to FIG. 8, a number-of-transfer counter 216 is a counter circuit configured to count the number of times a recording timing signal is transferred, and is incremented for every recording timing signal. The number-of-transfer counter 216 counts from 0 to 15 and is reset to 0. The number-of-transfer counter 216 also counts a bank value of the third recording memory 213, and increments the bank value by one (+1) when the number-of-transfer counter 216 is counted 16 times.

In a block-driving-order data memory 214, the priority orders of driving 16 segmented recording elements of block numbers 0 to 15 are recorded at addresses 0 to 15. For example, in the case of sequentially driving recording elements from block number 0, block numbers 0, 1, 2, and 15 are stored at addresses 0 to 15 in that order.

A recording data transfer circuit 219 is configured to increment the number-of-transfer counter 216 in response to as a trigger a recording timing signal that is generated on the basis of, for example, an optical linear encoder. A data selection circuit 215 is configured to read a recording data item corresponding to the value of the block-driving-order data memory 214 and the bank value counted by the number-of-transfer counter 216 from the third recording memory 213 in response to a recording timing signal. The read recording data item is corrected in accordance with a correction value stored in a correction value storage unit 217, and the corrected recording data item is transferred to the recording head 11 in synchronization with a data transfer clock (CLK) signal (HD_CLK) generated by a data transfer CLK generator 218.

FIG. 10 shows an example of block-driving-order data written at addresses 0 to 15 of the block-driving-order data memory 214. In FIG. 10, block data items indicating blocks 0 and 1 are stored at addresses 0 and 1 of the block-driving-order data memory 214, respectively. Block data items indicating blocks 2 to 15 are sequentially stored at addresses 2 to 15, respectively.

The data selection circuit 215 reads block data item 0001 (numerical value indicating block 1) as a block enable signal from address 0 of the block-driving-order data memory 214 in response to a recording timing signal as a trigger. A recording data item corresponding to the block data item 0001 is read from the third recording memory 213 and is then transferred to the recording head 11.

Similarly, in response to the subsequent recording timing signal, block data item 1011 (numerical value indicating block 11) is read as a block enable signal from address 1 of the block-driving-order data memory 214. A recording data item corresponding to the block data item 0011 is read from the third recording memory 213 and is then transferred to the recording head 11.

Similarly, in response to subsequent recording timing signals as triggers, block data items are read in order from addresses 2 to 15 of the block-driving-order data memory 214. Recording data items corresponding to the respective block data items are read from the third recording memory 213 and are then transferred to the recording head 11.

In this way, the data selection circuit 215 reads block data items set at addresses 0 to 15 of the block-driving-order data memory 214. Recording data items corresponding to the respective block data items are read from the third recording memory 213 and are then transferred to the recording head 11 to thereby record data for one column.

Figure 11:
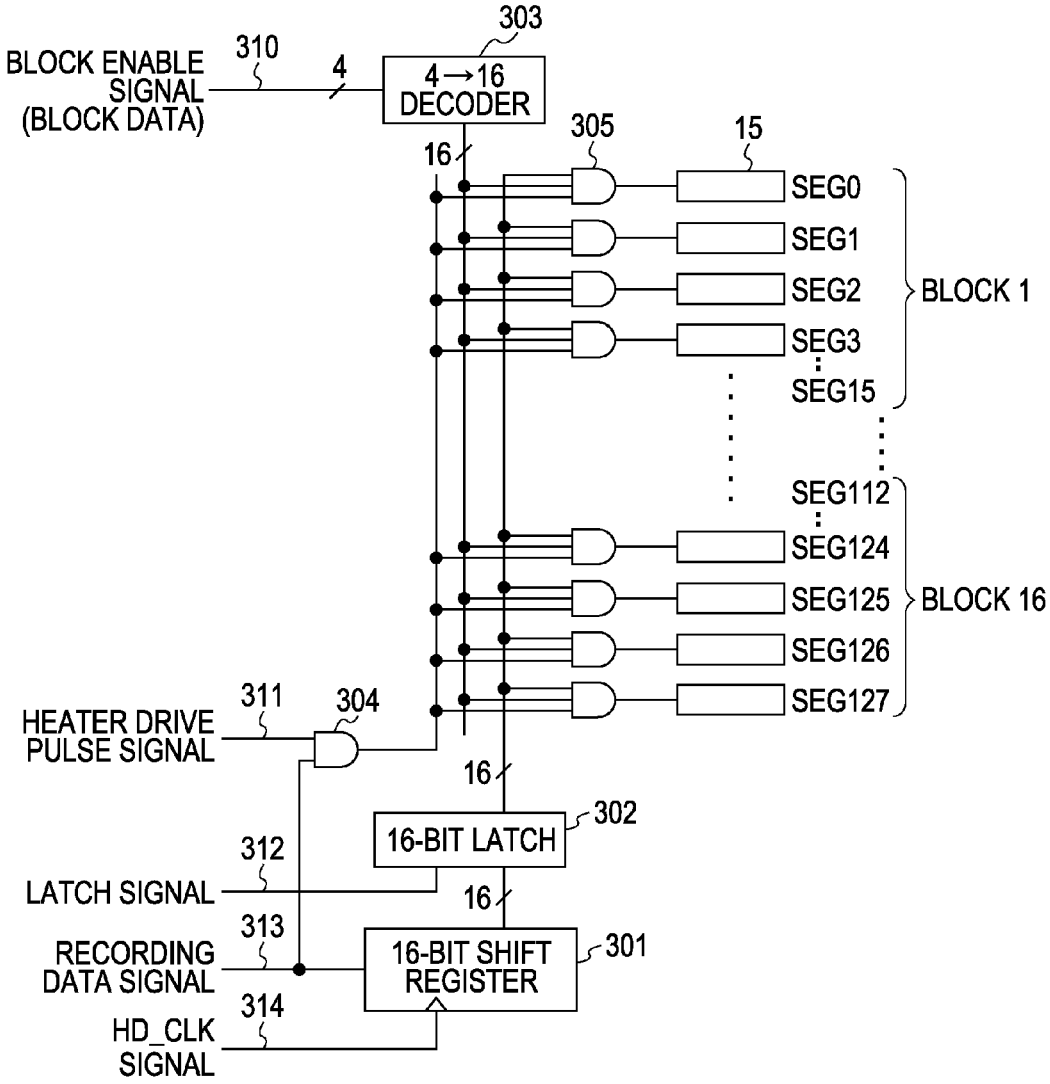
FIG. 11 is a diagram showing a driving circuit configured to drive the recording head.

FIG. 11 is a diagram of a driving circuit configured to drive the recording head 11. The recording head 11 is driven so that the 128 recording elements 15 are divided into 16 blocks, and 16 recording elements assigned to each block are driven. A recording data signal 313 is transmitted to the recording head 11 via serial transfer by an HD_CLK signal 314. The recording data signal 313 is received by a 16-bit shift register 301 and is then latched by a 16-bit latch 302 in response to a rising edge of a latch signal 312. A block is specified by a four-valued block enable signal 310, and a recording element 15 of a specified block that is extended in a decoder 303 is selected.

A recording element 15 that is specified by the block enable signal 310 and the recording data signal 313 is driven by a heater drive pulse signal 311 passing through an AND gate 305 associated with the recording element 15, and ejects an ink drop to record an image.

Figure 12:
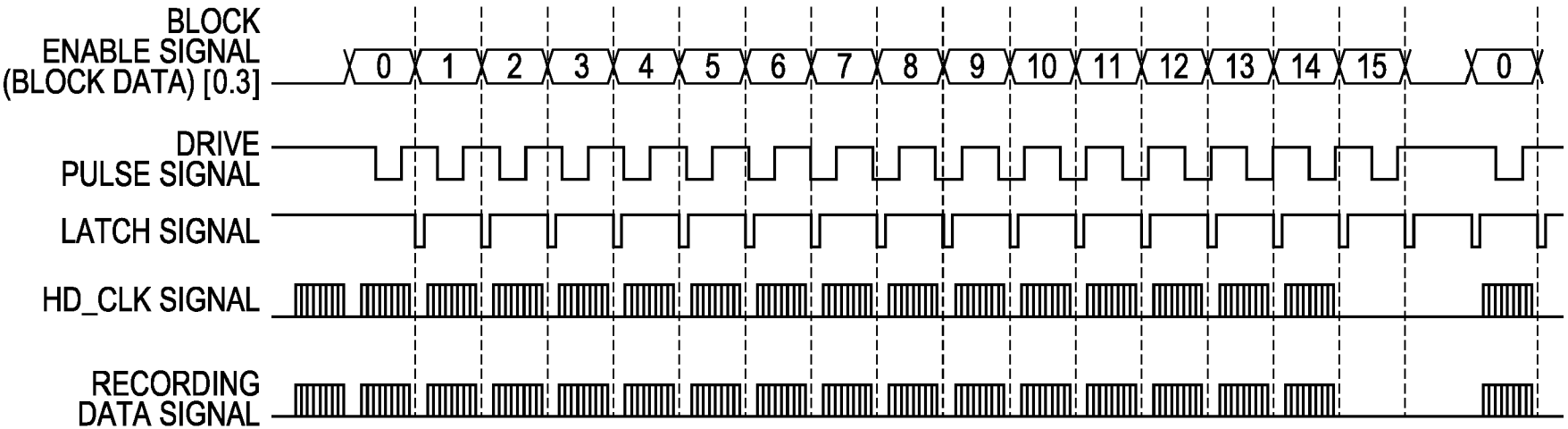
FIG. 12 is a diagram showing a driving timing of a block enable signal.

FIG. 12 shows a driving timing of the block enable signal 310. A segmented-block selection circuit is capable of generating the block enable signal 310 on the basis of the block-driving-order data stored in the block-driving-order data memory 214. As indicated by the block enable signal 310 shown in FIG. 12, the segmented-block selection circuit is set so as to specify the 16 blocks in order starting from block 0 up to block 15 according to block-driving-order data generated by the block-driving-order data memory 214. In one-way recording and forward scanning recording in two-way recording, therefore, in response to the block enable signal 310 indicating a driving timing, the recording head 11 is driven in the order of block 0, block 1, block 2, . . . , and block 15. The block enable signal 310 is generated so that the blocks can be specified at equal intervals within one period.

An overview of correction of inclination deviation in the ink jet recording apparatus of the first embodiment will now be described. A feature of the first embodiment is to correct inclination deviation of dots. Although information regarding inclination deviation may be detected using any suitable method, in FIG. 13 and subsequent figures, an optical sensor is used to obtain information regarding inclination deviation, by way of example.

Figure 13:
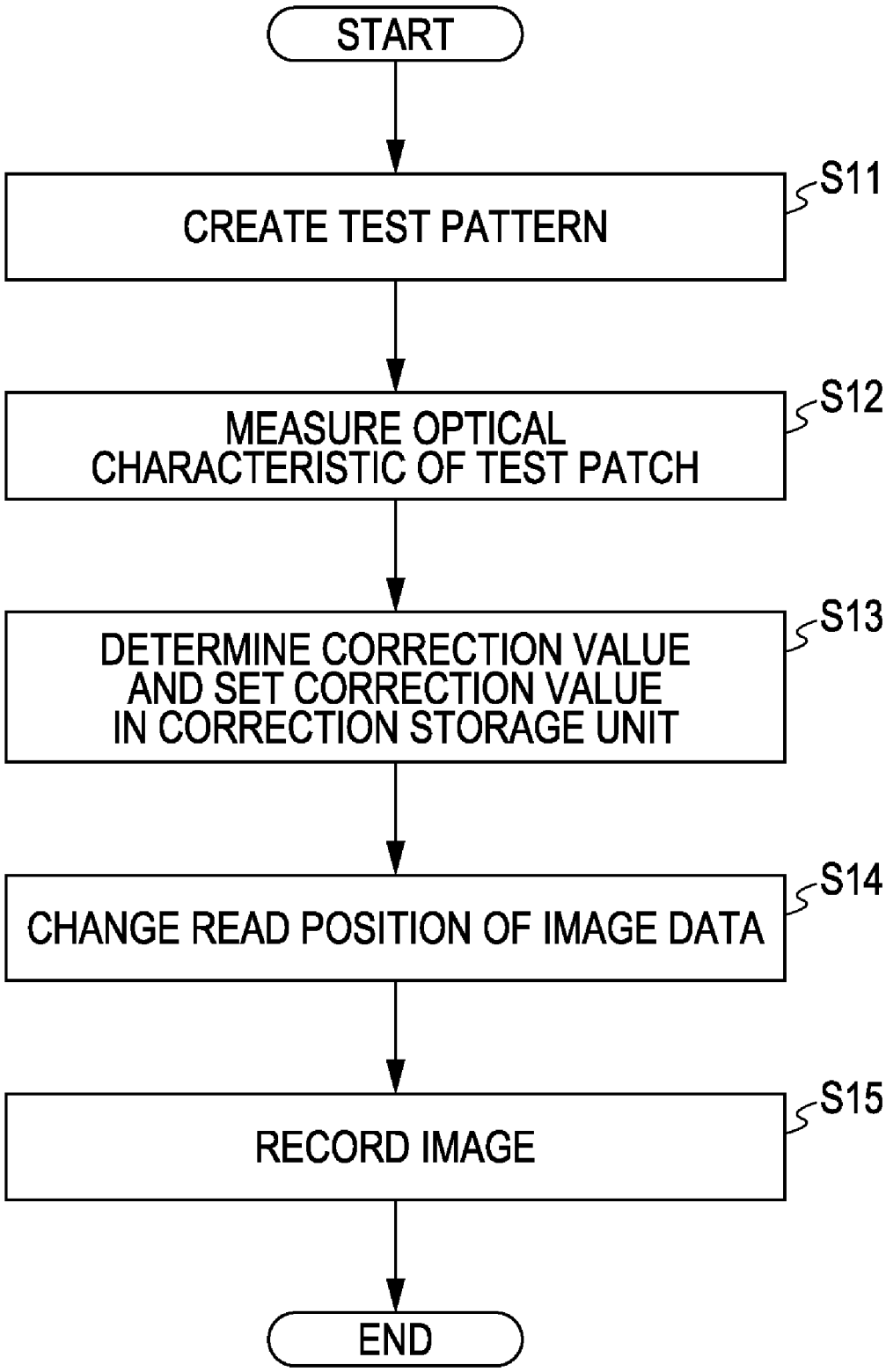
FIG. 13 is a flowchart showing an overview of a process for correcting inclination deviation in the first embodiment.

FIG. 13 is a flowchart showing an overview of a process for correcting inclination deviation of dots. First, in step S11, a test pattern for detecting information regarding inclination deviation is recorded. Then, in step S12, an optical characteristic of each of test patches of the recorded test pattern is measured using an optical sensor, and information regarding inclination deviation is obtained. In the first embodiment, the reflecting optical density of each of the test patches is measured as an optical characteristic thereof. Then, in step S13, correction information is determined from the obtained information regarding inclination deviation, and is set in the correction value storage unit 217. In step S14, the read position of recording data is changed in accordance with the correction information set in the correction value storage unit 217. In step S15, an image is recorded on a recording medium.

The recording of a test pattern in step S11 and the obtaining of information regarding inclination deviation based on a measured optical characteristic in step S12 will now be described. The obtained information regarding inclination deviation may be an amount of deviation in the main scanning direction between a dot formed from an upstream ink ejection port 13 of the ink ejection port array 141 and a dot formed from a downstream ink ejection port 13 of the ink ejection port array 141.

Figure 14:
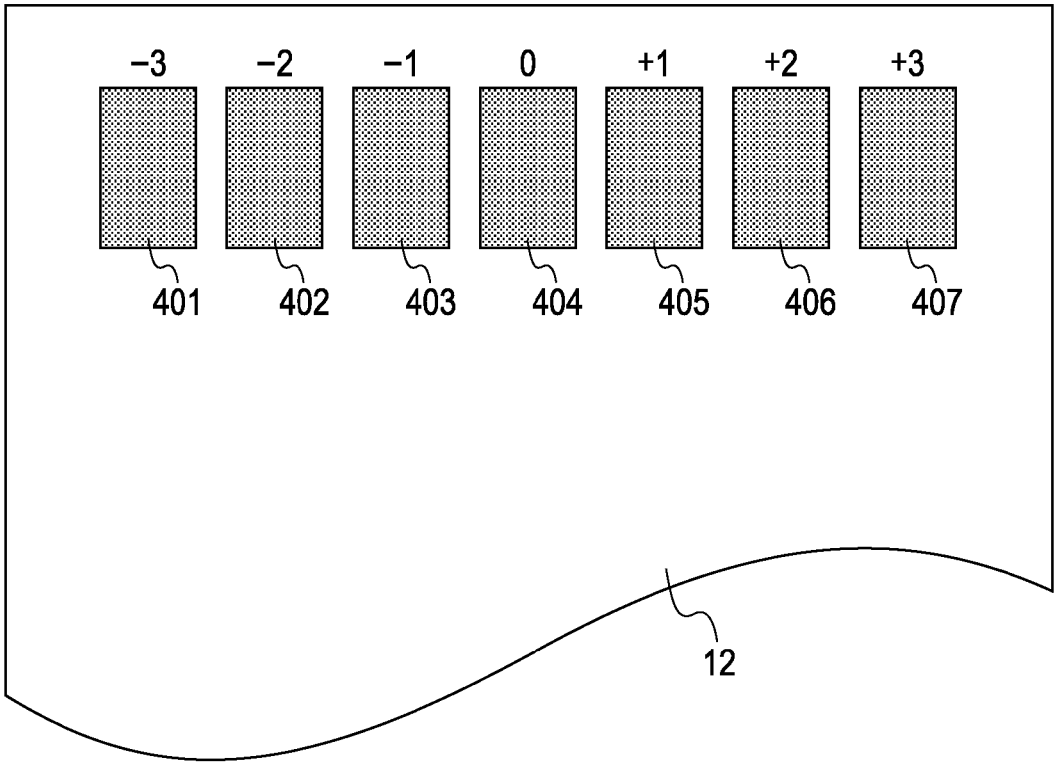
FIG. 14 is a diagram showing an example of a test pattern in the first embodiment.

FIG. 14 shows an example of the test pattern formed on the recording medium 12 in step S11. In the first embodiment, the test pattern includes seven test patches 401 to 407. Numbers recorded near the test patches 401 to 407, such as "0" and "+1", help identify the test patches 401 to 407. Those numbers may not be necessarily recorded.

Figure 34A:
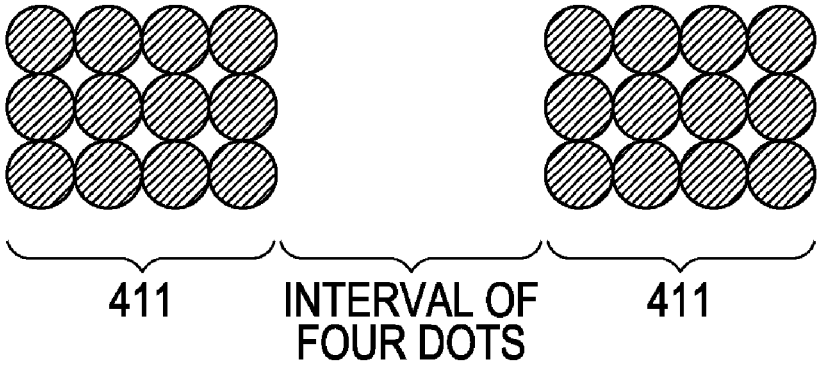
FIGS. 34A and 34B are diagrams showing a procedure of creating a test patch.
Figure 34B:
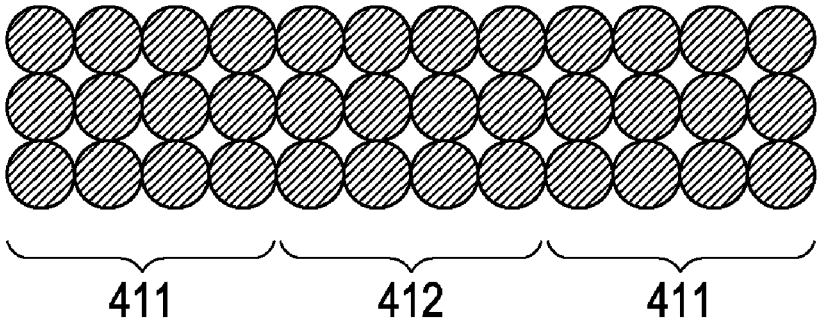

A procedure of recording each test patch will now be described with reference to FIGS. 34A and 34B. For ease of illustration, three upstream ink ejection port arrays and three downstream ejection port arrays are shown in FIGS. 34A and 34B. First, in the first scanning of a recording head, dot images 411, each having three dots in the sub-scanning direction by four dots in the main scanning direction, are recorded using the three upstream ink ejection port arrays at intervals of four dots in the scanning direction (see FIG. 34A). Then, the recording medium 12 is conveyed. In the second scanning of the recording head, a dot image 412 is recorded in the space formed in the first scanning, which is an area of three dots in the sub-scanning direction by four dots in the scanning direction, using the three downstream ink ejection port arrays (see FIG. 34B). Preferably, the first scanning operation and the second scanning operation are performed in the same direction because if the direction of the first scanning operation and the direction of the second scanning operation are different to record a test patch, the difference in scanning direction may cause displacement of the positions where dots are formed.

In the reference test patch among the seven test patches 401 to 407, namely, the test patch 404, the two dot images 411 are recorded by the first scanning operation, and the dot image 412 is recorded between the two dot images 411 by the second scanning operation. In the test patches 405, 406, and 407, however, the driving timing of the downstream ink ejection port arrays 13 is delayed in the second scanning operation in which the dot image 412 is recorded. Specifically, the dot image 412 is recorded so as to be shifted by ½ pixels, 1 pixel, and 3/2 pixels to the right with respect to the space between the two dot images 411. In the test patches 403, 402, and 401, on the other hand, the driving timing of the downstream ink ejection port arrays 13 is advanced in the second scanning operation in which the dot image 412 is recorded. Specifically, the dot image 412 is recorded so as to be shifted by ½ pixels, 1 pixel, and 3/2 pixels to the left with respect to the space between the two dot images 411.

Figure 15A:
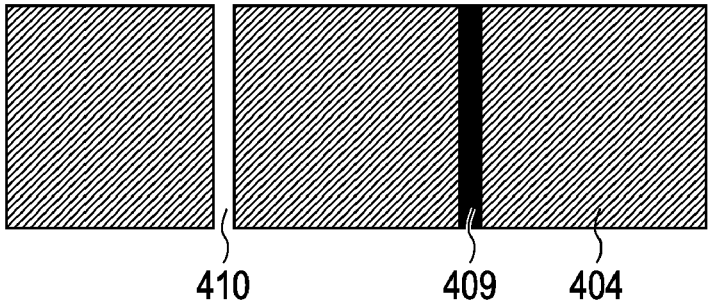
FIGS. 15A and 15B are diagrams showing a test patch in which inclination deviation has occurred and showing a dot array.
Figure 15B:
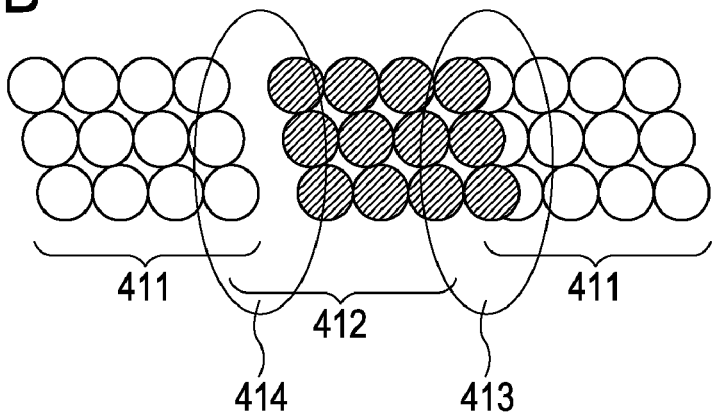
Figure 16:
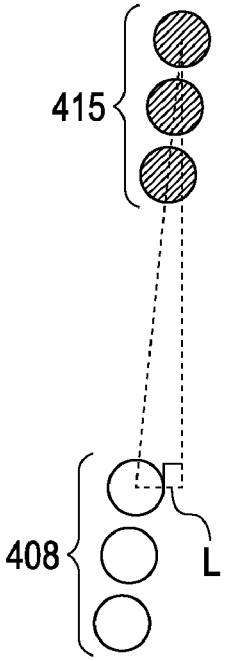
FIG. 16 is a diagram showing deviation in the main scanning direction between an upstream dot and a downstream dot.

FIGS. 15A and 15B are diagrams showing the test patch 404 under the presence of inclination deviation and showing a dot array of the test patch 404. As shown in FIG. 15A, due to the presence of inclination deviation, a black fringe 409 and a white fringe 410 are generated in the test patch 404. In correspondence with the black fringe 409 and the white fringe 410, as shown in FIG. 15B, an overlapping dot portion 413 where dots overlap and a non-dot portion 414 where no dot is formed are generated. In the presence of inclination deviation, as shown in FIG. 16, a deviation L exists in the main scanning direction between upstream dots 408 and downstream dots 415. In the test patch 404, the two dot images 411 are recorded by the first scanning operation and the dot image 412 is recorded between the two dot images 411 by the second scanning operation. Thus, as shown in FIG. 15B, an overlapping dot portion or a non-dot portion is generated between each of the dot images 411 and the dot image 412, resulting in the test patch 404 having the black fringe 409 and white fringe 410 shown in FIG. 15A. Accordingly, the occurrence of inclination deviation may cause a black fringe and a white fringe in the reference test patch 404.

Next, a method of obtaining the amount of inclination, or the amount of deviation in the main scanning direction between an upstream dot and a downstream dot, will be described. As shown in FIG. 17A, the test patch 402 marked with number "−2" out of the seven test patches 401 to 407 is an image having a uniform recording density and including no black fringe or white fringe.

In the test patch 402, the dot image 412 is recorded by advancing the driving timing of the downstream ink ejection port arrays in the second scanning operation so that the dot image 412 can be shifted by one pixel to the left in the main scanning direction with respect to the space between the two dot images 411. Thus, without inclination deviation, a black fringe would be generated in a left portion of the space due to the overlapping of the upstream dots 408 and the downstream dots 415, and a white fringe in which no upstream dots or downstream dots are formed would be generated in a right portion of the space. However, due to the occurrence of inclination deviation, as shown in FIG. 16, a deviation L exists in the main scanning direction between the upstream dots 408 and the downstream dots 415. The deviation L is canceled with the positional displacement of dots that are to be generated by advancing the driving timing of the downstream ink ejection port arrays 13, resulting in a test patch having a uniform recording density. In this manner, the deviation L that exists in the main scanning direction between the upstream dots 408 and the downstream dots 415 is equal to one pixel, and it is found that clockwise deviation of inclination having such displacement in the main scanning direction has occurred.

Accordingly, an image having a uniform recording density is selected from a plurality of test patches that are recorded by delaying or advancing the driving timing of downstream ink ejection port arrays. Therefore, the amount of displacement of dots in the main scanning direction can be obtained as information regarding inclination deviation. In the optical measurement using an optical sensor, a test patch having a high reflecting optical density may be detected as a test patch including no black fringe or white fringe and having a uniform dot arrangement.

In the first embodiment, simply, a test patch having the most uniform dot arrangement is selected using an optical sensor, and the amount of displacement in the main scanning direction between an upstream dot and a downstream dot is detected when the selected test patch is recorded. The detected amount of displacement is obtained as information regarding inclination deviation (amount of inclination). However, any other structure may be used. For example, the optical characteristic of each test patch may be measured, and a test patch having the highest reflecting optical density and a test patch having the second highest reflecting optical density may be detected. The difference between the reflecting optical densities of the two test patches may be determined. If the difference between the reflecting optical densities is equal to or more than a predetermined value, the amount of deviation of the test patch having the highest reflecting optical density may be used as information regarding inclination deviation, and if the difference is equal to or less than the predetermined value, an average of the amount of deviation of the test patch having the highest reflecting optical density and the amount of deviation of the test patch having the second highest reflecting optical density may be used. Alternatively, on the left and right sides of the test patch having the highest reflecting optical density, approximate lines or approximate curves may be determined through collinear approximation or polynomial approximation from optical characteristic data of the test patches. Then, information regarding inclination deviation may be obtained from an intersection of those two lines or curves.

In step S13, correction information is set in the correction value storage unit 217 in accordance with the amount of displacement of arranged dots with respect to the main scanning direction, which is detected by the measurement of the optical characteristic in step S12. In the first embodiment, the correction information may be the number of recording elements (correction value) corresponding to recording data for which the read position is changed for each of groups 0 to 7. As shown in FIG. 18, this correction information is set in the correction value storage unit 217 in the form of a table. In a case where inclination deviation of "−2" has occurred in the structure of the first embodiment, the correction values for the reference group, or group 0, and group 1 are set to 0 and 2, respectively. The correction values for groups 2, 3, 4, 5, 6, and 7 are further set to 4, 6, 8, 10, 12, and 14, respectively.

The correction values for the respective groups may be determined in accordance with various amounts of inclination, and may be stored in advance in the form of a plurality of tables. Alternatively, the correction value for the reference group, or group 0, may be set to 0, and the correction value for group 7 may be determined from the amount of inclination. The correction values for the groups located therebetween may be determined by performing a simple calculation.

In the first embodiment, furthermore, a reference group for which the correction value is set to 0 is group 0. The reference group may be a group other than group 0. For example, if group 4 is used as a reference, the correction values for groups 0, 1, 2, and 3 are set to −8, −6, −4, and −2, respectively. The correction values for groups 5, 6, and 7 are further set to 2, 4, and 6, respectively.

In step S14, the read position of recording data is changed on the basis of the correction information set in the correction value storage unit 217 in the manner described above. In step S15, an image is recorded on a recording medium on the basis of the recording data for which the read position has been changed.

Figure 1:
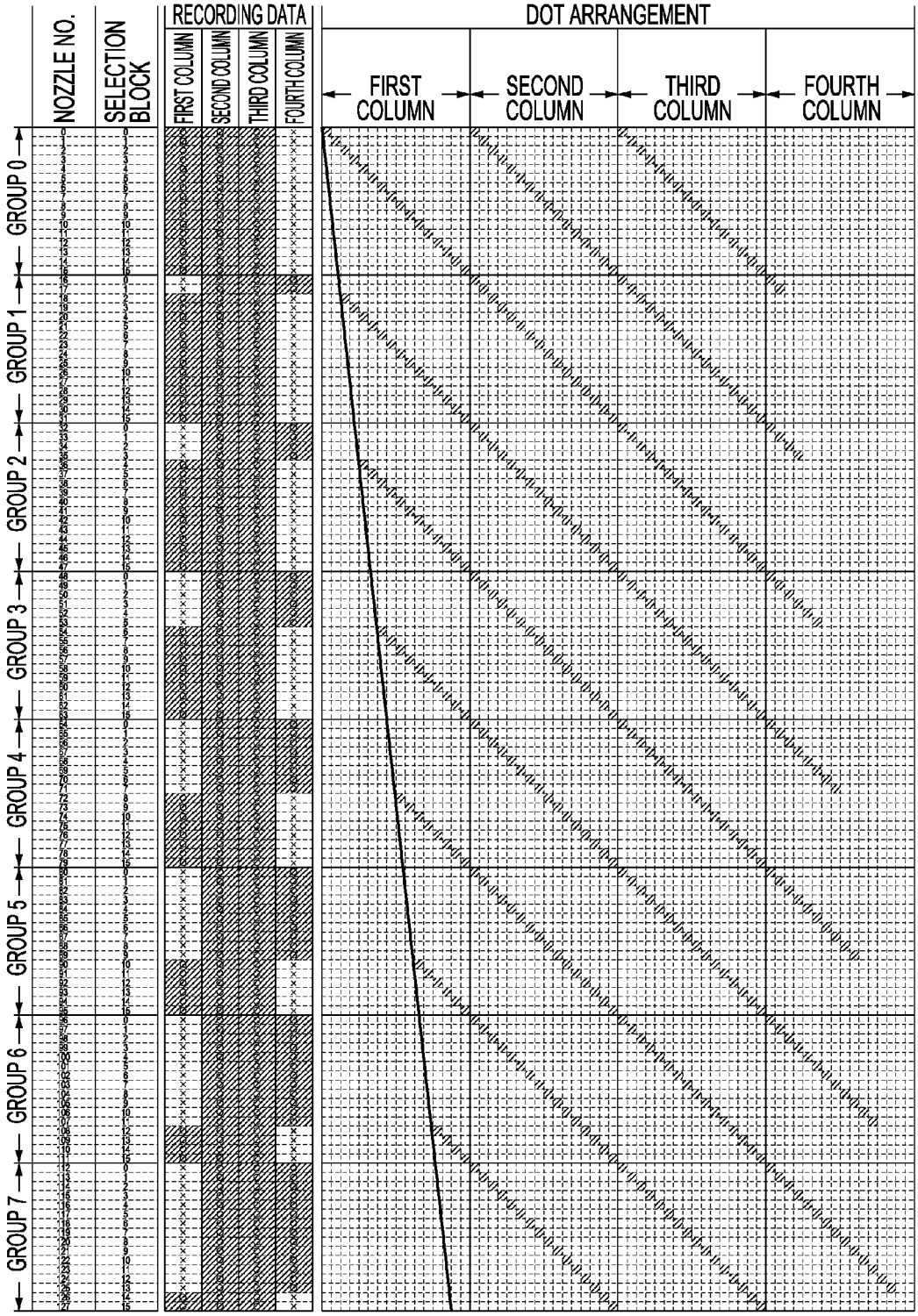
FIG. 1 is a diagram showing nozzle numbers, blocks, recording data, and a dot arrangement in the correction of inclination deviation according to a first embodiment.

FIG. 1 is a diagram showing nozzle numbers assigned to the recording elements of groups 0 to 7, block numbers, recording data, and a dot arrangement. In FIG. 1, the recording data indicates a timing of reading of recording data of the first to third columns assigned to the recording elements. The dot arrangement schematically shows an arrangement of dots formed on a recording medium when recording is performed at that timing under the absence of inclination deviation. When the read position of recording data is changed, the dot arrangement shown in FIG. 1 is obtained under the absence of inclination deviation. However, due to the presence of inclination deviation, the dots are arranged in the true columns, which will be described later.

In the first embodiment, as can also be seen from the "recording data" column shown in FIG. 1, the read position of recording data associated with a number of recording elements specified by a correction value is changed starting from the recording element of block number 0 in each group. For example, the correction value for group 1 is set to 2, and the read position of recording data associated with two recording elements of blocks 0 and 1 is changed from the timing of the true, first to third columns to the timing of the second to fourth columns. The read position of recording data up to block 3 for group 2, the read position of recording data up to block 5 for group 3, and the read position of recording data up to block 7 for group 4 are offset by one column and are changed to the timing of the second to fourth columns. The read position of recording data up to block 9 for group 5, the read position of recording data up to block 11 for group 6, and the read position of recording data up to block 13 for group 7 are offset by one column and are changed to the timing of the second to fourth columns.

Figure 2:
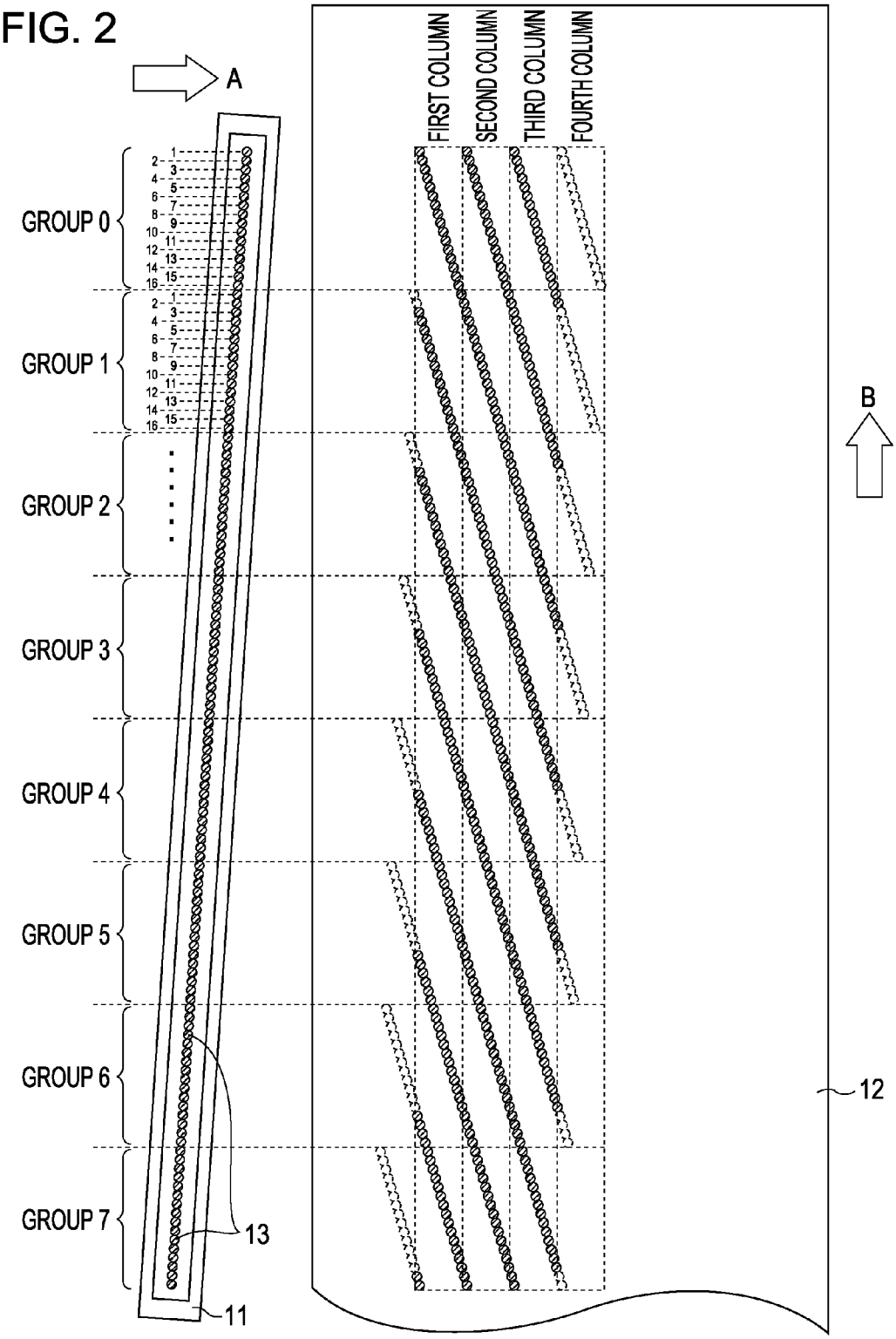
FIG. 2 is a diagram showing an arrangement of dots obtained as a result of the correction of inclination deviation according to the first embodiment.

FIG. 2 shows an arrangement of dots formed on the recording medium 12 as a result of correction of inclination deviation according to the first embodiment. In FIG. 2, hollow dots represent dots that will be formed when correction of inclination deviation is not performed according to the first embodiment. If inclination deviation has occurred, as shown in FIG. 2, dots formed outside the true columns are generated. The number of dots outside the true columns increases in accordance with the group number, for example, two dots of blocks 0 and 1 for group 1 and four dots of blocks 0 to 3 for group 2. If inclination deviation has occurred, therefore, the number of dots that are formed outside the true columns in each group increases as one moves from an end of the recording head to the other end. In accordance with the number of dots formed outside the true columns, dots to be offset in position in each group need to be determined. Further, depending on the amount of inclination, the number of dots formed outside the true columns varies even in the same group. That is, the larger the amount of inclination, the larger the correction value is set to, even for the same group, resulting in an increase in the number of recording elements corresponding to the recording data for which the read position is to be offset.

In the correction of inclination deviation according to the first embodiment, the read position of recording data assigned to recording elements are changed for every recording element in the main scanning direction. In the first embodiment, therefore, the number of dots for which the position of column used for recording is changed is variable for every group in accordance with the amount of inclination.

For example, if inclination deviation with an amount of inclination of "−2" has occurred, for group 2, four dots of blocks 0 to 3 are formed outside the true position. Since the correction value for group 2 is set to 4, the read position of recording data assigned to the recording elements of blocks 0 to 3 is offset by one column. Since the correction value for group 3 is set to 6, the read position of recording data assigned to the recording elements of blocks 0 to 5 is offset by one column. Accordingly, the read position of recording data assigned to recording elements is variable for every recording element, thus allowing only a dot outside the true column to be offset in the main scanning direction in accordance with the amount of inclination. According to the first embodiment, furthermore, even if the number of dots outside the true columns increases as one moves from one end of the recording head to the other end, the correction values for each group are also increased as one moves from one end of the recording head to the other end, thus allowing only a dot outside the true column to be offset.

Accordingly, the number of dots outside the true columns due to the occurrence of inclination deviation differs from group to group. In the first embodiment, however, a correction value is set for each group, and the read position of recording data associated with a number of recording elements specified by the correction value can be changed. According to the first embodiment, therefore, deterioration in image quality caused by inclination deviation can be reduced.

In the foregoing description, it is possible to correct all dots that lie outside the true columns. Depending on the amount of inclination, however, all the dots may not be corrected. In this case, a correction value that provides a maximum number of correctable dots may be set for each group to correct inclination deviation.

An example of a configuration of an apparatus for correcting inclination deviation according to the first embodiment will be described.

Figure 41:
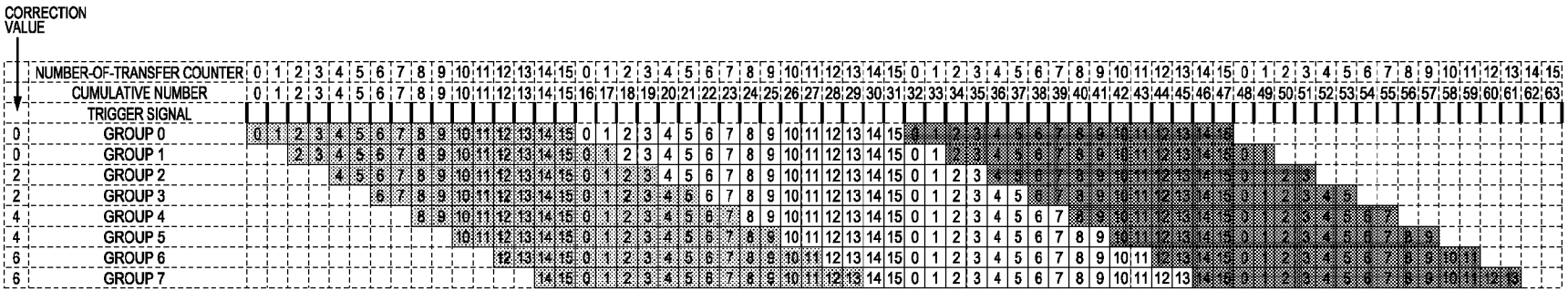
FIG. 41 is a timing chart showing a timing of reading of recording data from the third memory.

FIG. 41 is a timing chart showing a timing of reading of recording data from the third recording memory 213. In FIG. 41, the term "cumulative number" is a time-axis index value indicating the number of recording timing signals counted from a reference. The value of number-of-transfer counter refers to, as described previously, a value incremented by the number-of-transfer counter 216 for each recording timing signal, and is reset to 0 after the number-of-transfer counter 216 counts from 0 to 15. Numbers written in frames below the "trigger signal" field represent block numbers for which a recording timing signal is transferred at the defined timing.

In FIG. 41, lightly shaded frames represent recording data to be recorded in the first column, and unshaded frames represent recording data to be recorded on the second column. Darkly shaded frames represent recording data to be recorded on the third column.

In the first embodiment, the correction values for groups 0, 1, 2, 3, 4, 5, 6, and 7 are set to 0, 2, 4, 6, 8, 10, 12, and 14, respectively, in the correction value storage unit 217. Referring to FIG. 41, for group 0 for which the correction value is set to 0, recording data of the first column is recorded for a period from cumulative numbers 0 to 15. For group 1 for which the correction value is set to 2, the recording timing is shifted by two cumulative numbers, and recording data of the first column is recorded for a period from cumulative numbers 2 to 17.

A process for generating recording data in the correction of inclination deviation according to the first embodiment will now be described.

First, the data selection circuit 215 reads data items of Banks 0 and 2 from the third recording memory 213 at the timing of cumulative numbers 0 to 15. At the timings of cumulative numbers 16 to 31, data items of Banks 1 and 0 are read. At the timing of cumulative numbers 32 to 47, data items of Banks 2 and 1 are read. At the timing of cumulative numbers 48 to 63, data items of Banks 1 and 0 are read. Accordingly, the data selection circuit 215 reads data items from two of Banks 0, 1, and 2 in accordance with the cumulative number.

For example, for cumulative number 0, data items of Banks 0 and 2 are read. Thus, recording data items of block 0, i.e., recording data item (Bank 0) at address 0 and recording data item (Bank 2) at address 20, are read (see FIG. 41). At the timing of cumulative number 22, data items of Banks 1 and 0 are read. Thus, recording data items of block 6, i.e., recording data item (Bank 1) at address 16 and recording data item (Bank 0) at address 6, are read.

Figure 42:
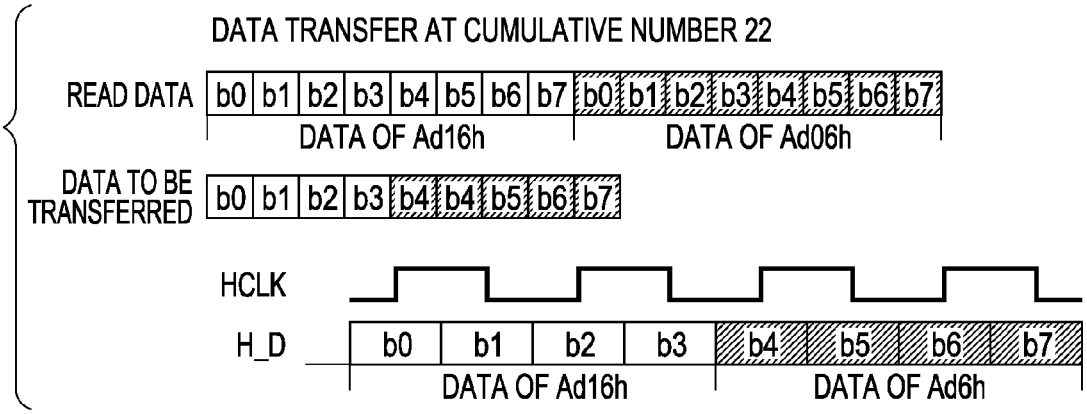
FIG. 42 is a schematic diagram showing the generation of transfer data at the timing of cumulative number 22.

FIG. 42 is a schematic diagram schematically showing the generation of recording data (transfer data) that is transferred to the recording head 11 at the timing of cumulative number 22. In FIG. 42, recording data item b0 to be transferred is a recording element data item of a block corresponding to the cumulative number for group 0, Since the block for which transfer is block 6, the recording data item b0 is the recording data item of block 6 for group 0, i.e., the data item to be recorded from SEG 6 of the recording head 11. Recording data item b7 is a recording element data item of block 6 for group 7, i.e., the data item to be recorded from SEG 118 of the recording head 11.

Figure 39:
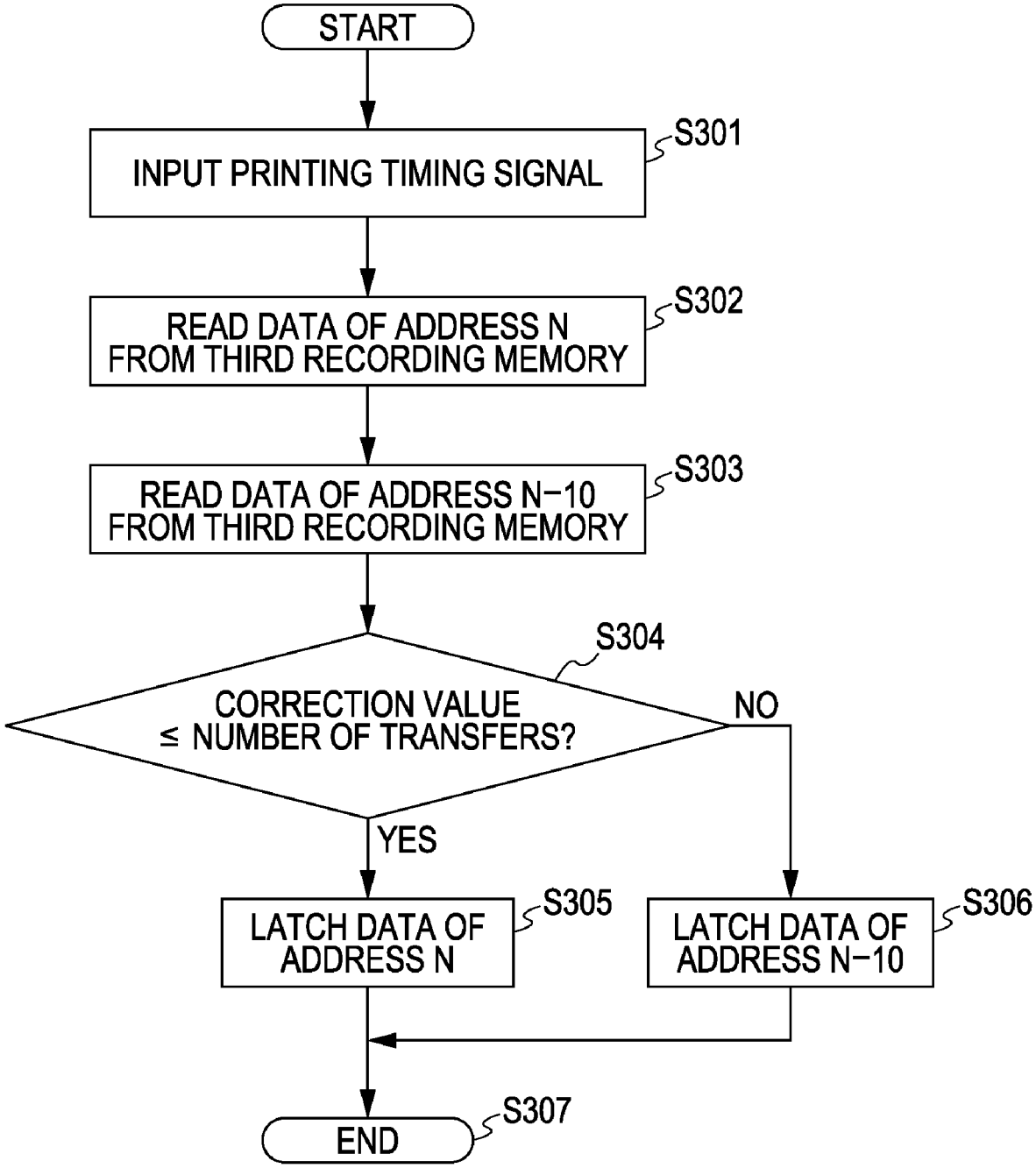
FIG. 39 is a flowchart showing a process for a data selection circuit 215 to select recording data.

FIG. 39 is a flowchart showing a process for the data selection circuit 215 to select recording data. A method of generating transfer data at the timing of cumulative number 22 will be described with reference to FIG. 39.

When a recording timing signal is input (step S301), recording data is read from address 16 of Bank 1 of the third recording memory 213, and is temporarily stored in a first internal latch unit (not shown) (step S302). Then, recording data is read from address 6 of Bank 0 of the third recording memory 213, and is temporarily stored in a second latch unit (not shown) (step S303).

Then, the correction value for group 0 and the current number-of-transfer counter value are compared (step S304). In the first embodiment, the correction value for group 0 is set to 0, and is equal to or more than the number of transfers, 6 (i.e., $0 \leqq 6$). Thus, the data at the area b0 of address 16 is stored in a third latch unit (step S305).

Similar processing is performed for groups 0 to 7. For example, for group 4, the correction value is set to 8 and the number of transfers is 6, which do not satisfy the condition of step S304. Thus, the data at the area b4 of address 6 is stored in the third latch unit (step S306). The processing is performed for groups 0 to 7 in the manner described above to obtain transfer data items b0 to b7.

Referring back to FIG. 42, the transfer data items b0 to b3 for groups 0 to 3 are recording data items to be recorded at the timing of cumulative number 22, i.e., recording data items of the second column. The transfer data items b4 to b7 for groups 4 to 7, on the other hand, are recording data items of the first column to be recorded at a timing 16 timings prior to the current timing. The generated recording data is transmitted to the recording head 11 by the recording data transfer circuit 219 together with the signal HCL generated by the data transfer CLK generator 218.

Figure 43:
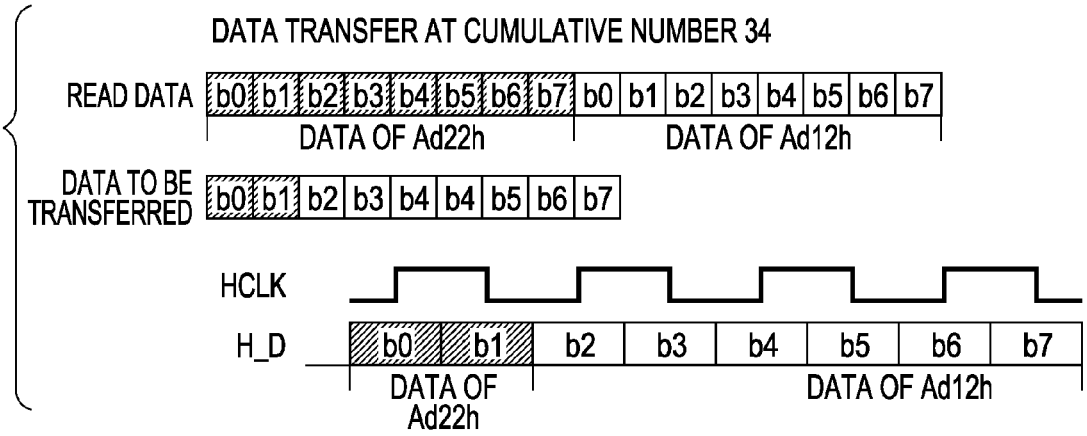
FIG. 43 is a schematic diagram showing the generation of transfer data at the timing of cumulative number 34.

FIG. 43 is a schematic diagram schematically showing the generation of recording data (transfer data) that is transferred to the recording head 11 at the timing of cumulative number 34. At the timing of cumulative number 34, recording data of block 2, i.e., the recording data at address 22 and the recording data at address 12, is read from the third recording memory 213.

Referring to the flowchart of FIG. 39 showing the process for selecting recording data, as a result of comparison between the correction values for groups 0 to 7 and the number-of-transfer counter values, groups 0 and 1 satisfy the relationship of step S304 between the correction value and the number of transfers. Thus, recording data at address 21 is selected as transfer data items b0 and b1 of group 0 and group 1, and recording data at address 11 is selected as transfer data of groups 2 to 7.

In the first embodiment, data for two banks is read from the third recording memory 213, and is stored in the first and second latch units, after which data is selected. The selected data is stored as transfer data in the third latch unit. Alternatively, control equivalent to that described above may be performed using only one latch unit.

Figure 40:
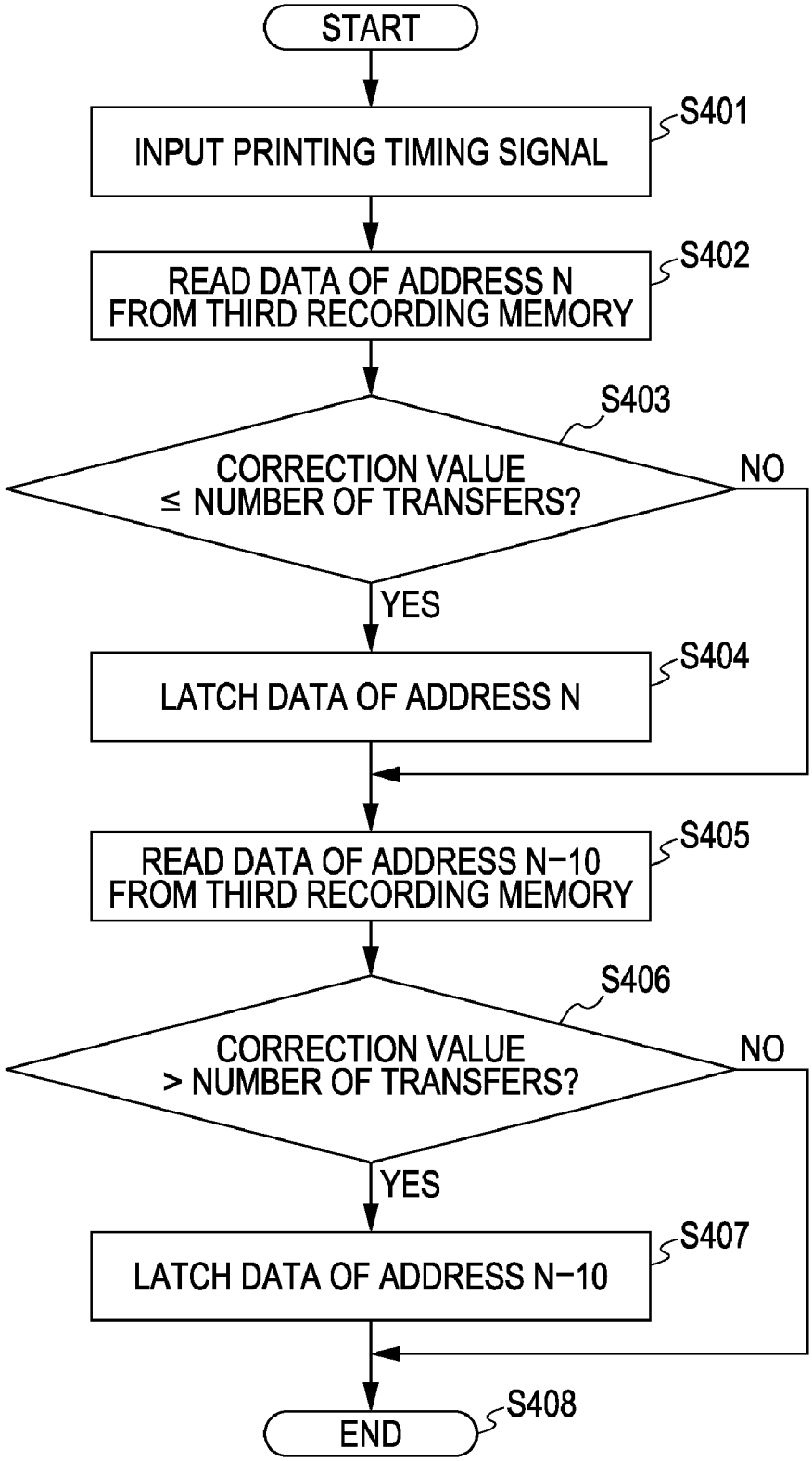
FIG. 40 is a flowchart showing a process for performing control using only one latch unit.

FIG. 40 is a flowchart showing a process for performing control using only one latch unit. After a recording timing signal is input (step S401), recording data is read from address 16 of Bank 1 of the third recording memory 213 (step S402). Then, the correction value for group 0 and the current number-of-transfer counter value are compared (step S403). In the first embodiment, the correction value for group 0 is set to 0, and is equal to or more than the number of transfers, 6

(i.e., 0<6). Thus, the data at the area b0 of address 16 is stored in the latch unit (step S404). Similar processing is performed for groups 1 to 7. In step S404, only data for a group satisfying the condition of the correction value<the number-of-transfer counter value in step S403 is latched.

Then, recording data is read from address 16 of Bank 0 of the third recording memory 213 (step S405). In this step, recording data for a group that does not satisfy the condition in step S403 is latched (step S406). That is, data for a group that satisfies the condition of the correction value>the number-of-transfer counter value is latched. Similar processing is performed for groups 0 to 7 to obtain transfer data items b0 to b7.

In a case where similar control is performed at the timing of cumulative number 22, in step S404, only data items b0 to b3 at address 13 are latched, and in step S407, data items b4 to b7 at address 3 are latched.

In the first embodiment, data for two banks is read from the third recording memory 213. However, for the first column, recording data of Bank 0 and recording data of Bank 2, which is data of the preceding column, are read. Since the first column is a column immediately after the recording operation is started, the data of the preceding column does not exist. Therefore, the data read from Bank 2 is discarded and is not used for the recording operation for the first column. Similarly, for the fourth column, recording data of Bank 0 and recording data of Bank 2, which is data of the preceding column, are read. Since the fourth column is a column in which the recording operation ends, the data to be recorded in the current column does not exist. Therefore, the data read from Bank 0 is discarded and is not used for the recording operation for the fourth column.

With the configuration of the apparatus described above, therefore, the read position of recording data assigned to recording elements is variable for every recording element. Therefore, the amount of inclination is obtained, and a correction value for each group is set in accordance with the amount of inclination, thus allowing only a dot formed outside the true column to be corrected. According to the first embodiment, deterioration in image quality caused by inclination deviation can be reduced.

As a modification of the first embodiment, manual detection of information regarding inclination deviation will now be described.

In the first embodiment, in order to obtain information regarding inclination deviation, the amount of deviation of dots in the main scanning direction, which are formed from upstream and downstream ink ejection ports 13, is detected using an optical sensor. However, the ink jet recording apparatus according to the first embodiment may not be necessarily provided with an optical sensor. In this case, a test patch including no black fringe or white fringe and having a uniform density is visually selected by a user from among the seven test patches 401 to 407 shown in FIG. 14. Then, the user may input information concerning the selected test patch (e.g., "−2") to a host such as a personal computer (PC) so that the information can be transferred to the ink jet recording apparatus. Alternatively, the user may set information concerning the selected test patch using an input unit provided in the ink jet recording apparatus.

Even in a case where the ink jet recording apparatus is provided with an optical sensor, in order to avoid inconvenience due to the breaking of the optical sensor, a mode in which the amount of inclination is detected using the optical sensor and a mode in which the amount of inclination is visually detected by a user may be provided.

The correction of counterclockwise deviation of inclination will be described.

The first embodiment has been described in the context of a method of correcting inclination deviation in a case where the recording head 11 is inclined clockwise. The first embodiment may also provide correction of deviation of counterclockwise inclination of the recording head 11. In the following description, downstream dots are one pixel shifted to the left in the main scanning direction with respect to upstream dots ("+2"). A structure similar to that described above with respect to the first embodiment will not be discussed herein.

In the correction of such inclination deviation, the correction values for groups 0, 1, 2, and 3 are set to 14, 12, 10, and 8, respectively, in the correction value storage unit 217. The correction values for groups 4, 5, 6, and 7 are further set to 6, 4, 2, and 0, respectively.

Figure 19:
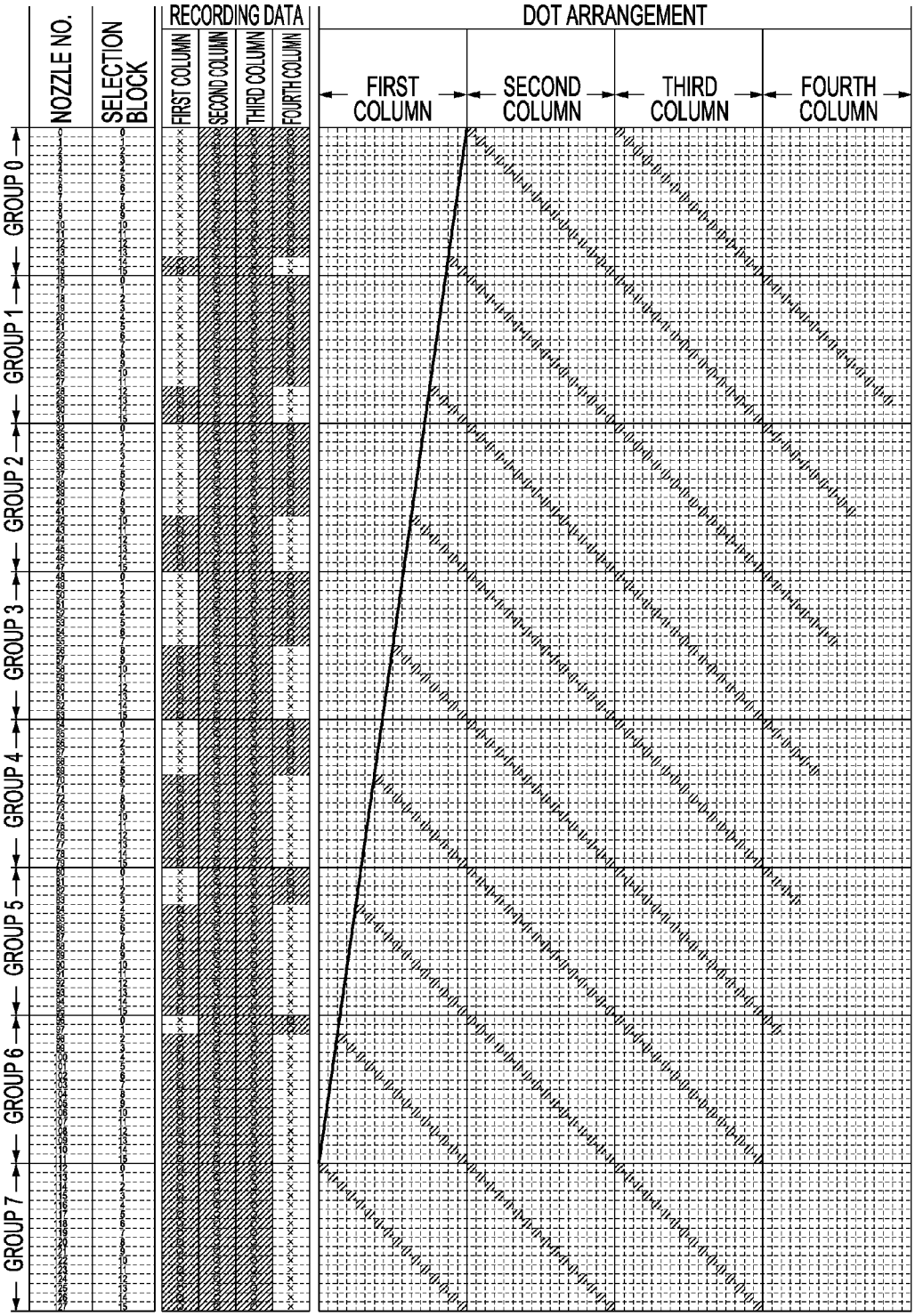
FIG. 19 is a diagram showing nozzle numbers, blocks, recording data, and a dot arrangement in the correction of counterclockwise deviation of inclination.

FIG. 19 is a diagram showing nozzle numbers assigned to the recording elements of groups 0 to 7, a driving order, recording data, and a dot arrangement. In each group, the read position of recording data assigned to a number of recording elements specified by correction information is offset starting from the recording element having the highest priority order of ejection. That is, the read position of the recording data assigned to the recording elements of blocks 0 to 13 for group 0, the read position of the recording data the recording elements of blocks 0 to 11 for group 1, the read position of the recording data the recording elements of blocks 0 to 9 for group 2, and the read position of the recording data the recording elements of blocks 0 to 7 for group 3 are changed to the position of the second to fourth columns. The read position of the recording data items assigned to the recording elements of up to block 5 for group 4, the read position of the recording elements of up to block 3 for group 5, and read position of the recording elements of up to block 1 for group 6 are changed to the position of the second to fourth columns.

Figure 20:
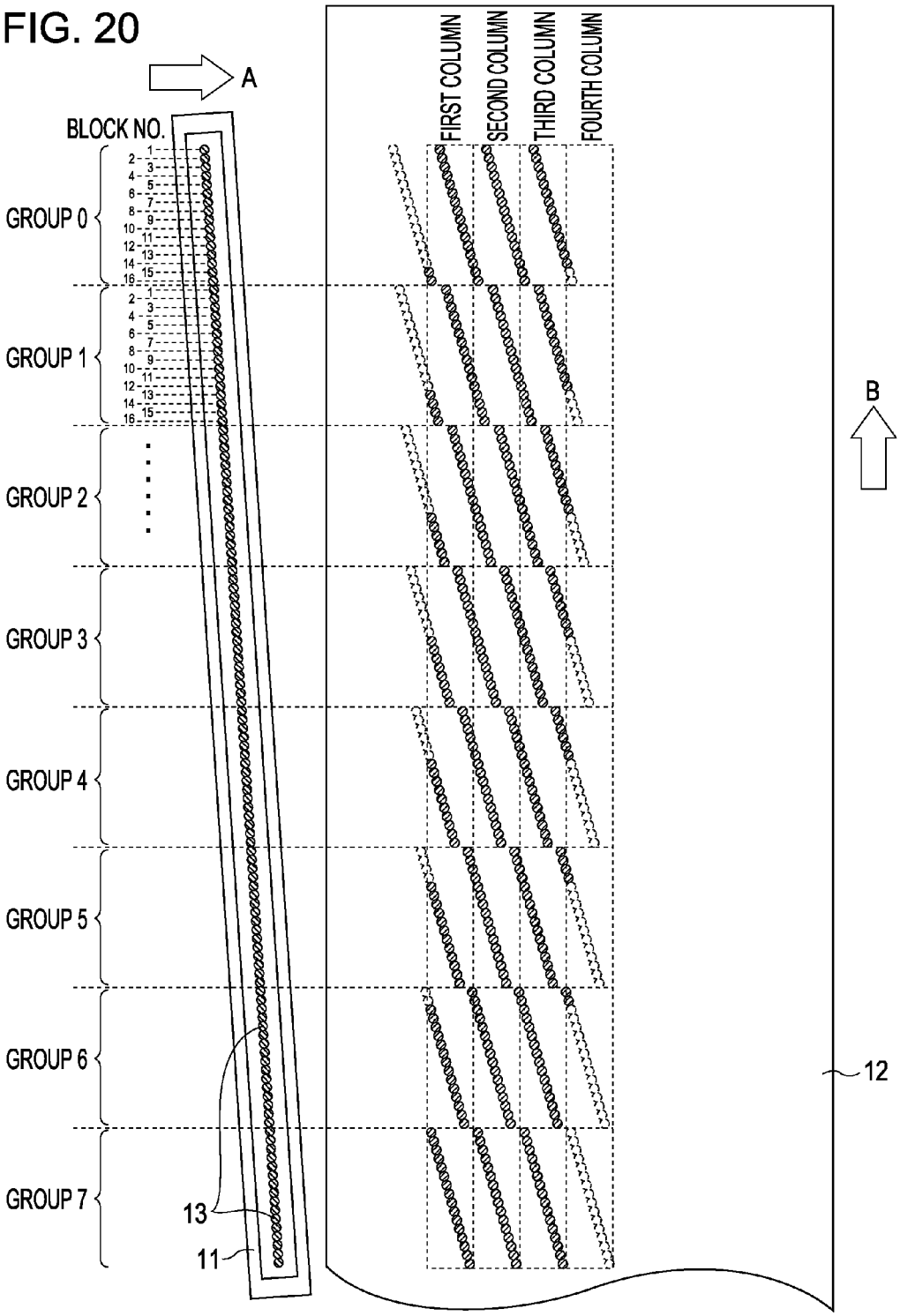
FIG. 20 is a diagram showing an arrangement of dots formed as a result of the correction of counterclockwise deviation of inclination.

FIG. 20 shows an arrangement of dots formed on a recording medium as a result of the correction of inclination deviation shown in FIG. 19. According to the first embodiment, counterclockwise deviation of inclination is corrected by setting a correction value for each group and changing the read position of recording data corresponding to a number of recording elements specified by a correction value. Thus, even in the case of counterclockwise deviation of inclination, only a dot formed outside the true column can be corrected, and deterioration in image quality caused by such inclination deviation can be reduced.

The correction of inclination deviation based on distributed driving will now be described.

In an ink jet recording method, heaters or piezoelectric elements are used as recording elements to apply energy to ink, and are arranged to eject ink drops to record an image. In such an ink jet recording method, ejection of an ink drop from a certain ink ejection port affects a nozzle portion of an adjacent ink ejection port due to pressure wave or the like to cause unstable ejection of ink from the adjacent ink ejection port (this phenomenon is called crosstalk). It is therefore desirable that recording be performed by time-division driving (distributed driving) in which recording elements located at discrete positions are driven in turn to prevent ink drops from being successively ejected from adjacent ink ejection ports.

In the case of performing correction of inclination deviation using time-division driving based on such a distributed driving method, the correction values for each group are set so that correction values for groups 0, 1, 2, and 3 are set to 0, 2, 4, and 6, respectively, in the correction value storage unit 217.

The correction values for groups 4, 5, 6, and 7 are further set to 8, 10, 12, and 14, respectively.

Figure 21:
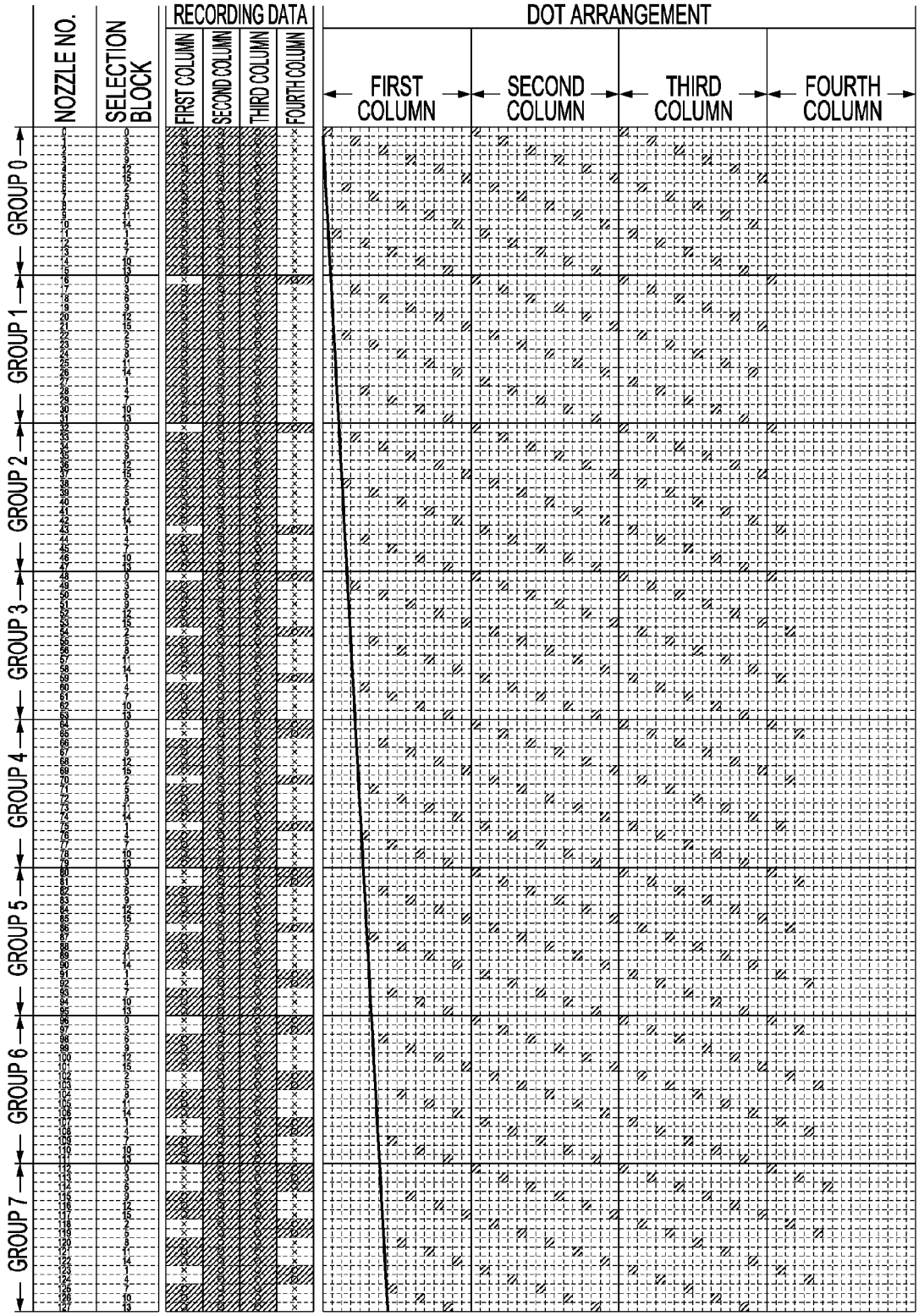
FIG. 21 is a diagram showing nozzle numbers, blocks, recording data, and a dot arrangement in the correction of inclination deviation in distributed driving.
Figure 22:
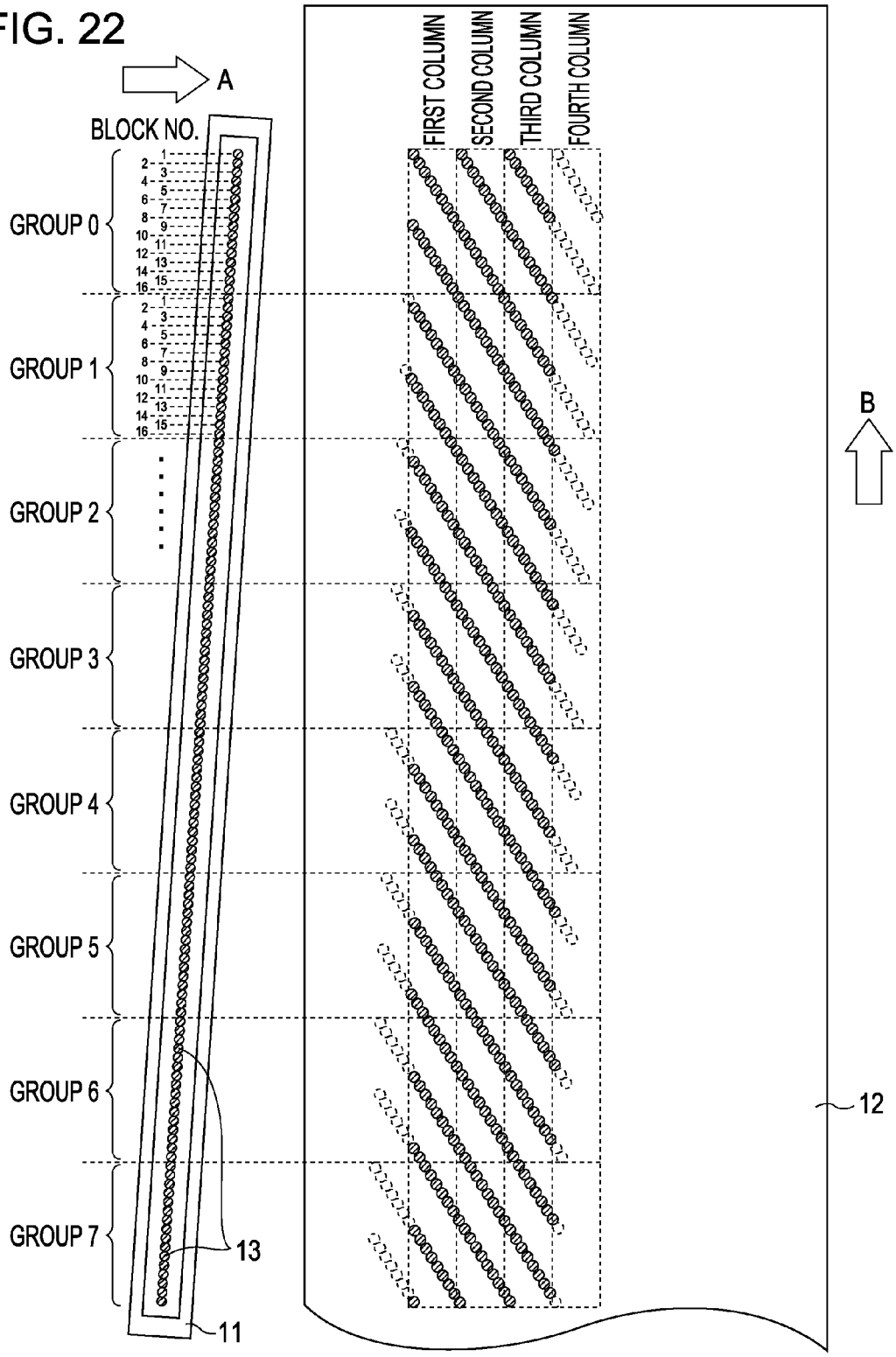
FIG. 22 is a diagram showing an arrangement of dots formed as a result of the correction of inclination deviation in distributed driving.

FIGS. 21 and 22 are diagrams showing the correction of inclination deviation in the case of recording in accordance with a driving order based on the distributed driving method. FIG. 21 is a diagram showing nozzle numbers assigned to recording elements of each group, a driving order, recording data, and a dot arrangement. FIG. 22 shows an arrangement of dots formed on a recording medium as a result of the correction of inclination deviation shown in FIG. 21.

In the distributed driving method, the driving order is different from that of the first embodiment, and recording elements corresponding to the recording data for which the read position is to be changed are different from those of the first embodiment. However, the read position of recording data assigned to a number of recording elements specified by a correction value starting from the recording element having the highest priority order of ejection in each group is offset in a manner similar to the first embodiment.

As can also be seen from FIG. 22, according to the first embodiment, also in the structure of distributed driving, a correction value is set for each group, and the read position of recording data corresponding to a number of recording elements specified by a correction value is changed. Only a dot that lies outside the true column for each group is offset in the main scanning direction, whereby deterioration in image quality caused by inclination deviation can be reduced.

A method of correcting a smaller amount of inclination deviation than that of the first embodiment will now be described in the context of inclination deviation ("−1") caused when a downstream dot is ½ pixels shifted to the right in the main scanning direction with respect to an upstream dot.

In the correction of inclination deviation of "−1", correction values for groups 0, 1, 2, and 3 are set to 0, 1, 2, and 3, respectively, and are stored in the correction value storage unit 217. The correction values for groups 4, 5, 6, and 7 are further set to 4, 5, 6, and 7, respectively. The read position of recording data assigned to a number of recording elements specified by the correction values is offset starting from the recording element having the highest priority order of ejection in each group. That is, the position of the recording data assigned to the recording elements of up to block 0 for group 1, the position of the recording data assigned to the recording elements of up to block 1 for group 2, and the position of the recording data assigned to the recording elements of up to block 2 for group 3 are changed to the position of the second to the fourth columns. The position of the recording data assigned to the recording elements of up to block 3 for group 4, the position of the recording data assigned to the recording elements of up to block 4 for group 5, the position of the recording data assigned to the recording elements of up to block 5 for group 6, and the position of the recording data assigned to the recording elements of up to block 6 for group 7 are also changed to the position of the second to fourth columns.

Accordingly, the first embodiment also allows the correction of a small amount of inclination deviation less than one column. Further, in a case where the amount of inclination is small, a correction value is set for each group so as to reduce the number of recording elements corresponding to the recording data for which the read position is to be offset. Thus, the correction of inclination deviation according to the first embodiment can be applied to the correction of a smaller amount of inclination deviation less than one column.

The correction of inclination deviation caused by changing the storage position of recording data will be described.

In the foregoing description with respect to the first embodiment, the position at which recording data for a recording element specified by a correction value is read from the third recording memory 213 is changed in the main scanning direction to correct inclination deviation. However, the third recording memory 213 may not be necessarily provided to change the read position of data on the basis of correction information when data is read in units of columns from recording data subjected to HV conversion processing.

Alternatively, recording data may be stored in a recording memory instead of the third recording memory 213 on the basis of information regarding inclination deviation. That is, a storage position may be changed to a separate recording memory so that a number of dots specified by a correction value can be offset in the main scanning direction for each group, and recording data may be read from the separate recording memory using an existing method. Therefore, the correction of inclination deviation of the first embodiment is achieved.

Further, it is to be understood that when recording data transferred from a host and expanded is subjected to HV conversion processing, the storage position of the recording data may be changed to a recording memory in which the processed recording data is stored on the basis of correction information.

The correction of inclination deviation of one column or more will be described.

In the structure described above, if the amount of inclination is large, the correction value set in the correction value storage unit 217 is also large, leading to an increase in cost of the apparatus because of the use of a memory capable of storing correction information to handle a large amount of correction information. For example, a dot formed by a downstream ink ejection port of a recording head is two columns shifted to the right in the main scanning direction with respect to a dot formed by an upstream ink ejection port of the recording head. In order to correct such inclination deviation, as correction information, for example, the correction values for the reference group, or group 0, and group 1 are set to 0 and 4, respectively. The correction values for groups 2, 3, 4, 5, 6, and 7 are further set to 8, 12, 16, 20, 24, and 28, respectively. In the structure described above, therefore, if the amount of inclination is large, the correction values stored as correction information are also large, resulting in a large amount of correction information.

In the first embodiment, a structure of correcting inclination deviation using a correction value including a rough metering value and a fine metering value is employed. A rough metering value is a value for offsetting the read position of image data assigned to all recording elements within a group by a specified number of columns. For example, a rough metering value of 1 is set for a given group. The read position of image data for all recording elements within the given group is offset by one column in the main scanning direction. A fine metering value is a value for offsetting the read position of image data assigned to a specified number of recording elements within a group by one column. For example, a fine metering value of 2 is set for a given group. The read position of recording data corresponding to two recording elements of blocks 0 and 1 is offset by one column.

A method of correcting inclination deviation according to the first embodiment will now be descried with reference to FIG. 23. For simplicity of description, an image is recorded using recording data of one column for column 0. Also in this example, a recording head has 64 ink ejection ports.

FIG. 23 schematically shows an arrangement of dots formed on a recording medium under the absence of inclination deviation as a result of changing of the timing of reading of recording data assigned to each recording element. FIG. 23 shows an example of correction of inclination deviation caused by clockwise inclination of dots arranged on the recording medium by 1.5 columns, each column corresponding to 1200 dpi (about 21 microns), between the top group and the bottom group of FIG. 23.

In this example, group 0 (1801) formed by the recording elements 0 to 15 is a reference group. For the recording elements of group 0, the read position of recording data for any recording element is not offset. For group 1 (1802) formed by the recording elements 16 to 31, a rough metering value of 0 and a fine metering value of 8 are set as correction values. Thus, the read position of recording data for all the recording elements is not offset while the read position of recording data corresponding to the recording elements of blocks 0 to 7 is offset in the main scanning direction. For group 2 (1803), a rough metering value of 1 and a fine metering value of 0 are set as correction values. Thus, data is offset by one column for the entire group. For group 3 (1804), a rough metering value of 1 and a fine metering value of 8 are set as correction values. First, data is offset by one column for the entire group. Then, the read position of recording data corresponding to the recording elements of blocks 0 to 7 is offset by one column in the main scanning direction.

Accordingly, with the correction of inclination deviation based on a correction value including a rough metering value and a fine metering value, the amount of correction information can be reduced to correct inclination deviation even if the amount of inclination is large, and deterioration in image quality can therefore be reduced.

The corrections of inclination deviation described previously, that is, the correction of counterclockwise deviation of inclination and the correction of inclination deviation based on distributed driving, can also be performed using a correction value including a rough metering value and a fine metering value.

The correction of inclination deviation is performed using a rough metering value and a fine metering value, thereby achieving the further advantage of preventing an increase in capacity of the third recording memory 213 in which recording data is stored. The third recording memory 213 has a three-bank structure in which one bank is used for writing and the rest two are for reading. In this structure, two banks are provided as areas used for the reading operation, thus allowing the read position of recording data to be changed in accordance with inclination deviation if a dot that lies outside the true column is shifted to an adjacent column. If the amount of inclination deviation is large, however, a read area as large as three or more banks is needed to offset recording data so that the recording data can be recorded in the true column. However, the storage position of recording data for the entire group is changed to the second recording memory 211 on a column-by-column basis according to a rough metering value, whereby only a dot that is to be corrected for each group can be offset by one column without using a read area as large as three or more banks. In the first embodiment, therefore, an increase in capacity of a recording memory in which recording data is stored can be suppressed.

Further, when data is read from the second recording memory 211, the read position of the data may be changed on a column-by-column basis for the entire group according to a rough metering value. Thus, the required memory capacity can be reduced if the storage position of the data is changed to a separate recording memory so that a number of dots specified by a correction value for each group can be offset in the main scanning direction.

Second Embodiment

A second embodiment provides a method of correcting inclination deviation in reciprocating scanning of a recording head to perform recording on a recording medium, called two-way recording. In the second embodiment, an image is recorded using recording data of one column for column 0, and the recording head has 64 ink ejection ports.

Figure 24:
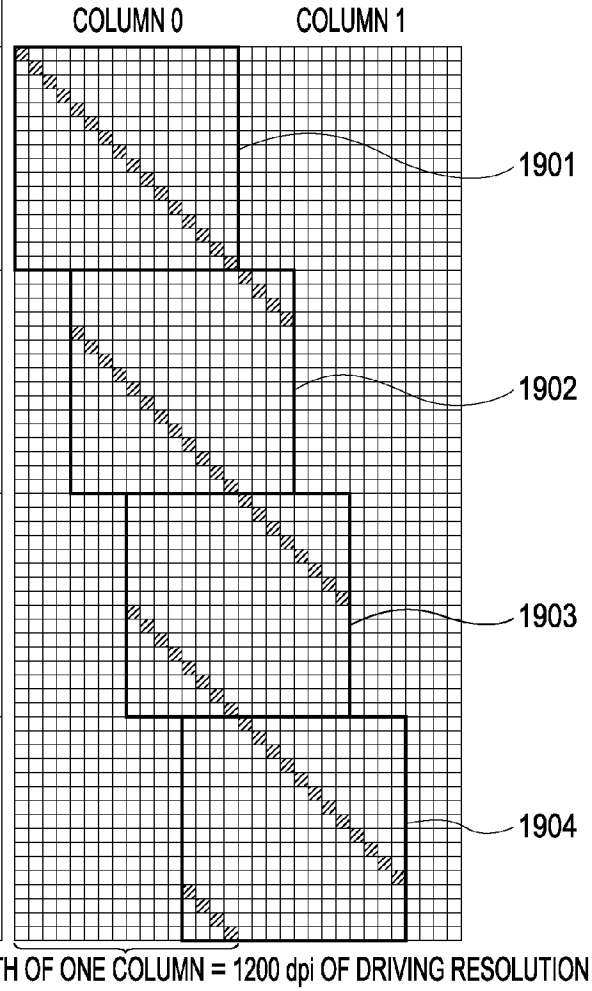
FIG. 24 is a diagram showing a method of correcting inclination deviation using a rough metering value and a fine metering value in forward scanning.
Figure 25:
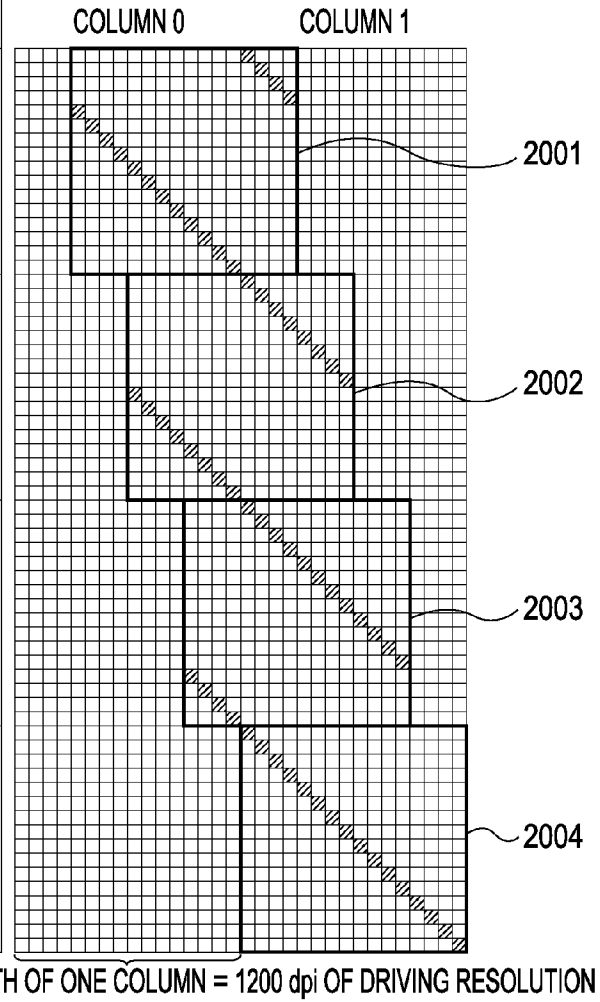
FIG. 25 is a diagram showing a method of correcting inclination deviation using a rough metering value and a fine metering value in reverse scanning.
Figure 26:
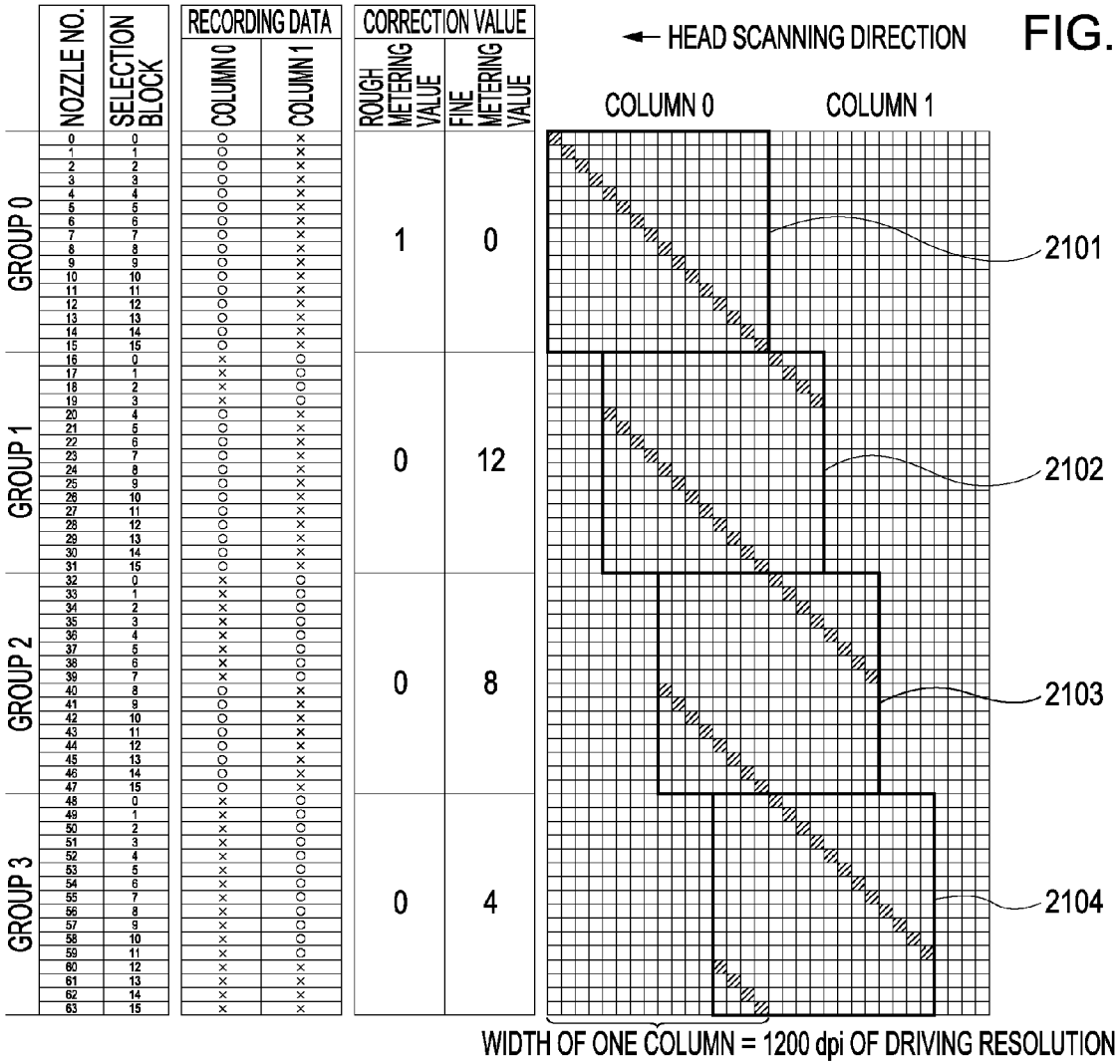
FIG. 26 is a diagram showing another method of correcting inclination deviation using a rough metering value and a fine metering value in reverse scanning.

FIGS. 24, 25, and 26 show a method of correcting inclination deviation according to the second embodiment. FIG. 24 schematically shows an arrangement of dots formed on a recording medium under the absence of inclination deviation as a result of recording by forward scanning of the recording head (scanning in a direction from the left to right in FIG. 24), wherein the timing of reading of recording data assigned to each recording element is changed. FIG. 25 schematically shows an arrangement of dots formed on the recording medium under the absence of inclination deviation as a result of recording by backward scanning of the recording head (scanning in a direction from the right to the left in FIG. 25), wherein the timing of reading of recording data assigned to each recording element is changed. FIGS. 24 and 25 show an example of correction of inclination deviation caused by clockwise inclination by 0.75 columns, each column corresponding to 1200 dpi (about 21 microns), between the top group and the bottom group.

First, the correction of inclination deviation caused in forward scanning will be described with reference to FIG. 24. In this example, group 0 (1901) formed by recording elements 0 to 15 is a reference group. For the recording elements of group 0, the read position of recording data for any recording element is not offset. For group 1 (1902) formed by recording elements 16 to 31, a rough metering value of 0 and a fine metering value of 4 are set as correction values. Thus, the read position of recording data for all the recording elements is not offset while the read position of recording data corresponding to the recording elements of blocks 0 to 3 is offset in the main scanning direction. For group 2 (1903) formed by recording elements 32 to 47, a rough metering value of 0 and a fine metering value of 8 are set as correction values. The read position of recording data for all the recording elements is not offset while the read position of recording data corresponding to the recording elements of blocks 0 to 7 is offset in the main scanning direction. For group 3 (1904) formed by recording elements 48 to 63, a rough metering value of 0 and a fine metering value of 12 are set. The read position of recording data for all the recording elements is not offset while the read position of recording data corresponding to the recording elements of blocks 0 to 11 is offset in the main scanning direction.

Next, the correction of inclination deviation caused in scanning reverse to the forward scanning will be described with reference to FIG. 25. In this example, group 3 (2004) formed by recording elements 48 to 63 is a reference group. For the recording elements of group 3, the read position of recording data for any recording element is not offset. For group 2 (2003) formed by recording elements 32 to 47, a rough metering value of 0 and a fine metering value of 4 are set as correction values. Thus, the read positing of recording data for all the recording elements is not offset while the read position of recording data corresponding to the recording elements of blocks 15 to 12 is offset in the main scanning direction. For group 1 (2002) formed by recording elements 16 to 31, a rough metering value of 0 and a fine metering value of 8 are set as correction values. The read position of recording data for all the recording elements is not offset while the read position of recording data corresponding to the recording elements of blocks 15 to 8 is offset in the main scanning direction. For group 0 (2001) formed by recording elements 0 to 15, a rough metering value of 0 and a fine metering value of 12 are set as correction values. The read position of recording data for all the recording elements is not offset while the read position of recording data for the recording elements of blocks 15 to 4 is offset in the main scanning direction.

Accordingly, as in the first embodiment, with the correction of inclination deviation using a correction value including a rough metering value and a fine metering value, inclination deviation can be corrected even in scanning in each direction of two-way recording, and deterioration in image quality can be reduced. It is to be understood that the timing of starting of the driving of scanning of each direction in two-way recording is shifted as appropriate so that an arrangement of dots recorded in the same area using data corrected using the method shown FIGS. 24 and 25 can be superimposed at a desired position.

Furthermore, a rough metering value and a fine metering value are not specifically limited as long as the dots formed using recording data after correction are arranged in a desired manner so that inclination deviation can be corrected. FIG. 26 shows another example of correction of inclination deviation caused in reverse scanning.

In this example, for group 3 (2104) formed by recording elements 48 to 63, a rough metering value of 0 and a fine metering value of 4 are set. Thus, the read position of recording data for all the recording elements is not offset while the read position of recording data corresponding to the recording elements of blocks 15 to 12 is offset in the main scanning direction.

For group 2 (2103) formed by recording elements 32 to 47, a rough metering value of 0 and a fine metering value of 8 are set as correction values. Thus, the read position of recording data for all the recording elements is not offset while the read position of recording data corresponding to the recording elements of blocks 15 to 8 is offset in the main scanning direction. For group 1 (2102) formed by recording elements 16 to 31, a rough metering value of 0 and a fine metering value of 12 are set as correction values, and the read position of recording data for all the recording elements is not offset. The read position of reading data corresponding to the recording elements of blocks 15 to 4 is offset in the main scanning direction. For group 0 (2101) formed by recording elements 0 to 15, a rough metering value of 1 and a fine metering value of 0 are set as correction values. Thus, the read position of recording data for all the recording elements belonging to group 1 is offset by one column.

Accordingly, the arrangement of dots formed using recording data after correction may be corrected so that inclination deviation can be corrected, and the timing of starting of the driving of scanning of each direction in two-way recording is shifted so that an arrangement of dots recorded in reciprocating scanning can be superimposed at a desired position.

Third Embodiment

Figure 28:
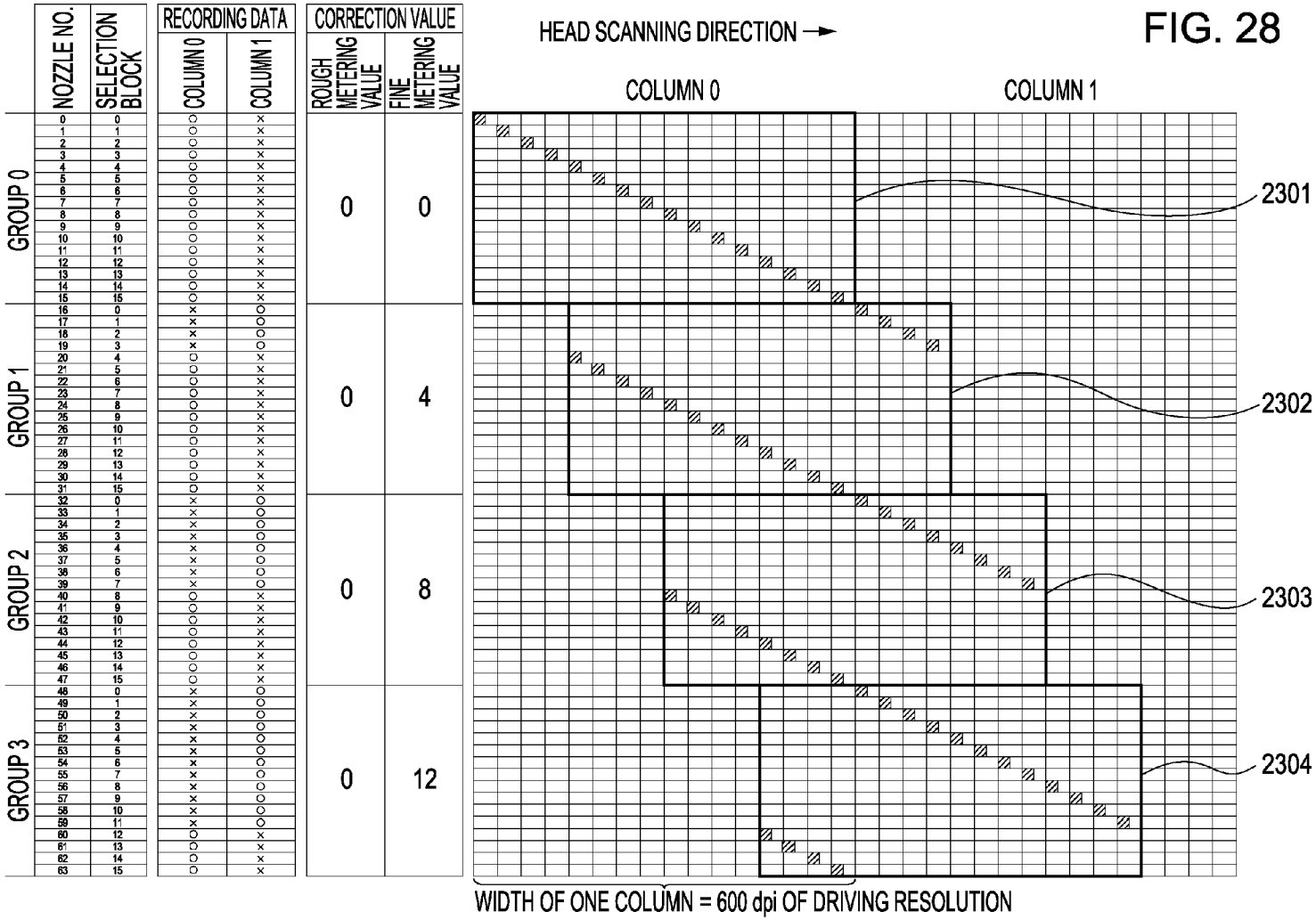
FIG. 28 is a diagram showing a method of correcting another recording element array for inclination deviation using a rough metering value and a fine metering value.
Figure 30:
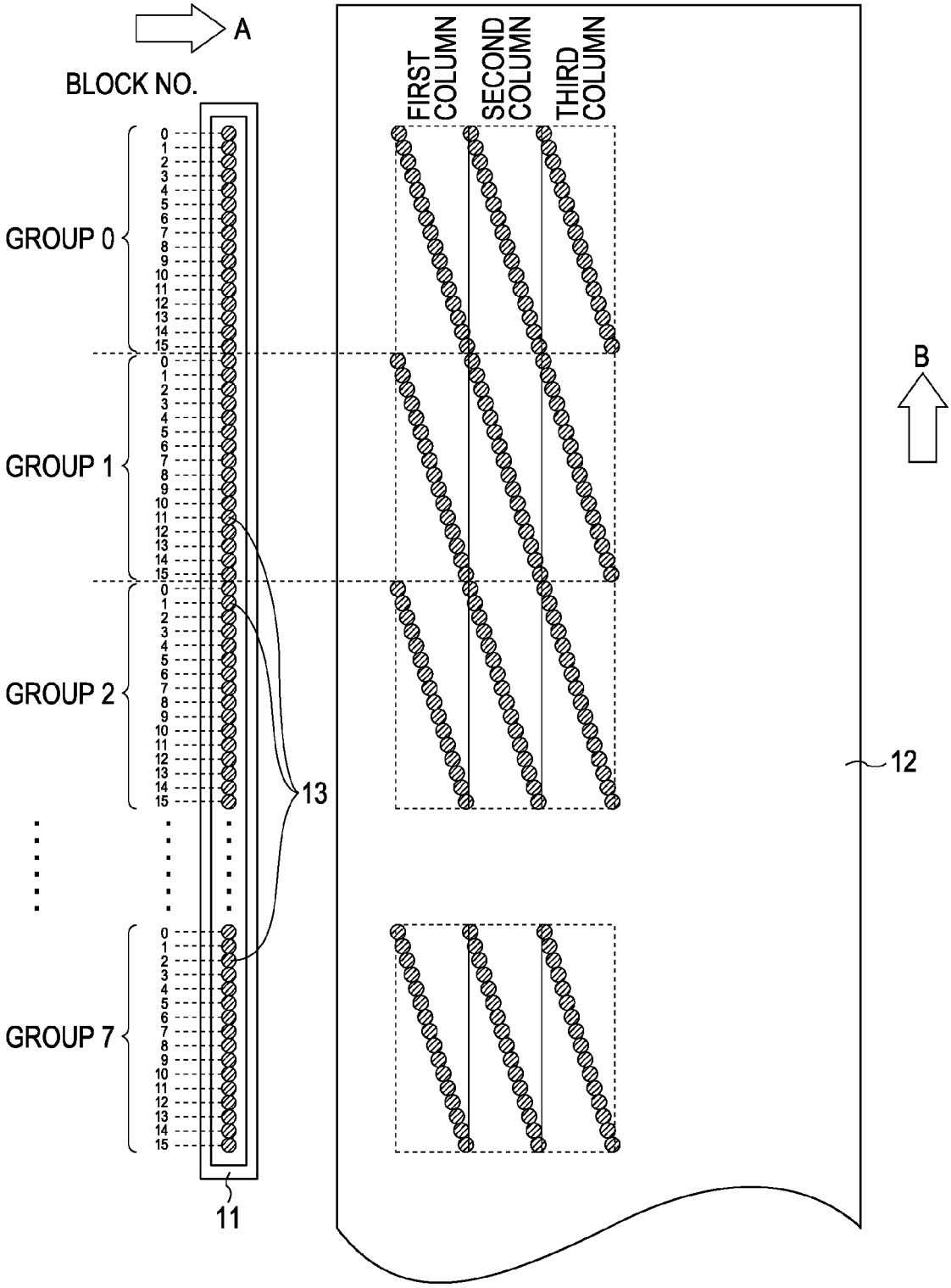
FIG. 30 is a diagram showing an arrangement of dots formed under the absence of inclination deviation.
Figure 31:
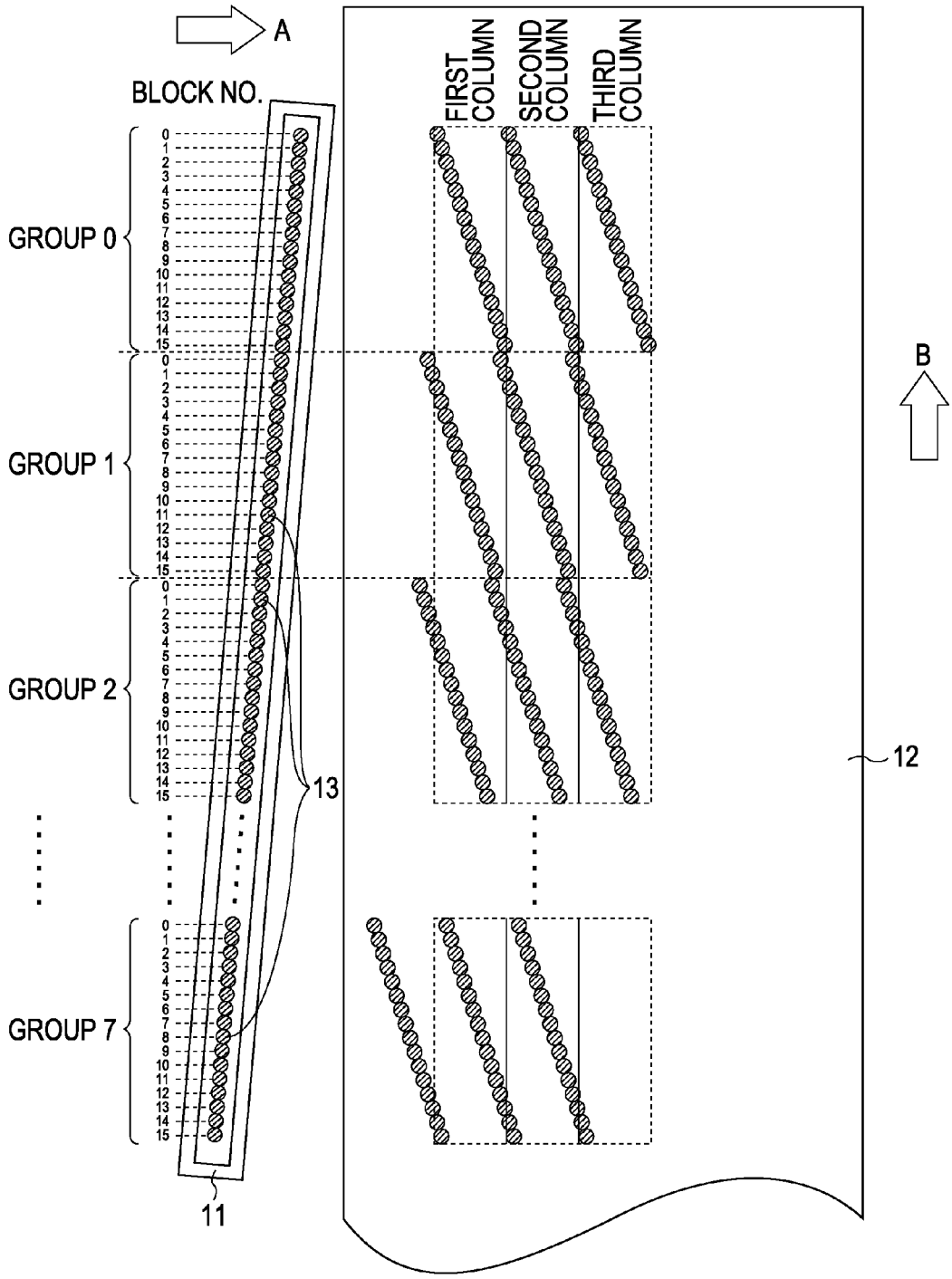
FIG. 31 is a diagram showing an arrangement of dots formed under the presence of inclination deviation.
Figure 32:
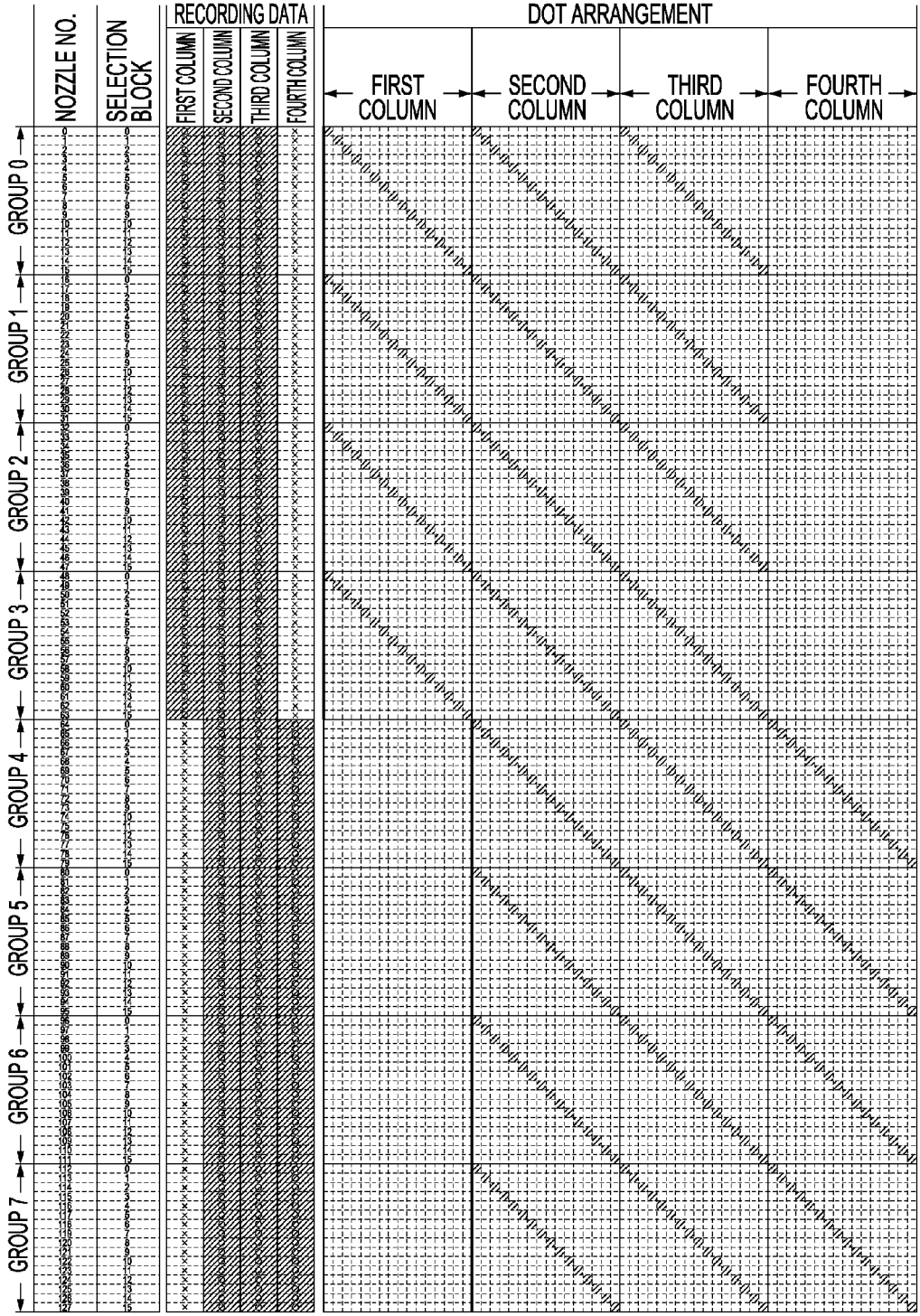
FIG. 32 is a diagram showing nozzle numbers, blocks, recording data, and a dot arrangement in the correction of inclination deviation described in Japanese Patent Laid-Open No. 2004-09489.
Figure 33:
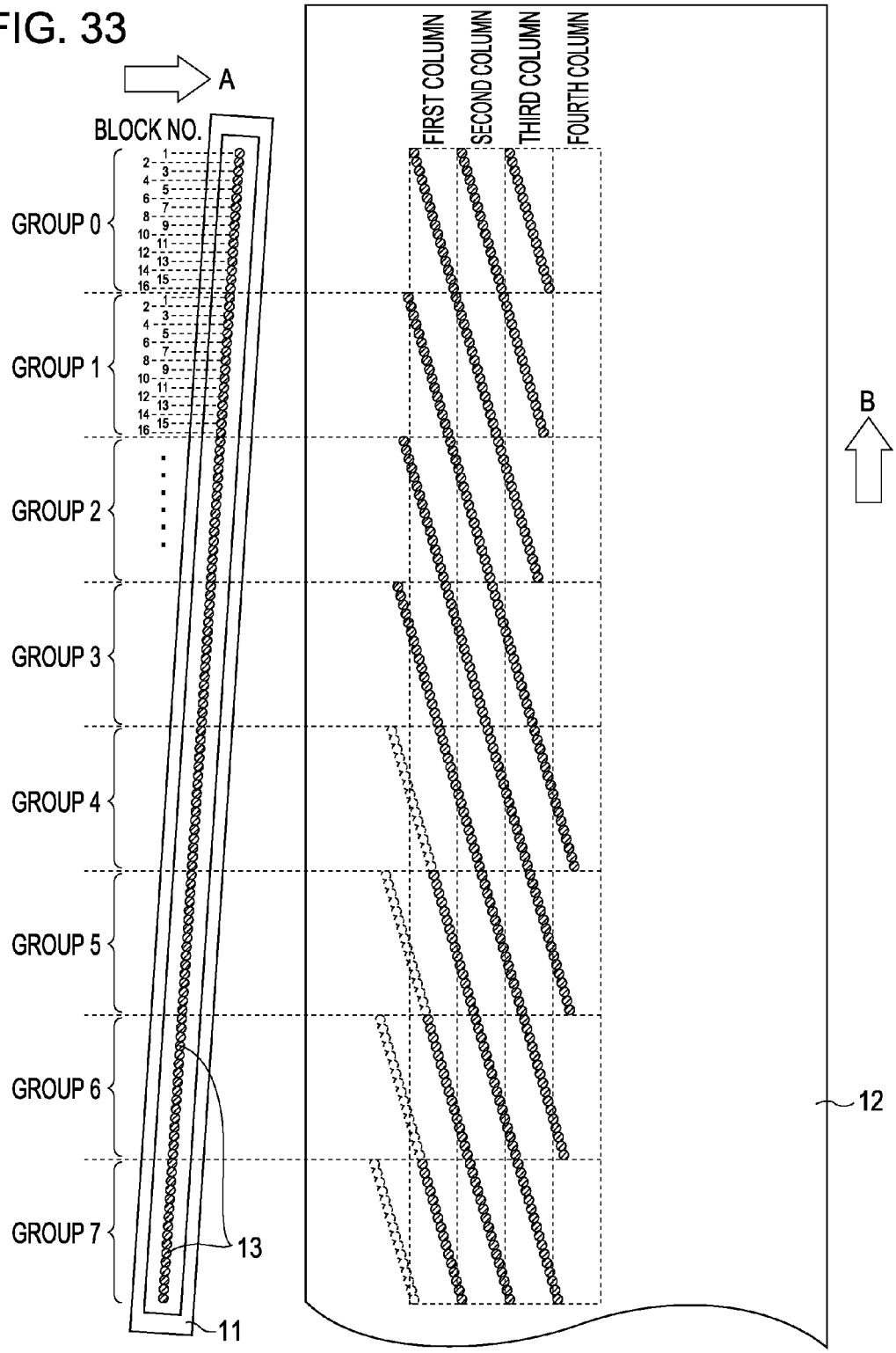
FIG. 33 is a diagram showing an arrangement of dots formed as a result of the correction of inclination deviation described in Japanese Patent Laid-Open No. 2004-09489.

A third embodiment provides a method of correcting inclination deviation in a case where recording is performed using a plurality of recording element arrays having different driving resolutions at the same time. FIG. 27 shows a method of correcting inclination deviation of dots using a recording element array A having a driving resolution of 1200 dpi, and FIG. 28 shows a method of correcting inclination deviation of dots using a recording element array B having a driving resolution of 600 dpi. In the following description, each of the recording element arrays A and B includes 64 ink ejection ports. It is also assumed that the recording element arrays A and B are inclined clockwise by 1.5 columns, each column corresponding to 1200 dpi (about 21 microns), between the top group and the bottom group.

The data assigned to the recording element array A shown in FIG. 27 corresponds to two columns, namely, columns 0 and 1, and the data assigned to the recording element array B shown in FIG. 28 corresponds to one column, namely, column 0. The amount of data in the main scanning direction differs between the recording element arrays A and B. However, since the driving resolution also differs, dots are arranged across the same width in the main scanning direction.

First, a method of correcting inclination deviation for the recording element array A shown in FIG. 27 will be described. In the recording element array A, group 0 (2201) formed by recording elements 0 to 15 is a reference group. For the recording elements of group 0, the read position of recording data for any recording element is not offset. For group 1 (2202) formed by recording elements 16 to 31, a rough metering value of 0 and a fine metering value of 8 are set as correction values. Thus, the read position of recording data for all the recording elements is not offset while the read position of recording data corresponding to the recording elements of blocks 0 to 7 is offset in the main scanning direction.

For group 2 (2203) formed by recording elements 32 to 47, a rough metering value of 1 and a fine metering value of 0 are set as correction values, and the read position of recording data for all the recording elements belonging to group 2 is offset by one column. For group 3 (2204) formed by recording elements 48 to 63, a rough metering value of 1 and a fine metering value of 8 are set as correction values. First, data is offset for the entire group by one column. Then, the read position of recording data corresponding to the recording elements of blocks 0 to 7 is offset by one column in the main scanning direction.

Next, a method of correcting inclination deviation for the recording element array B shown in FIG. 28 will be described. In the recording element array B, group 0 (2301) formed by recording elements 0 to 15 is a reference group. For the recording elements of group 0, the read position of recording data for any recording element is not offset. For group 1 (2302) formed by recording elements 16 to 31, a rough metering value of 0 and a fine metering value of 4 are set as correction values. Thus, the read position of recording data for all the recording elements is not offset while the read position of recording data corresponding to the recording elements of blocks 0 to 3 is or offset in the main scanning direction. For group 2 (2303) formed by recording elements 32 to 47, a rough metering value of 0 and a fine metering value of 8 are set as correction values, and the read position of recording data for all the recording elements is not offset. The read position of recording data corresponding to the recording elements of blocks 0 to 7 is offset in the main scanning direction. For group 3 (2304) formed by recording elements 48 to 63, a rough metering value of 0 and a fine metering value of 12 are set as correction values. The read position of recording data for all the recording elements is not offset while the read position of recording data corresponding to the recording elements of blocks 0 to 11 is offset in the main scanning direction.

Accordingly, even in the recording operation using recording element arrays having different driving resolutions at the same time, inclination deviation can be corrected using a correction value including a rough metering value and a fine metering value.

Other Embodiments

FIG. 29 shows correction information that is stored in the correction value storage unit 217. As shown in FIG. 29, correction information is stored in the form of a table, and a rough metering value and a fine metering value are stored as correction values for each group. FIG. 29 shows information concerning the amount of correction for clockwise deviation of inclination by 0.75 columns, each column corresponding to a resolution of 1200 dpi.

The creation of a test pattern is not limited to that described in the foregoing example. For example, first, the amount of inclination deviation may be detected using a pattern by which relatively rough deviation as much as about the recording resolution can be detected, and rough adjustment is performed. Then, a test pattern capable of detecting a smaller amount of inclination deviation than the unit of recording resolution may be created after rough adjustment is performed, and a smaller amount of inclination deviation than the recording resolution may be detected.

Further, a rough metering value or a fine metering value may be selectively used as a correction value depending on the required image quality or the degree of adverse effect on an image due to inclination to perform correct of inclination deviation. For example, for high-resolution recording such as printing of photographic data, a correction value including a rough metering value and a fine metering value may be used to perform high-resolution correction processing. For recording with relatively less noticeable adverse effect on an image, such as printing of text on plain paper, on the other hand, correction processing may be performed using a correction value including only a rough metering value or correction processing may not be necessarily performed.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-172740 filed Jun. 29, 2007, which is hereby incorporated by reference herein in its entirety.

What is claimed is:

1. A recording apparatus that scans a recording head in a main scanning direction to perform time-division driving for a plurality of blocks of recording elements, the recording head including a recording element array having a plurality of recording elements, each of blocks including recording elements located at discrete positions in the recording element array, the recording apparatus comprising:

a storage unit configured to store recording data items;

an obtaining unit configured to obtain information regarding inclination of the recording element array with respect to the main scanning direction;

a first changing unit configured to change, in units of the recording elements, based on the obtained information, storage positions of recording data items in the main scanning direction that are stored in the storage unit and that are assigned to recording elements in each of groups, each of the groups including recording elements belonging to the blocks in the recording element array which are consecutive; and a second changing unit configured to change, in units of the groups, based on the obtained information, the storage positions of the recording data items in the main scanning direction.

2. The recording apparatus according to claim 1, wherein the first changing unit changes the storage positions of the recording data items in the main scanning direction so that dots formed on a recording medium by recording elements belonging to an identical group are arranged in an identical column on the recording medium.

3. The recording apparatus according to claim 1, wherein the number of recording elements that are assigned recording data items for which storage positions in the main scanning direction have been changed in one of the groups that includes a recording element located at a first end of the recording element array is different from the number of recording elements that are assigned recording data items for which storage positions in the main scanning direction have been changed in one of the groups that includes a recording element located at a second end of the recording element array.

4. The recording apparatus according to claim 3, wherein the number of recording elements that are assigned recording data items for which storage positions in the main scanning direction have been changed in each of the groups increases from the one group that includes the recording element located at the first end of the recording element array to the one group that includes the recording element located at the second end of the recording element array.

5. A recording apparatus that scans a recording head in a main scanning direction to perform time-division driving for a plurality of blocks of recording elements, the recording head including a recording element array having a plurality of recording elements, each of blocks including recording elements that are located at discrete positions in the recording element array, the recording apparatus comprising:

a storage unit configured to store recording data items;

an obtaining unit configured to obtain information regarding inclination of the recording element array with respect to the main scanning direction;

a first reading unit configured to read, in units of the recording elements, based on the obtained information, recording data items stored at different positions in the main scanning direction in the storage unit so that recording elements belonging to an identical block are substantially simultaneously driven; and a second reading unit configured to read, in units of groups, based on the obtained information, recording data items stored at different positions in the storage unit in the main scanning direction so that recording elements belonging to an identical block are substantially simultaneously driven, each of the groups including recording elements belonging to the blocks in the recording element array which are consecutive.

6. The recording apparatus according to claim 5, wherein the first reading unit reads the recording data items stored at different positions in the main scanning direction so that dots formed on a recording medium by recording elements belonging to an identical group are arranged in an identical column on the recording medium.

7. The recording apparatus according to claim 5, wherein the number of recording elements driven in each of the groups by reading recording data items stored at different positions in the main scanning direction increases from one of the groups that includes a recording element located at a first end of the recording element array to one of the groups that includes a recording element located at a second end of the recording element array.

8. The recording apparatus according to claim 7, wherein the amount of inclination of the recording element array with respect to the main scanning direction is larger in a second state than in a first state, and wherein the number of recording elements driven by reading recording data items stored at different positions in the main scanning direction is larger in the second state than in the first state.

9. A recording apparatus that scans a recording head in a main scanning direction to perform time-division driving for a plurality of blocks of recording elements, the recording head including a recording element array having a plurality of recording elements, each of blocks including recording elements located at discrete positions in the recording element array, the recording apparatus comprising:

a storage unit configured to store recording data items;

an obtaining unit configured to obtain information regarding inclination of the recording element array with respect to the main scanning direction;

a changing unit configured to change, in units of groups, based on the obtained information, storage positions of the recording data items that are stored in the storage unit in the main scanning direction and that are assigned to recording elements in each of groups, each of the groups including recording elements belonging to the blocks in the recording element array which are consecutive; and a reading unit configured to read, in units of the recording elements, based on the obtained information, the recording data items for which the storage positions have been changed by the changing unit so that recording elements belonging to an identical block are substantially simultaneously driven.

* * * * *